US005528899A

United States Patent [19]

Ono

[11] Patent Number: 5,528,899

[45] Date of Patent: Jun. 25, 1996

[54] AIR-FUEL RATIO CONTROL APPARATUS FOR INTERNAL COMBUSTION ENGINES

[75] Inventor: Kenichi Ono, Kariya, Japan

[73] Assignee: Nippondenso Co., Ltd., Aichi-Pref., Japan

[21] Appl. No.: 357,224

[22] Filed: Dec. 12, 1994

[30] Foreign Application Priority Data

| | | | |
|---|---|---|---|
| Dec. 13, 1993 | [JP] | Japan | 5-311972 |
| Dec. 27, 1993 | [JP] | Japan | 5-350448 |
| Mar. 24, 1994 | [JP] | Japan | 6-053682 |

[51] Int. Cl.[6] ..... F01N 3/28

[52] U.S. Cl. ..... 60/276; 60/285

[58] Field of Search ..... 60/276, 285

[56] References Cited

U.S. PATENT DOCUMENTS

| | | | |
|---|---|---|---|
| 4,761,950 | 8/1988 | Nagai et al. | 60/276 |
| 5,193,339 | 3/1993 | Furuya | 60/276 |
| 5,337,557 | 8/1994 | Toyoda | 60/276 |
| 5,341,641 | 8/1994 | Nakajima | 60/285 |

FOREIGN PATENT DOCUMENTS

| | | |
|---|---|---|
| 62-60941 | 3/1987 | Japan . |
| 2-238147 | 9/1990 | Japan . |
| 4-101038 | 4/1992 | Japan . |

*Primary Examiner*—Douglas Hart
*Attorney, Agent, or Firm*—Cushman Darby & Cushman

[57] ABSTRACT

An air-fuel ratio control system for an internal combustion engine is provided. This system has an upstream air-fuel ratio sensor arranged upstream of a catalytic converter and a downstream air-fuel ratio sensor arranged downstream thereof, and learns a given feedback control parameter upon reversal of an air-fuel ratio between rich and lean sides based on the downstream air-fuel ratio sensor. The system also learns the given feedback control parameter when preselected conditions are met even if the air-fuel ratio is not reversed. Additionally, the system, when brought under open-loop control from feedback control, stores the given control parameter. Upon resumption of the feedback control, when the air-fuel ratio shows the same status, the stored given control parameter is used. Further, the system controls the air-fuel ratio based on the output from the downstream air-fuel ratio sensor when it moves out of a preselected range.

27 Claims, 32 Drawing Sheets

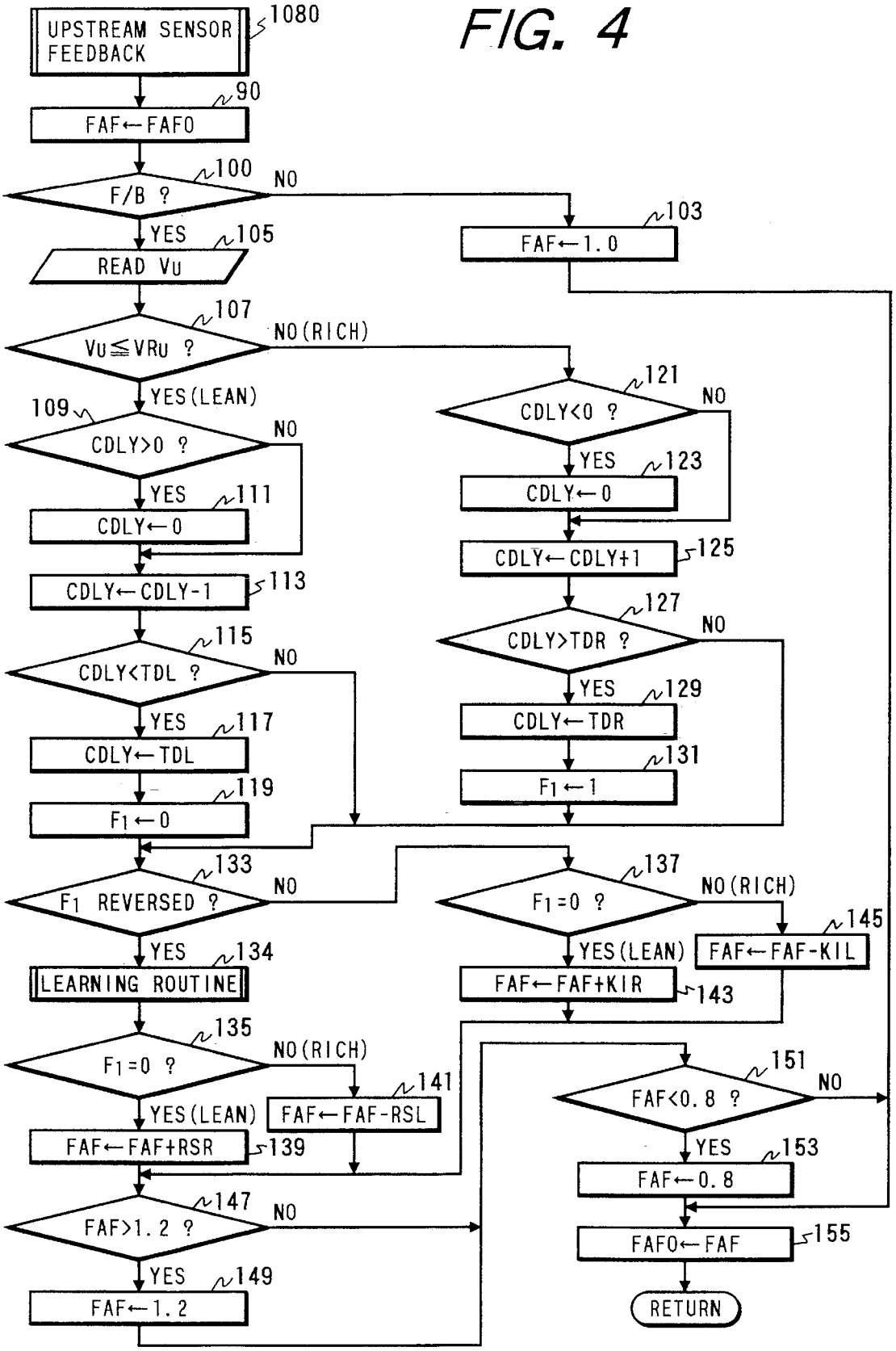
FIG. 4
UPSTREAM SENSOR FEEDBACK
1080
FAF←FAFO
90
F/B ?
100
NO
YES
READ Vu
105
FAF←1.0
103
Vu≦VRu ?
107
NO(RICH)
YES(LEAN)
CDLY>0 ?
109
NO
YES
CDLY←0
111
CDLY←CDLY-1
113
CDLY<TDL ?
115
NO
YES
CDLY←TDL
117
F1←0
119
CDLY<0 ?
121
NO
YES
CDLY←0
123
CDLY←CDLY+1
125
CDLY>TDR ?
127
NO
YES
CDLY←TDR
129
F1←1
131
F1 REVERSED ?
133
NO
YES
LEARNING ROUTINE
134
F1=0 ?
135
NO(RICH)
YES(LEAN)
FAF←FAF-RSL
141
FAF←FAF+RSR
139
FAF>1.2 ?
147
NO
YES
FAF←1.2
149
F1=0 ?
137
NO(RICH)
YES(LEAN)
FAF←FAF-KIL
145
FAF←FAF+KIR
143
FAF<0.8 ?
151
NO
YES
FAF←0.8
153
FAFO←FAF
155
RETURN

START
1601
READ EXHAUST FLOW RATE
1602
READ ΔF
1603
REFLECTING ΔF ON FAF
RETURN

START
1611
UPSTREAM RICH AND DOWNSTREAM LEAN ?
YES
NO
1612
UPSTREAM LEAN AND DOWNSTREAM LEAN ?
YES
NO
1613
REFLECTING ΔF1 ON FAF
1614
REFLECTING ΔF2 ON FAF
RETURN

START
1621
FWIN=0 ?
YES
NO
1622
FWIN 1→0 ?
YES
NO
1623
START TIMER
1624
READ ΔF
1625
REFLECTING ΔF ON FAF
1626
FWIN 0→1 ?
YES
NO
1627
RESET TIMER
RETURN

AIR-FUEL RATIO CONTROL APPARATUS FOR INTERNAL COMBUSTION ENGINES

BACKGROUND OF THE INVENTION

1. Technical Field of the Invention

The present invention relates generally to an air-fuel ratio control apparatus for internal combustion engines, and more particularly to an improved air-fuel ratio control apparatus which is designed to correct an air-fuel ratio control parameter using outputs from two oxygen sensors arranged upstream and downstream of a catalytic converter, respectively.

2. Background Art

Japanese Patent First Publication No. 62-60941 discloses a two-$O_2$ sensor system having two oxygen sensors: one being located upstream of a catalytic converter (hereinafter, referred to as an upstream sensor) and the other being located downstream thereof (hereinafter, referred to as a downstream sensor). This conventional system controls an air-fuel ratio around a stoichiometric air-fuel ratio using an output signal from the upstream sensor, and further corrects air-fuel ratio control parameters such as an integration constant, a skip amount, delay time, and a reference voltage, based on an output signal from the downstream sensor for reducing the deterioration of and variations in exhaust emissions due to the variation in characteristic and deterioration with age of the upstream sensor and the variation in engine operation.

The above two-$O_2$ sensor system monitors an air-fuel ratio downstream of the catalytic converter to determine whether an actual air-fuel ratio falls within a catalyst window (i.e., a region where any of harmful emissions such as $NO_X$, CO, and HC contained in the exhaust gas is decreased) or not for controlling the actual air-fuel ratio to within the catalyst window. This results in greatly improved emission control. For example, the use of only the upstream sensor will cause the exhaust gas from a specific cylinder to be monitored mainly dependent upon a mounted location of the upstream sensor. This makes it difficult to bring the air-fuel ratio to within the catalyst window. The two-$O_2$ sensor system can eliminate such a problem to optimize emission control regardless of the variation in engine operation or deterioration of the engine as well as the variation in characteristic of the upstream sensor.

The above prior art system, however, has the drawbacks in that the influence of $O_2$ storage effects (i.e., a function of accumulating or discharging oxygen) of the catalytic converter increases a time interval between the change in air-fuel ratio upstream of the catalytic converter and the change in air-fuel ratio downstream thereof, resulting in a reduced response rate of the downstream sensor to prolong a control cycle. Additionally, since the air-fuel ratio control parameters are corrected based on the output from the downstream sensor, it is required to delay a correction speed (i.e., a speed at which the control parameters are modified to change an air-fuel ratio) of the air-fuel ratio control parameter for preventing exhaust emissions from being degraded due to the overshoot induced by the reduced response rate of the downstream sensor.

Therefore, because of the prolonged control cycle and the slow control speed, it is difficult or impossible to correct the air-fuel ratio control parameters in transition conditions. The feedback control (hereinafter, referred to as downstream $O_2$ feedback control) for correcting the air-fuel ratio control parameters through the downstream sensor can be carded out only under steady conditions (e.g., during traveling at a constant speed in an intermediate-high speed range).

For this reason, during traveling conditions other than the steady conditions (e.g., transition conditions), the downstream $O_2$ feedback control is inhibited, and instead control parameters learned during the downstream $O_2$ feedback control are used for controlling the air-fuel ratio. This learning is performed in timing where an output from the downstream sensor is reversed between a rich value indicating that an air-fuel ratio is richer than the stoichiometric air-fuel ratio and a lean value indicating that the air-fuel ratio is leaner than the stoichiometric air-fuel ratio, that is, where a difference between an actual air-fuel ratio and the stoichiometric air-fuel ratio may be considered to almost be compensated for. In fact, values of the control parameters upon a rich-to-lean reversal and values of the control parameters upon a lean-to-rich reversal immediately before the rich-to-lean reversal, are averaged to derive learning values.

The above system, however, has suffered from the drawback in that since the learning is not performed unless the output from the downstream sensor is reversed, the optimum control may not be achieved for a long time.

For example, when values of the control parameters upon initiation of the downstream $O_2$ feedback control are greatly different from optimum values, the reversal of the output from the downstream sensor does not occur for an extended period of time. Thus, during this period, when a gear shift is achieved or the vehicle accelerates or decelerates to bring the vehicle into transition conditions, the downstream $O_2$ feedback control is prohibited, so that the control parameters are returned back to their respective initial values.

Additionally, a reversal cycle of the output from the downstream sensor is usually as much as several tens to several hundreds of seconds. Therefore, during running in town as well as when the initial values of the control parameters are greatly different from the optimum values, the downstream $O_2$ feedback control is sometimes opened before the reversal of the output of the downstream sensor occurs. It is, thus, difficult to have the control parameters reach the optimum values due to the length of the control cycle or the delay of the control speed.

Therefore, the above prior art system give rise to problems in that because of the inevitable characteristics of the downstream sensor, exhaust emissions may not be improved for a considerably extended period of time after assembly at the factory or replacement of a battery, initializing the system, and it may be difficult to return the emission control to optimum levels.

SUMMARY OF THE INVENTION

It is therefore a principal object of the present invention to avoid the disadvantages of the prior art.

It is another object of the present invention to provide an improved air-fuel ratio control apparatus for an automotive vehicle which is designed to achieve the optimum emission control level quickly, for example, after shipment or replacement of a battery.

According to one aspect of the present invention, there is provided an air-fuel ratio control apparatus for an internal combustion engine which comprises an upstream air-fuel ratio sensor arranged in a portion of an exhaust passage of the internal combustion engine upstream of a catalytic converter to provide a signal having a sensor parameter indicative of an air-fuel ratio of an air-fuel mixture, a downstream air-fuel ratio sensor arranged in a portion of the exhaust passage downstream of the catalytic converter to provide a signal having a sensor parameter indicative of the air-fuel ratio, a control parameter determining means for determining a given control parameter used for controlling the air-fuel ratio under air-fuel ratio control based on the signal outputted from the downstream air-fuel ratio sensor, a learning means for learning the given control parameter determined by the control parameter determining means in timing where the signal outputted form the downstream air-fuel ratio sensor is reversed between a first sensor parameter indicating that the air-fuel ratio is on a rich side and a second sensor parameter indicating that the air-fuel ratio is on a lean side, an air-fuel ratio control means for performing the air-fuel ratio control based on the signal outputted from the upstream air-fuel ratio sensor and the given control parameter either determined by the control parameter determining means or learned by the learning means, and a learning execution means for executing a learning operation of the learning means when a preselected condition is encountered.

According to another aspect of the present invention, there is provided an air-fuel ratio control apparatus for an internal combustion engine which comprises an upstream air-fuel ratio sensor arranged in a portion of an exhaust passage of the internal combustion engine upstream of a catalytic converter to provide a signal having a sensor parameter indicative of an air-fuel ratio of an air-fuel mixture, a downstream air-fuel ratio sensor arranged in a portion of the exhaust passage downstream of the catalytic converter to provide a signal having a sensor parameter indicative of the air-fuel ratio, a control parameter determining means for determining a given control parameter for controlling the air-fuel ratio of the air-fuel mixture, based on the sensor parameter provided by the downstream air-fuel ratio sensor under a given condition, an air-fuel ratio controlling means for controlling the air-fuel ratio of the air-fuel mixture based on the sensor parameter provided by the upstream air-fuel ratio sensor, the air-fuel ratio controlling means correcting the air-fuel ratio based on the given control parameter determined by the control parameter determining means, a learning means for learning the given control parameter to derive a learning value and storing the learning value every given cycle under the given condition, a storing means for storing the given control parameter determined by the control parameter determining means, a convergence determining means for determining whether the learning value learned by the learning means has converged or not, and a control parameter updating means for updating the given control parameter to a value within a given range including a value of the given control parameter stored in the storing means when the convergence determining means concludes that the learning value is not converged.

According to a further aspect of the present invention, there is provided an air-fuel ratio control apparatus for an internal combustion engine which comprises an upstream air-fuel ratio sensor arranged in a portion of an exhaust passage of the internal combustion engine upstream of a catalytic converter to provide a signal having a sensor parameter indicative of an air-fuel ratio of an air-fuel ratio mixture, a downstream air-fuel ratio sensor arranged in a portion of the exhaust passage downstream of the catalytic converter to provide a signal having a sensor parameter indicative of the air-fuel ratio, a first air-fuel ratio controlling means for controlling the air-fuel ratio of the air-fuel mixture of the internal combustion engine, the first air-fuel ratio controlling means determining an air-fuel ratio correction mount based on the sensor parameter provided by the upstream air-fuel ratio sensor and correcting the air-fuel ratio correction amount based on the sensor parameter provided by the downstream air-fuel ratio sensor to control the air-fuel ratio of the air-fuel mixture, a second air-fuel ratio controlling means for controlling the air-fuel ratio of the air-fuel mixture, the second air-fuel ratio controlling means determining an air-fuel ratio correction amount based on the sensor parameter provided by the downstream air-fuel ratio sensor to control the air-fuel ratio, a sensor parameter determining means for determining if the sensor parameter provided by the downstream air-fuel ratio sensor falls within a given range to provide a first signal indicative of the sensor parameter falling within the given range and a second signal indicative of the sensor parameter lying out of the given range, and a control mode selecting means for selecting between a first control mode and a second control mode, the first mode being such that the first air-fuel ratio controlling means is activated in response to the first signal provided by the sensor parameter determining means, the second control mode being such that the second air-fuel ratio controlling means is activated in response to the second signal provided by the sensor parameter determining means.

According to a yet further aspect of the present invention, there is provided an air-fuel ratio control apparatus for an internal combustion engine which comprises an upstream air-fuel ratio sensor arranged in a portion of an exhaust passage of the internal combustion engine upstream of a catalytic converter to provide a signal having a sensor parameter indicative of an air-fuel ratio of an air-fuel mixture, a downstream air-fuel ratio sensor arranged in a portion of the exhaust passage downstream of the catalytic converter to provide a signal having a sensor parameter indicative of the air-fuel ratio, a control parameter determining means for determining a given control parameter for controlling the air-fuel ratio of the air-fuel mixture, based on the sensor parameter provided by the downstream air-fuel ratio sensor under a given condition, a learning means for learning the given control parameter determined by the control parameter determining means in timing where the signal outputted form the downstream air-fuel ratio sensor is reversed between a first sensor parameter indicating that the air-fuel ratio is on a rich side and a second sensor parameter indicating that the air-fuel ratio is on a lean side, to derive a learning value, the learning means storing the learning value, an air-fuel ratio control means for performing the air-fuel ratio control based on the signal outputted from the upstream air-fuel ratio sensor and either of the given control parameter determined by the control parameter determining means and the learning value learned by the learning means, a learning execution means for executing a learning operation of the learning means when the signal provided by the downstream air-fuel ratio sensor provides a parameter indicative of a preselected condition, a storing means for storing the given control parameter determined by the control parameter determining means, a convergence determining means for determining whether the learning value learned by the learning means has converged or not, and a control parameter updating means for updating the given control parameter to a value within a given range including a value of the given control parameter stored in the storing means when the convergence determining means concludes that the learning value is not converged.

According to a still further aspect of the present invention, there is provided an air-fuel ratio control apparatus for an internal combustion engine which comprises an upstream air-fuel ratio sensor arranged in a portion of an exhaust passage of the internal combustion engine upstream of a catalytic converter to provide a signal having a sensor parameter indicative of an air-fuel ratio of an air-fuel mixture, a downstream air-fuel ratio sensor arranged in a portion of the exhaust passage downstream of the catalytic converter to provide a signal having a sensor parameter indicative of the air-fuel ratio, a control parameter determining means for determining a given control parameter used for controlling the air-fuel ratio under air-fuel ratio control based on the signal outputted from the downstream air-fuel ratio sensor, a learning means for learning the given control parameter determined by the control parameter determining means in timing where the signal outputted form the downstream air-fuel ratio sensor is reversed between a first sensor parameter indicating that the air-fuel ratio is on a rich side and a second sensor parameter indicating that the air-fuel ratio is on a lean side, a learning execution means for executing a learning operation of the learning means when the signal provided by the downstream air-fuel ratio sensor provides a parameter indicative of a preselected condition, a first air-fuel ratio controlling means for controlling the air-fuel ratio of the air-fuel mixture of the internal combustion engine, the first air-fuel ratio controlling means determining an air-fuel ratio correction amount based on the sensor parameter provided by the upstream air-fuel ratio sensor and correcting the air-fuel ratio correction amount based the given control parameter either determined by the control parameter determining means or learned by the learning means to control the air-fuel ratio of the air-fuel mixture, a second air-fuel ratio controlling means for controlling the air-fuel ratio of the air-fuel mixture, the second air-fuel ratio controlling means determining an air-fuel ratio correction amount based on the sensor parameter provided by the downstream air-fuel ratio sensor to control the air-fuel ratio, a sensor parameter determining means for determining if the sensor parameter provided by the downstream air-fuel ratio sensor falls within a given range to provide a first signal indicative of the sensor parameter falling within the given range and a second signal indicative of the sensor parameter lying out of the given range, and a control mode selecting means for selecting between a first control mode and a second control mode, the first mode being such that the first air-fuel ratio controlling means is activated in response to the first signal provided by the sensor parameter determining means, the second control mode being such that the second air-fuel ratio controlling means is activated in response to the second signal provided by the sensor parameter determining means.

According to a further aspect of the present invention, there is provided an air-fuel ratio control apparatus for an internal combustion engine which comprises an upstream air-fuel ratio sensor arranged in a portion of an exhaust passage of the internal combustion engine upstream of a catalytic converter to provide a signal having a sensor parameter indicative of an air-fuel ratio of an air-fuel mixture, a downstream air-fuel ratio sensor arranged in a portion of the exhaust passage downstream of the catalytic converter to provide a signal having a sensor parameter indicative of the air-fuel ratio, a control parameter determining means for determining a given control parameter for controlling the air-fuel ratio of the air-fuel mixture, based on the sensor parameter provided by the downstream air-fuel ratio sensor under a given condition, a learning means for learning the given control parameter to derive a learning value and storing the learning value every given cycle under the given condition, a storing means for storing the given control parameter determined by the control parameter determining means, a convergence determining means for determining whether the learning value learned by the learning means has converged or not, a control parameter updating means for updating the given control parameter to a value within a given range including a value of the given control parameter stored in the storing means when the convergence determining means concludes that the learning value is not converged, a first air-fuel ratio controlling means for controlling the air-fuel ratio of the air-fuel mixture of the internal combustion engine, the first air-fuel ratio controlling means determining an air-fuel ratio correction amount based on the sensor parameter provided by the upstream air-fuel ratio sensor and correcting the air-fuel ratio correction amount based on the given control parameter either determined by the control parameter determining means or learned by the learning means to control the air-fuel ratio of the air-fuel mixture, a second air-fuel ratio controlling means for controlling the air-fuel ratio of the air-fuel mixture, the second air-fuel ratio controlling means determining an air-fuel ratio correction amount based on the sensor parameter provided by the downstream air-fuel ratio sensor to control the air-fuel ratio, a sensor parameter determining means for determining if the sensor parameter provided by the downstream air-fuel ratio sensor falls within a given range to provide a first signal indicative of the sensor parameter falling within the given range and a second signal indicative of the sensor parameter lying out of the given range, and a control mode selecting means for selecting between a first control mode and a second control mode, the first mode being such that the first air-fuel ratio controlling means is activated in response to the first signal provided by the sensor parameter determining means, the second control mode being such that the second air-fuel ratio controlling means is activated in response to the second signal provided by the sensor parameter determining means.

According to a further aspect of the present invention, there is provided an air-fuel ratio control apparatus for an internal combustion engine which comprises an upstream air-fuel ratio sensor arranged in a portion of an exhaust passage of the internal combustion engine upstream of a catalytic converter to provide a signal having a sensor parameter indicative of an air-fuel ratio of an air-fuel mixture, a downstream air-fuel ratio sensor arranged in a portion of the exhaust passage downstream of the catalytic converter to provide a signal having a sensor parameter indicative of the air-fuel ratio, a control parameter determining means for determining a given control parameter for controlling the air-fuel ratio of the air-fuel mixture, based on the sensor parameter provided by the downstream air-fuel ratio sensor under a given condition, a learning means for learning the given control parameter determined by the control parameter determining means in timing where the signal outputted form the downstream air-fuel ratio sensor is reversed between a first sensor parameter indicating that the air-fuel ratio is on a rich side and a second sensor parameter indicating that the air-fuel ratio is on a lean side, a learning execution means for executing a learning operation of the learning means when the signal provided by the downstream air-fuel ratio sensor provides a parameter indicative of a preselected condition, a storing means for storing the given control parameter determined by the control parameter determining means, a convergence determining means for determining whether the learning value learned by the learning means has converged or not, a control parameter updating means for updating the given control parameter to a value within a given range including a value of the given control parameter stored in the storing means when the convergence determining means concludes that the learning value is not converged, a first air-fuel ratio controlling means for controlling the air-fuel ratio of the air-fuel mixture of the internal combustion engine, the first air-fuel ratio controlling means determining an air-fuel ratio correction amount based on the sensor parameter provided by the upstream air-fuel ratio sensor and correcting the air-fuel ratio correction amount based the given control parameter either determined by the control parameter determining means or learned by the learning means to control the air-fuel ratio of the air-fuel mixture, a second air-fuel ratio controlling means for controlling the air-fuel ratio of the air-fuel mixture, the second air-fuel ratio controlling means determining an air-fuel ratio correction amount based on the sensor parameter provided by the downstream air-fuel ratio sensor to control the air-fuel ratio, a sensor parameter determining means for determining if the sensor parameter provided by the downstream air-fuel ratio sensor falls within a given range to provide a first signal indicative of the sensor parameter falling within the given range and a second signal indicative of the sensor parameter lying out of the given range, and a control mode selecting means for selecting between a first control mode and a second control mode, the first mode being such that the first air-fuel ratio controlling means is activated in response to the first signal provided by the sensor parameter determining means, the second control mode being such that the second air-fuel ratio controlling means is activated in response to the second signal provided by the sensor parameter determining means.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for the purpose of explanation and understanding only.

In the drawings:

FIGS. 3 to 8 show flowcharts of logical steps performed by an air-fuel ratio control system according to a first embodiment of the invention;

FIG. 26(*b*) is a graph which shows a correction amount ΔF and a time t;

DESCRIPTION OF THE PREFERRED EMBODIMENT

Figure 1:
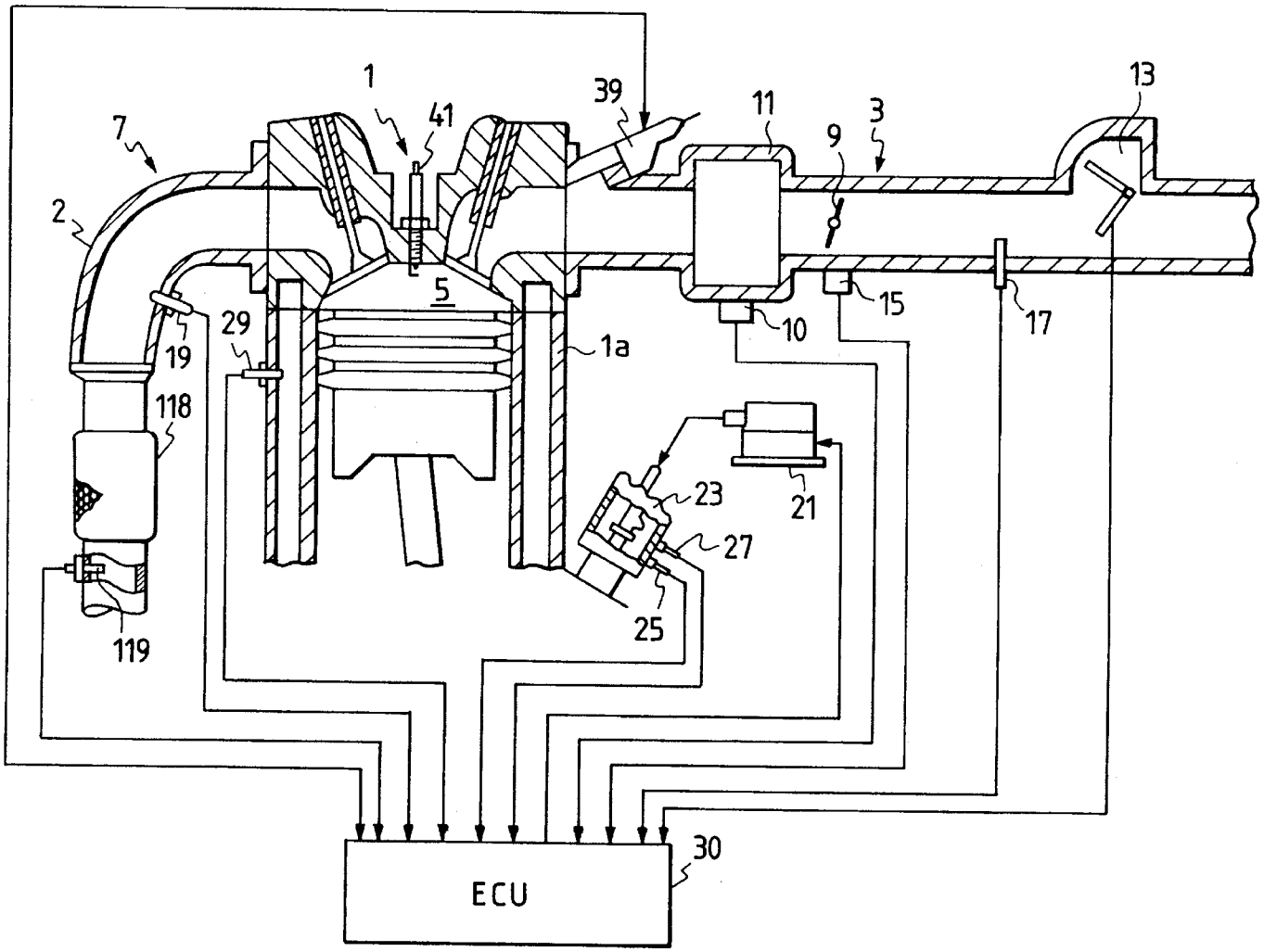
FIG. 1 is a schematic view which shows an air-fuel ratio control system according to the present invention.

Referring now to the drawings, wherein like numbers refer to like parts in several views, particularly to FIG. 1, there is shown an air-fuel ratio control system for an internal combustion engine according to the present invention.

The engine 1 generally includes an induction system 3 and an exhaust system 7. The induction system 3 includes an air cleaner (not shown), a throttle valve 9, a surge tank 11, an intake pressure sensor 10, an airflow meter 13, a throttle position sensor 15, and an intake air temperature sensor 17. The intake pressure sensor 10 measures a pressure level in the surge tank 11. The throttle position sensor 15 has disposed therein a throttle opening degree sensor 15*a* and an idle switch 15*b*. The idle switch 15*b* is designed to be turned on when the engine 1 is in idle modes of operation.

The exhaust system 7 has a catalytic converter 118, an upstream air-fuel ratio sensor 19 mounted in a portion of an exhaust passage 2 upstream of the catalytic converter, and a downstream air-fuel ratio sensor 119 arranged in a portion of the exhaust passage 2 downstream of the catalytic converter. These upstream and downstream air-fuel ratio sensors are each provided with an electromotive type of sensor which is designed to monitor a parameter indicative of an air-fuel ratio of an air-fuel mixture, i.e., the oxygen concentration of the exhaust gas flowing through the exhaust passage 2.

The engine 1 further includes an igniter 21, a distributor 23, an engine speed sensor 25, a cylinder-identifying sensor 27, and a coolant temperature sensor 29. The engine speed sensor 25 provides pulse signals according to a speed NE of the engine 1. A cylinder block 1*a* of the engine 1 is cooled by the coolant circulating therethrough. The temperature of the coolant is measured by the coolant temperature sensor 29 installed in the cylinder block 1*a*.

The air-fuel ratio control system includes an electronic control unit (ECU) 30. Sensor signals from the upstream and downstream air-fuel ratio sensors 19 and 119 and speed sensor 25 are inputted to the ECU 30.

Figure 2:
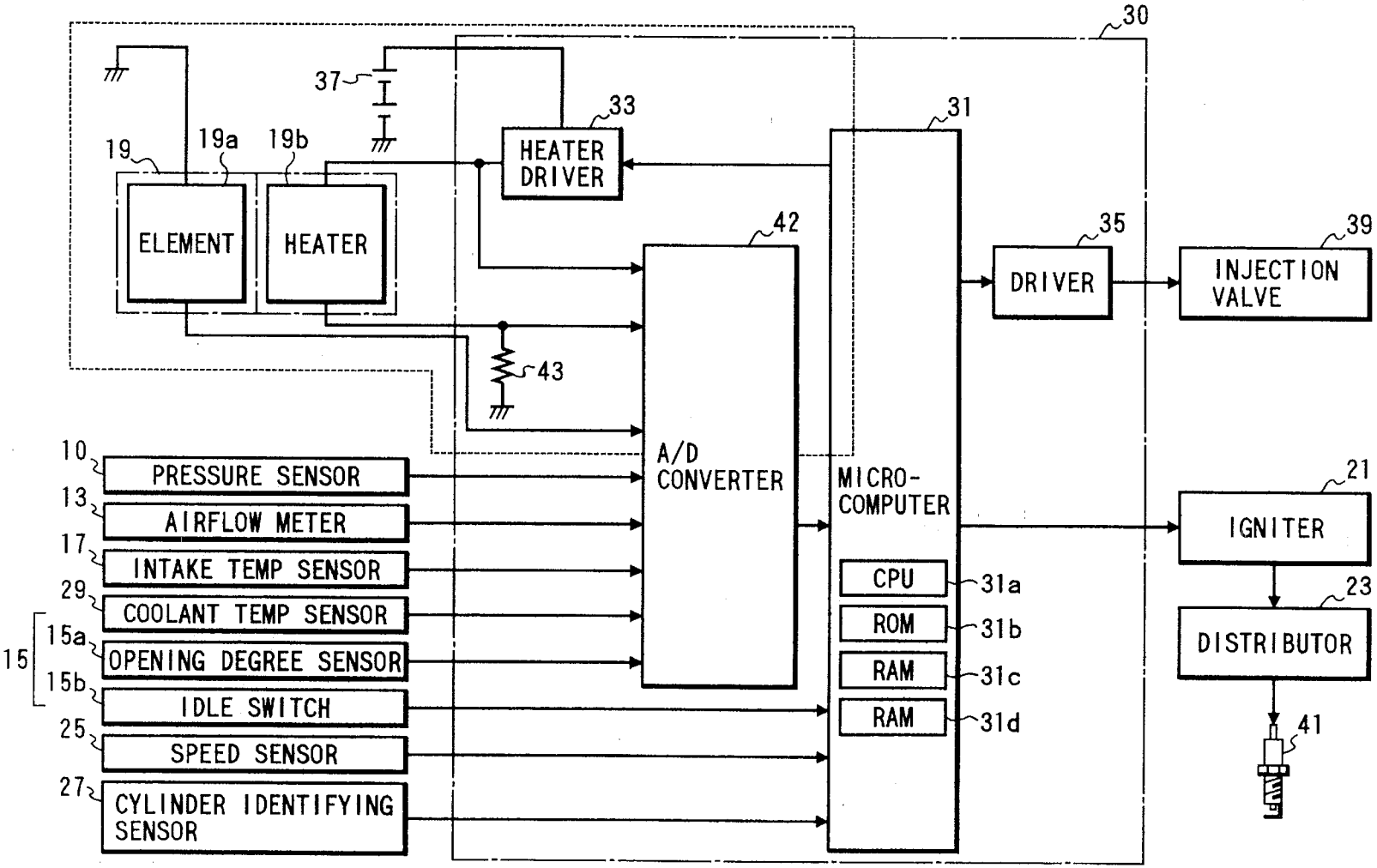
FIG. 2 is a block diagram which shows an air-fuel ratio control system.

The ECU 30, as shown in FIG. 2, is built around a microcomputer 31 consisting of a central processing unit (CPU) 31*a*, a ROM 31*b*, a RAM 31*c*, and a backup RAM 31*d* (non-volatile memory). The backup RAM 31*d*, if the engine is stopped, is supplied with the power from a battery 37 so that its stored data may not be lost. The microcomputer 31 takes in through its input ports signals from the idle switch 15*b*, the speed sensor 25, the cylinder-identifying sensor 27, and an A/D converter 42, and outputs control signals to the igniter 21, a heater driver 33, and an injection valve driver 35. The igniter connects with the distributor 23 which is, in turn, connected to a spark plug 41. The heater driver 33 receives a power supply from the battery 37, and controls electric power supplied to a heater 19*b* of the upstream air-fuel sensor 19. The heater 19*b* heats a sensor element 19*b*. The downstream air-fuel sensor 119 has the same construction as that of the upstream air-fuel sensor 19. The injection valve driver 35 is for actuating a fuel injection valve 39.

The A/D converter 42 receives analog signals from the intake pressure sensor 10, the airflow meter 13, the throttle opening degree sensor 15*a*, the intake air temperature sensor 17, and the coolant temperature sensor 29. The A/D converter 42 further receives outputs from the heater driver 33, the sensor element 19*a* of the upstream air-fuel ratio sensor 19 and a terminal voltage of a current-detecting resistor 43 connecting with the heater 19*b*. The downstream air-fuel sensor 119, although not illustrated in the drawing, connects with the A/D converter 42 in the same manner as that of the upstream air-fuel ratio sensor.

The ECU 30 serves to monitor operating conditions of the engine 1 based on the outputs from the above mentioned various sensors and the heater driver 33 etc. to and controls the operation (e.g., an air-fuel ratio) of the engine 1.

Figure 3:
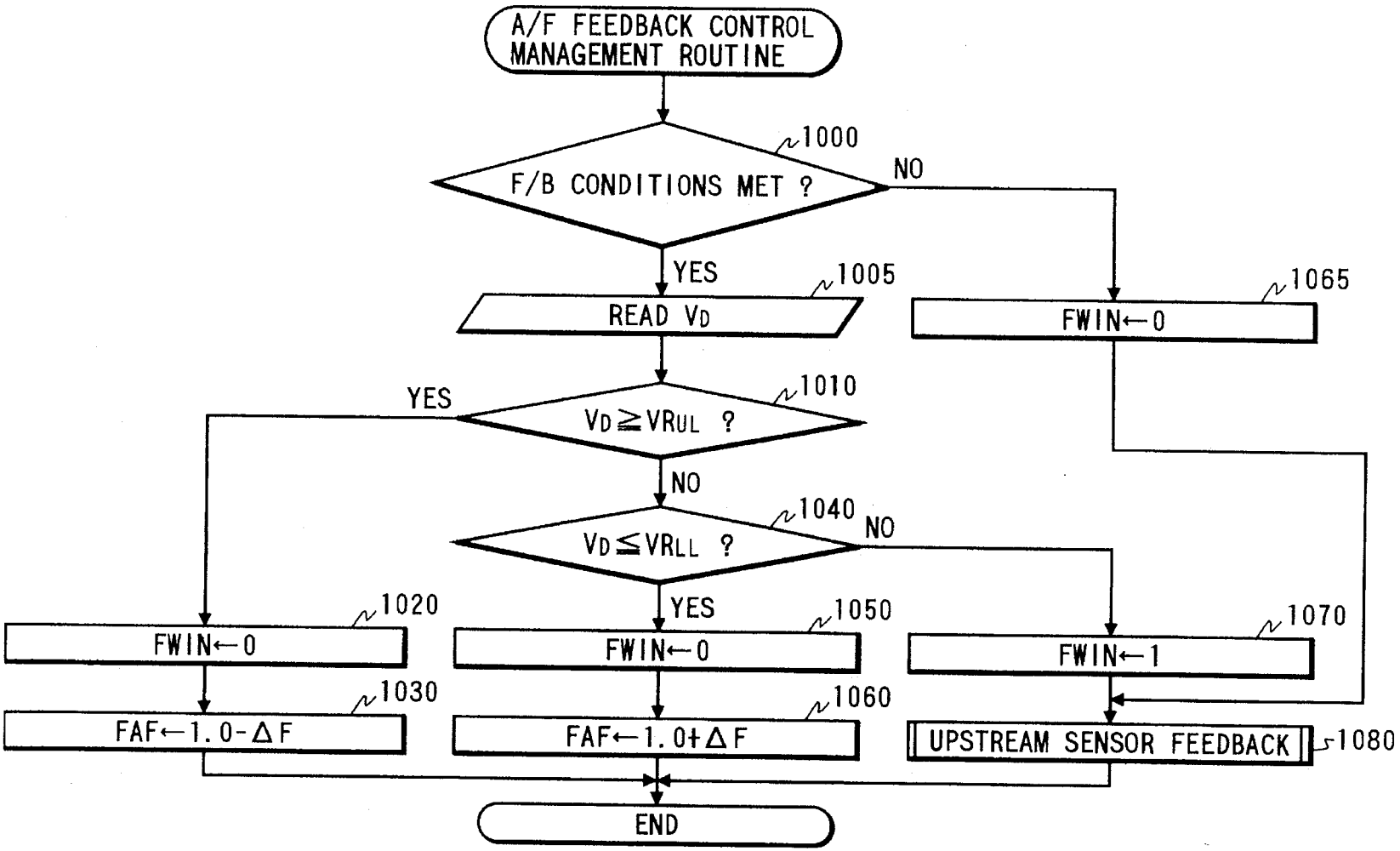
Figure 5:
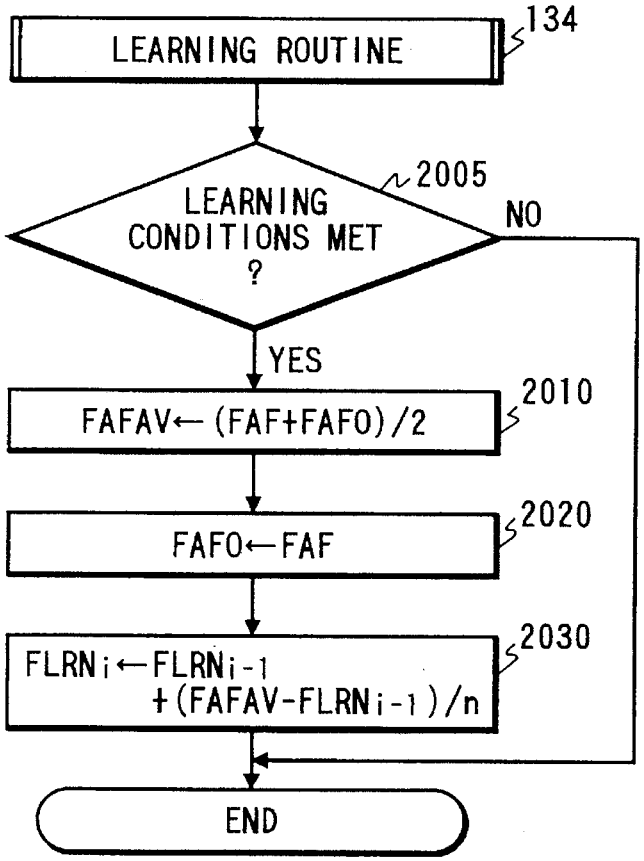

Referring to FIGS. 3 to 5, there are shown flowcharts of programs or logical steps for air-fuel ratio feedback control performed by the ECU 30. These programs are provided for deriving an air-fuel ratio correction mount FAF and an air-fuel ratio learning correction value FLRN based on the outputs from the upstream and downstream air-fuel ratio sensors 19 and 119. The results of an arithmetic operation of FAF and FLRN are used for the air-fuel ratio feedback control in a known manner.

FIG. 3 shows a management routine for controlling the whole air-fuel feedback control, and is executed by timer interrupt every 4 msec., for example.

After entering the program, the routine proceeds to step 1000 wherein it is determined whether the following air-fuel ratio feedback control conditions (a) to (d) are all met or not using the output from the downstream air-fuel ratio sensor 119.

(a) upstream $O_2$ feedback control conditions, as will be described later, exist.

(b) the coolant temperature falls within a given acceptable range (e.g., 75° to 95° C.).

(c) the vehicle is running in normal or steady conditions (e.g., an engine speed and an intake air amount lie within their respective allowable ranges, and a throttle opening degree is small).

(d) the downstream air-fuel ratio sensor is activated.

If at least any one of the above conditions does not exist, then the routine proceeds to step 1065 wherein a flag FWIN is set to zero (0). Subsequently, the routine proceeds directly to step 1080 wherein an air-fuel ratio control routine, as shown in FIG. 4, using the outputs from the upstream air-fuel ratio sensor 19 is initiated.

Alternatively, if a YES answer is obtained in step 1000, then the routine proceeds to step 1005 wherein an output voltage $V_D$ of the downstream air-fuel ratio sensor 119 is taken in. The routine then proceeds to step 1010 wherein it is determined whether the output voltage $V_D$ is greater than an upper limit $VR_{UL}$ or not. If a YES answer is obtained ($V_D \geqq VR_{UL}$), then the routine proceeds to step 1020. Alternatively, if a NO answer is obtained ($V_D < VR_{UL}$), then the routine goes to step 1040 wherein it is determined whether the output voltage $V_D$ is smaller than a lower limit $VR_{LL}$ or not. If a NO answer is obtained ($V_D > VR_{LL}$) meaning that the output voltage $V_D$ falls within an acceptable range between the upper limit $VR_{UL}$ and the lower limit $VR_{LL}$, then the routine proceeds to step 1070 wherein the flag FWIN is set to one (1). The routine then goes to step 1080 wherein an upstream air-fuel ratio sensor feedback routine, as will be described later, is carried out to determine the air-fuel ratio correction mount FAF, and proceeds to END. Alternatively, if the answer obtained in step 1010 is YES concluding that the output voltage $V_D$ is higher than the upper limit $VR_{UL}$, then the routine proceeds to step 1020 wherein the flag FWIN is set to zero (0). The routine then goes to step 1030 wherein the air-fuel ratio correction mount FAF is set to a value derived by the relation of $1.0-\Delta F$ where $\Delta F$ is 0.05 in this embodiment. Alternatively, if the answer obtained in step 1040 is YES concluding that the output voltage $V_D$ is less than the lower limit $VR_{LL}$, then the routine proceeds to step 1050 wherein the flag FWIN is set to zero (0). Subsequently, the routine goes to step 1060 wherein the air-fuel ratio correction amount FAF is set to a value derived by the relation of $1.0+\Delta F$, and then goes to END. Note that the air-fuel ratio correction amount FAF determined in step 1030 or 1060 is a basic air-fuel ratio correction amount derived by means of the downstream air-fuel ratio sensor 119.

The value of $\Delta F$, unlike the above manner that it is fixed to a constant value of 0.05, may alternatively be set to a variable determined according to a given condition, which will be discussed later in detail. Further, although, in this embodiment, the air-fuel ratio correction amount FAF is, as described above, derived by adding or subtracting ΔF to or from a reference value of 1.0 representing a stoichiometric air-fuel ratio, the reference value may be set to a blunt value FAFAV of FAF. In this case, ΔF may be either a constant or a variable. The blunt value FAFAV may be found by averaging FAFs derived in eight previous calculation cycles in steps 139 to 153, as shown in FIG. 4, according to the following relation.

$$FAFAV \leftarrow (7 \cdot FAFAV + FAF)/8$$

The flag FWIN is for controlling the operation of the feedback control routine (i.e., a control parameter-determining routine) using the output from the downstream air-fuel ratio sensor 119. When the flag FWIN shows one (1), the air-fuel ratio control conditions based on the downstream air-fuel ratio sensor 119 are established and the output from the downstream air-fuel ratio sensor 119 lies within the acceptable range between the upper and lower limits $VR_{UL}$ and $VR_{LL}$. This means that a storage mount of $O_2$ in the catalyst is enough to purge harmful exhaust at relatively high efficiencies, which shows a condition that a controlled air-fuel ratio lies within a catalyst window or near such a condition. On the other hand, when the flag FWIN is zero (0), the air-fuel feedback conditions do not exist or they exist, but the output from the downstream air-fuel ratio sensor 119 lies out of the acceptable range, meaning that a controlled air-fuel ratio is outside the catalyst window, which will cause a great deal of harmful exhaust to be emitted.

The air-fuel ratio feedback control routine using the output from the upstream air-fuel ratio sensor 19 performed in step 1080, will be discussed with reference to FIG. 4.

This routine is provided for, based on a RICH/LEAN determination using an output voltage $V_U$ of the upstream air-fuel ratio sensor 19, calculating the air-fuel correction amount FAF for the air-fuel ratio feedback control using given control constants or parameters: delay times TDR and TDL, skip amounts RSR and RSL, and integration constants KIR and KIL. Initially, in step 90, FAFO which is a value of the air-fuel ratio correction amount FAF set in a last calculation cycle, is reset to FAF. The process in step 90 in combination with step 155, as will be described later, is such that in the management routine in FIG. 3, when the output voltage $V_D$ from the downstream air-fuel ratio sensor 119 is shifted out of the acceptable range, the air-fuel ratio correction amount FAF is corrected in step 1030 or 1060, and thereafter the output voltage $V_D$ is returned to within the acceptable range, the upstream air-fuel ratio sensor feedback control is initiated with the air-fuel ratio correction amount FAF derived in the previous upstream air-fuel ratio sensor feedback control routine of FIG. 4.

After step 90, the routine goes to step 100 wherein it is determined if preselected air-fuel feedback control conditions are satisfied. The air-fuel feedback control conditions are based on, for instance, a coolant temperature level, if the engine undergoes a fuel cut, and if acceleration is increasing. Note that the determination in step 100 precedes the step 1000 in the management routine of FIG. 3. If a NO answer is obtained concluding that the air-fuel feedback control conditions do not exist, then the routine proceeds directly to step 103 wherein the air-fuel ratio correction amount FAF is set to 1.0, and then terminates.

If a YES answer is obtained in step 100 concluding that the air-fuel ratio feedback control conditions exist, then the routine proceeds to step 105 wherein the output voltage $V_U$ from the upstream air-fuel ratio sensor 19 is taken in. The routine then goes to step 107 wherein it is determined if the output voltage $V_U$ is less than a reference voltage $VR_U$ for determining whether an actual air-fuel ratio is richer or leaner than a target air-fuel ratio. If a YES answer is obtained concluding that the actual air-fuel ratio is leaner than the target air-fuel ratio, then the routine proceeds to step 109 wherein it is determined whether a count value CDLY of a delay counter is greater than zero (0) or not. If a NO answer is obtained, then the routine proceeds directly to step 113. Alternatively, if a YES answer is obtained meaning that the count value CDLY is greater than zero (0), then the routine goes to step 111 wherein the delay counter is reset to zero (0). In step 113, the count value CDLY is set to a value of CDLY−1. The routine then goes to step 115 wherein it is determined whether the count value CDLY is less than a minimum value TDL or not. If a NO answer is obtained (CDLY≧TDL), then the routine proceeds directly to step 133. Alternatively if a YES answer is obtained (CDLY>TDL), then the routine proceeds to step 117 wherein the count value CDLY is set to the minimum value TDL. The routine then proceeds to step 119 wherein a rich/lean flag F1 is set to zero (0).

If a NO answer is obtained in step 107 meaning that the actual air-fuel ratio is richer than the target air-fuel ratio, then the routine proceeds to step 121 wherein it is determined whether the count value CDLY of the delay counter is smaller than zero (0) or not. If a NO answer is obtained, then the routine proceeds directly to step 125. Alternatively, if a YES answer is obtained meaning that the count value CDLY is smaller than zero (0), then the routine goes to step 123 wherein the delay counter is reset to zero (0). Subsequently, the routine proceeds to step 125 wherein the count value CDLY is set to a value of CDLY+1. The routine then goes to step 127 wherein it is determined whether the count value CDLY is higher than a maximum value TDR or not. If a NO answer is obtained (CDLY≦TDR), then the routine proceeds directly to step 133. Alternatively if a YES answer is obtained (CDLY>TDR), then the routine proceeds to step 129 wherein the count value CDLY is set to the maximum value TDR. The routine then proceeds to step 13 1 wherein the flag F1 is set to one (1).

In step 133, a determination is made whether the flag F1 has been reversed or not for determining if the actual air-fuel ratio has been reversed between rich and lean sides. The reversal of the flag F1 is, as apparent from the above explanation, delayed a given length of time corresponding to the maximum or minimum value TDR or TDL of the delay counter following the RICH/LEAN determination in step 107 based on the output voltage $V_U$ from the upstream air-fuel ratio sensor 19. Therefore, the RICH/LEAN determination based on the reversal of the flag F1 becomes more stable. Additionally, fine adjustment of the air-fuel ratio between the rich and lean sides under the air-fuel ratio feedback control may be accomplished by modifying the maximum and minimum values TDR and TDL as serving as the delay times.

If the answer obtained in step 133 is YES meaning that the flag F1 has been reversed, then the routine proceeds to step 134 wherein learning control, as shown in FIG. 5 in detail, is performed.

In step 2005, it is confirmed whether given learning conditions are established or not. For example, the followings are provided as the learning conditions.

(a) a warm-up of engine operation is completed.

(b) the engine is running in a stable operating condition.

(c) any of various fuel corrections is not made (except the air-fuel ratio feedback control).

If all of the above conditions are satisfied, then the routine proceeds to step 2010 wherein an average value FAFAV of FAFO derived upon previous reversal of the flag F1 and FAF derived in the present program cycle, is determined. Subsequently, the routine proceeds to step 2020 wherein the previous air-fuel ratio correction mount FAFO is set to FAF, and then proceeds to step 2030 wherein a learning value $FLRN_i$ is updated according to the relation of $FLRN_i = FLRN_{i-1} + (FAFAV - FLRN_{i-1})/n$ where $FLRN_{i-1}$ is a learning value derived one program cycle earlier and n is a given integer. It is desirable that a learning area be divided into a plurality of learning sections according to engine operating conditions and the leaning value be used for each of the learning sections.

After step 2030 or the NO answer is obtained in step 2005, the routine goes to step 135 in FIG. 4 wherein it is determined whether the flag F1 is zero (0) or not. If a YES answer is obtained meaning that the air-fuel ratio is changed from the rich to lean side, then the routine proceeds to step 139 wherein the air-fuel ratio correction mount FAF is corrected by adding the rich skip amount RSR thereto. Alternatively, if a NO answer is obtained meaning that the air-fuel ratio is changed from the lean to rich side, then the routine proceeds to step 141 wherein the air-fuel ratio correction amount FAF is corrected by subtracting the lean skip amount RSL therefrom.

If a NO answer is obtained in step 133 meaning that the flag F1 has not been reversed, then the routine proceeds to step 137 wherein it is determined whether the flag 1 is zero or not. If a YES answer is obtained meaning that the air-fuel ratio is on the lean side, then the routine proceeds to step 143 wherein the air-fuel ratio correction amount FAF is updated by adding a rich integration constant KIR thereto. Alternatively, if a NO answer is obtained concluding that the air-fuel ratio is on the rich side, then the routine proceeds to step 145 wherein the air-fuel ratio correction amount FAF is updated by subtracting a lean integration constant KIL therefrom. The air-fuel ratio correction amount FAF derived in step 139, 14 1, 143, or 145 is the basic air-fuel ratio correction amount based on the output from the upstream air-fuel ratio sensor 19.

After step 143, 145, 139, or 141, the routine proceeds to step 147 wherein it is determined if the air-fuel ratio correction amount FAF is greater than a maximum value of 1.2 or not. If FAF>1.2, then it is set to 1.2 in step 149. If FAF≦1.2, then the routine proceeds to step 151 wherein it is determined whether FAF is smaller than a minimum value of 0.8 or not. If FAF<0.8, then it is set to 0.8. Subsequently, the routine proceeds to step 155 wherein the present air-fuel ratio correction mount FAF is set to FAFO, and then goes to END. Note that fine adjustment of the center of the air-fuel ratio feedback control may be achieved by modifying the skip amounts RSR and RSL, the integration constants KIL and KIR or the reference voltage VR as well as the delay times TDR and TDL.

Figure 6:
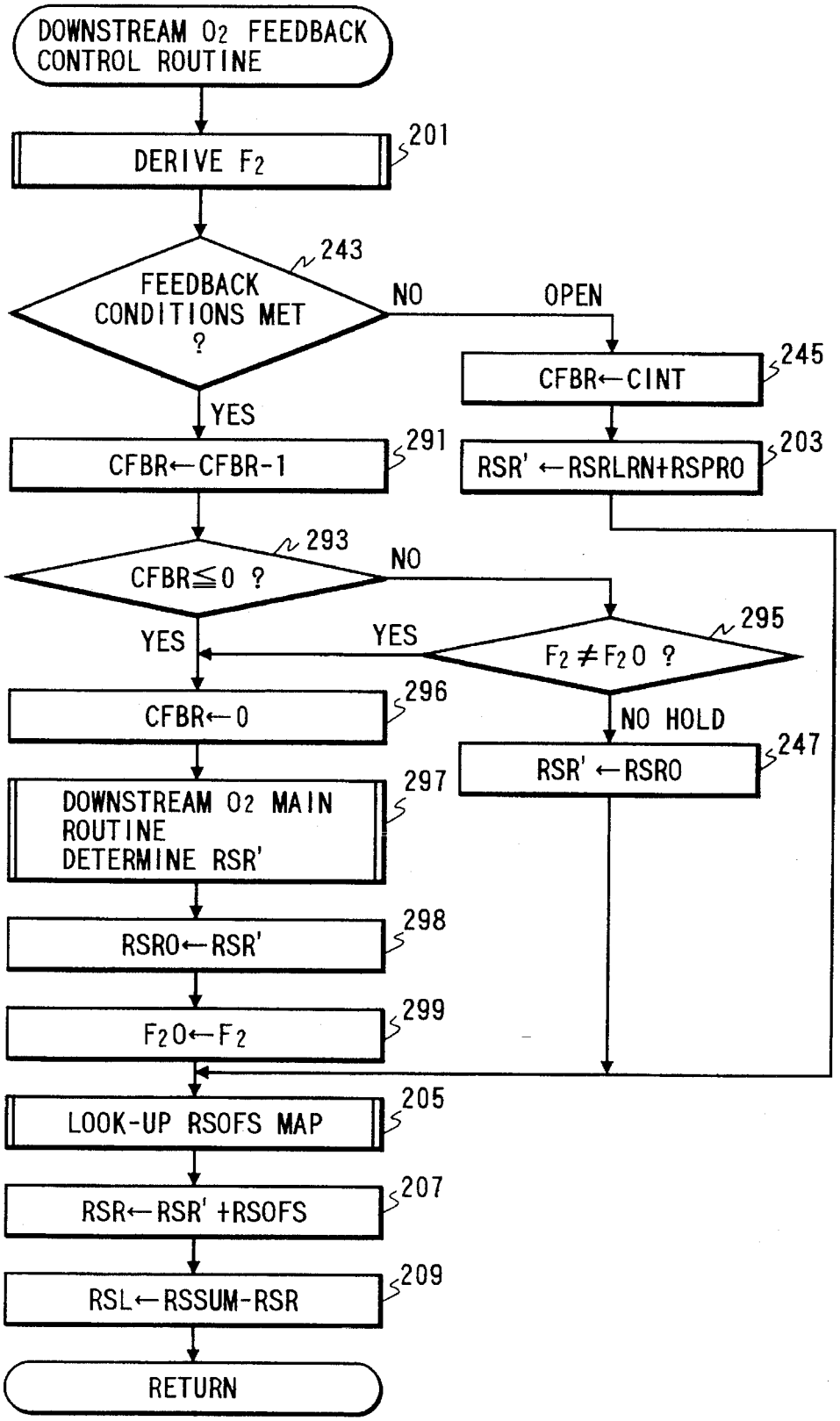

Referring to FIG. 6, there is shown a flowchart of a program which corrects preselected upstream $O_2$ feedback control parameters, for example, the skip amounts RSR and RSL based on the output voltage $V_D$ from the downstream air-fuel ratio sensor 19.

This air-fuel ratio feedback control using the downstream air-fuel ratio sensor 19 is carried out by timer interrupt at given time intervals, for example, every 524 msec. which is longer than a calculation cycle of this routine (which will be referred to as downstream $O_2$ feedback control hereinafter), and serves to fine adjust the center of the upstream $O_2$ feedback control to bring the air-fuel ratio into the catalyst window.

Figure 7:
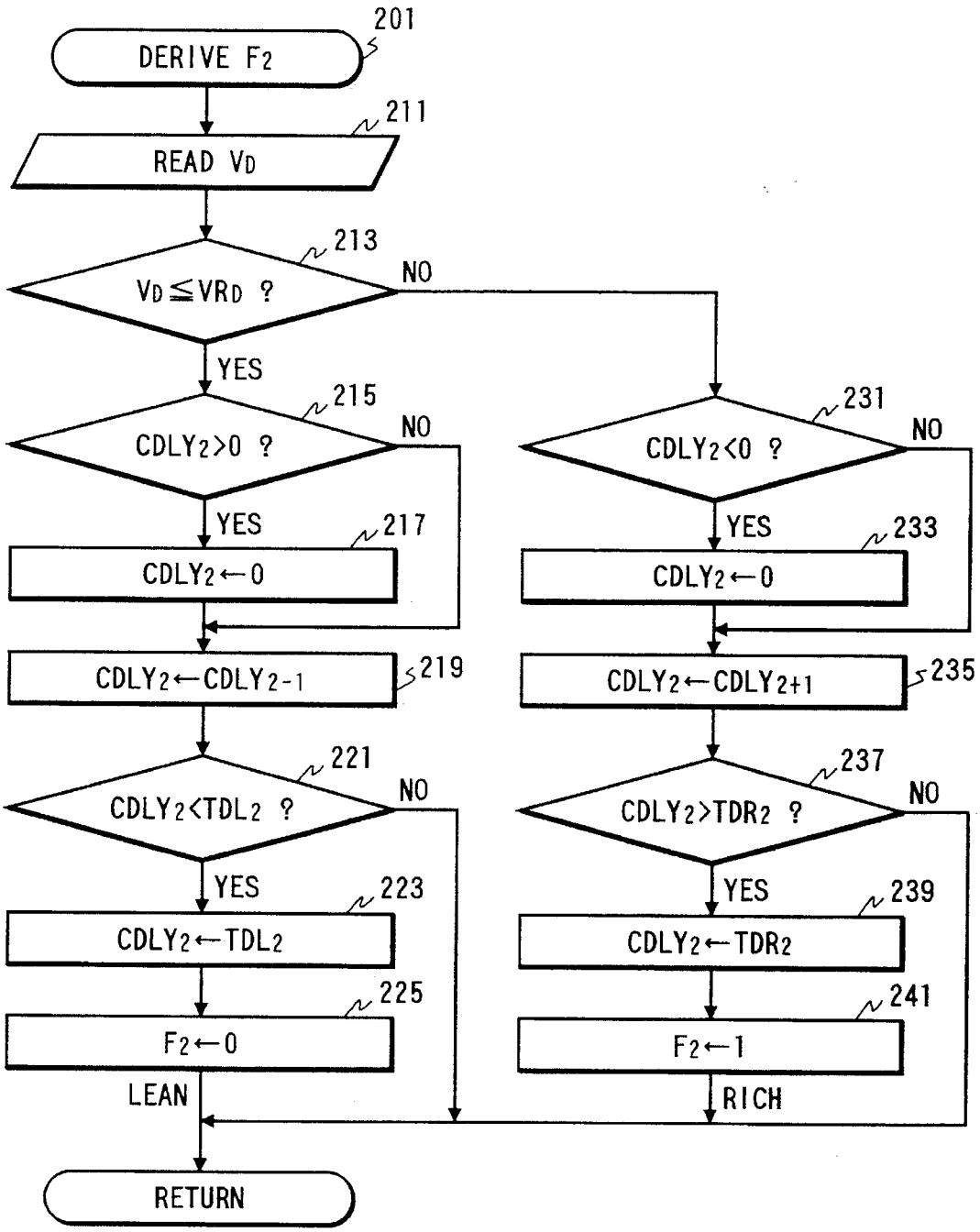

After entering the program, the routine proceeds to step 201 wherein a rich/lean flag F2 is set through steps shown in FIG. 7 based on the output from the downstream air-fuel ratio sensor 119.

In step 211, the output voltage $V_D$ from the downstream air-fuel ratio sensor 119 is taken in. The routine then goes to step 213 wherein it is determined if the output voltage $V_D$ is less than or equal to a reference voltage $VR_D$ for determining whether an actual air-fuel ratio is richer or leaner than a target air-fuel ratio. If a YES answer is obtained concluding that the actual air-fuel ratio is leaner than the target air-fuel ratio, then the routine proceeds to step 215 wherein it is determined whether a count value CDLY2 of a delay counter is greater than zero (0) or not. If a NO answer is obtained, then the routine proceeds directly to step 219. Alternatively, if a YES answer is obtained meaning that the count value CDLY2 is greater than zero (0), then the routine goes to step 217 wherein the delay counter is reset to zero (0). In step 219, one (1) is subtracted from the count value CDLY2. The routine then goes to step 221 wherein it is determined whether the count value CDLY2 is less than a minimum value TDL2 or not. If a NO answer is obtained (CDLY2≦TDL2), then the routine returns. Alternatively if a YES answer is obtained (CDLY2<TDL2), then the routine proceeds to step 223 wherein the count value CDLY2 is set to the minimum value TDL2. The routine then proceeds to step 225 wherein the rich/lean flag F2 is set to zero (0).

If a NO answer is obtained in step 213 meaning that the actual air-fuel ratio is richer than the target air-fuel ratio, then the routine proceeds to step 231 wherein it is determined whether the count value CDLY2 of the delay counter is smaller than zero (0) or not. If a NO answer is obtained, then the routine proceeds directly to step 235. Alternatively, if a YES answer is obtained meaning that the count value CDLY2 is smaller than zero (0), then the routine goes to step 233 wherein the delay counter is reset to zero (0). Subsequently, the routine proceeds to step 235 wherein one (1) is added to the count value CDLY2. The routine then goes to step 237 wherein it is determined whether the count value CDLY2 is higher than a maximum value TDR2 or not. If a NO answer is obtained (CDLY≦TDR), then the routine returns. Alternatively, if a YES answer is obtained (CDLY>TDR), then the routine proceeds to step 239 wherein the count value CDLY2 is set to the maximum value TDR2. The routine then proceeds to step 241 wherein the flag F2 is set to one (1).

After the rich/lean flag F2 is set to either zero (0) or one (1) in step 225 or 241, the routine proceeds to step 243, as shown in FIG. 6, wherein it is determined if a flag FWIN is one (1) based on whether the following execution conditions for the downstream $O_2$ feedback control all exist or not.

(a) the system is now under the upstream $O_2$ feedback control.

(b) the coolant temperature falls within a given acceptable range (e.g., 75° to 95° C.).

(c) the vehicle is running in normal or steady conditions (e.g., an engine speed and an intake air amount lie within their respective allowable ranges, and a throttle opening degree is small).

(d) an engine load (e.g., an intake air amount, a boost pressure) is higher than a fixed value.

(e) the downstream air-fuel ratio sensor 119 is activated.

(f) a preselected period of time has expired after the above conditions (a) to (e) are all established.

If at least any one of the above conditions (a) to (f) does not exist meaning that the flag FWIN shows zero (0), then the routine proceeds to step 245 (i.e., to open-loop control) wherein a counter CFBR is set to an initial value CINT. The counter CFBR is for counting a time after the above feedback conditions are all satisfied. Thereafter, the routine proceeds to step 203 wherein a mass production correction value RSPRO is added to a learning value RSRLRN to derive a skip correction parameter RSR'.

Figure 8:
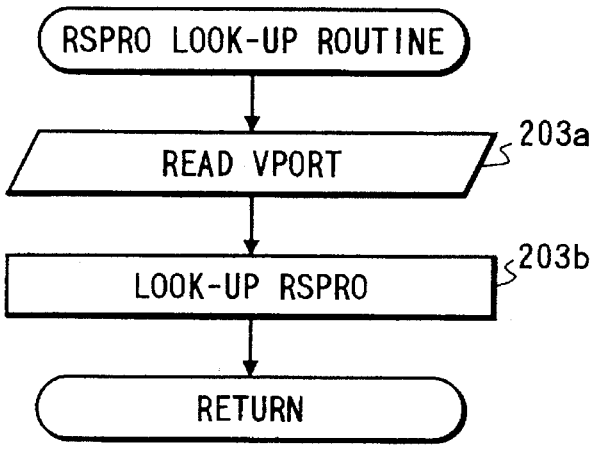
Figure 9:
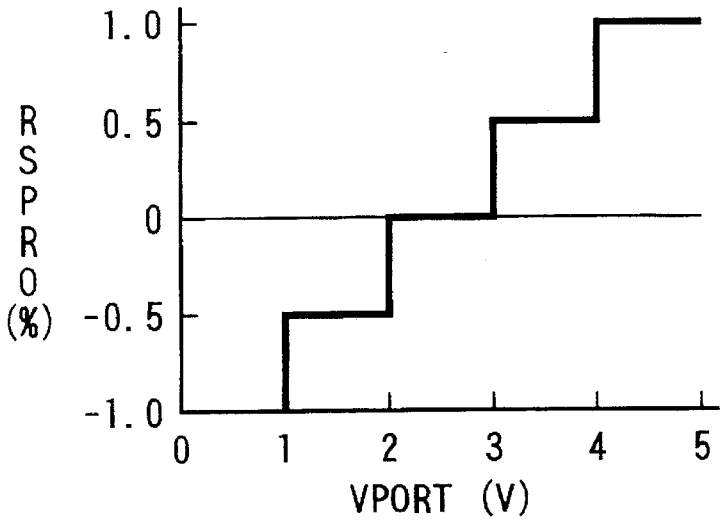
FIG. 9 is a graph which shows a relation between a production correction value RSPRO and a production correction port voltage VPORT for determining a control parameter of an upstream $O_2$ feedback control.

The mass production correction value RSPRO serves to shift an air-fuel ratio during a stop of the downstream $O_2$ feedback control (i.e., when the system is under the open-loop control) from that during the feedback control, and is determined according to a RSPEO look-up routine, as shown in FIG. 8. In step 203*a*, a so-called mass production correction port voltage VPORT is taken in. In step 203*b*, the mass production correction value RSPRO is determined by look-up using mapped data, as shown in FIG. 9. The mass production correction value RSPRO may be changed by adjusting a voltage level applied to the mass production correction port. Thus, even after a computer program is masked, it is possible to fine control an air-fuel ratio during the open-loop control. This allows exhaust emissions to be adjusted easily after mass-production of the system.

Figure 10:
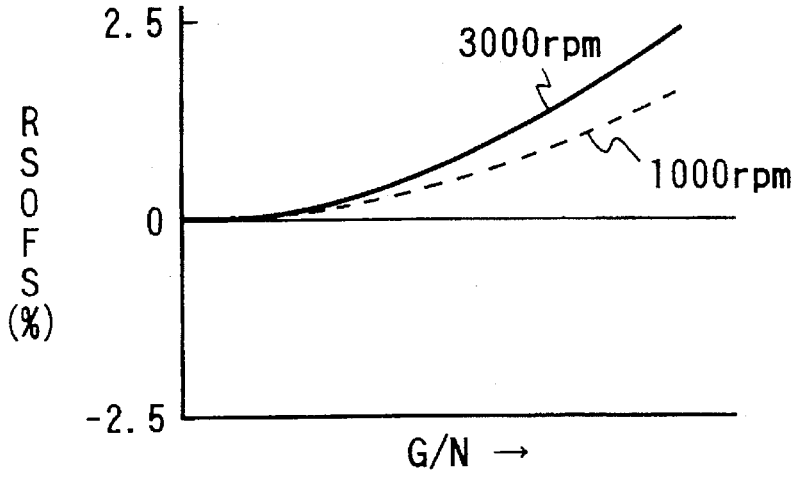
FIG. 10 is a graph which shows a relation between an intake air amount G/N and a compensating value RSOFS.

After step 203, the routine proceeds to step 205 wherein a compensating value RSOFS is determined by look-up using given mapped data, as shown in FIG. 10, based on an engine speed NE and an intake air amount G/N per one engine revolution. The routine then proceeds to step 207 wherein the compensating value RSOFS is added to RSR' to derive a rich skip mount ΔRSR. Subsequently, in step 209, RSR is subtracted from a total value RSSUM (e.g., 1%) of RSR and RSL (lean skip mount) to update RSR, and then the routine terminates. The compensating value RSOFS is provided for compensating for a difference between convergence values of RSR, converged by the downstream $O_2$ feedback control, different from each other dependent upon engine operating conditions for converging the feedback quickly under different conditions of engine operation.

Figure 11:
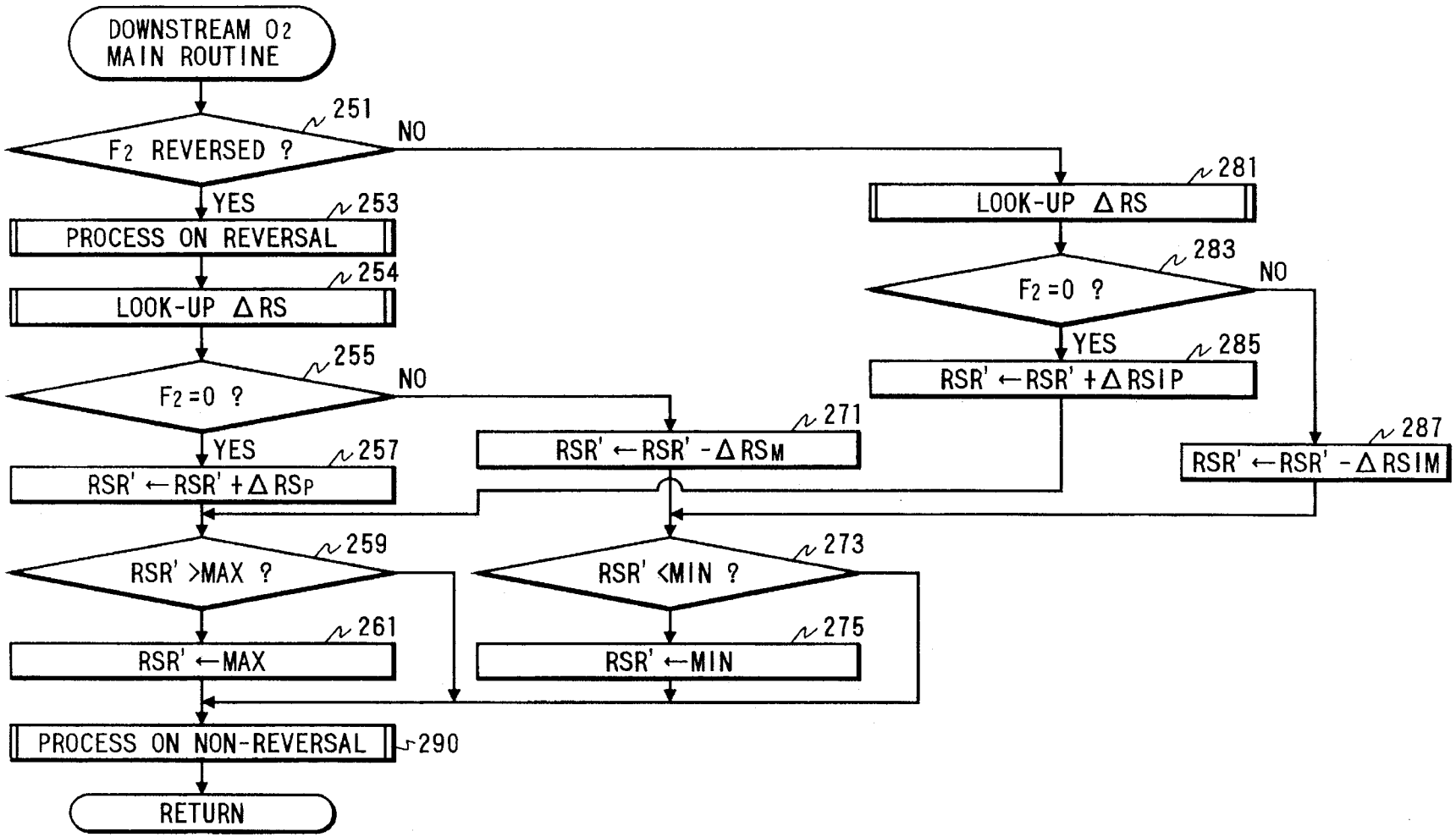
FIGS. 11 and 12 are flowcharts which shows logical steps carried out by an air-fuel ratio control system according to a first embodiment.

If a YES answer is obtained in step 243 meaning that all the execution conditions for the feedback control are met, then the routine proceeds to step 291 wherein the counter CFBR is decremented. The routine then proceeds to step 293 wherein it is determined whether a count value of the counter CFBR is less than or equal to zero (0) or not. If a YES answer is obtained, then the routine proceeds to step 296 wherein the counter CFBR is reset to zero (0). Alternatively, if a NO answer is obtained in step 293 (CFBR>0), then the routine proceeds to step 295 wherein it is determined if the rich/lean flag F2 is different from F20 which indicates a value of F2 immediately before the system was placed under the open-loop control in a previous program cycle. If a YES answer is obtained (F2≠F20) meaning that an air-fuel ratio has been reversed, to the rich or lean side with respect to the stoichiometric air-fuel ratio, from that before the open-loop control, then the routine proceeds to step 296 wherein the counter CFBR is reset to zero (0). The routine then proceeds to step 297 which is referred to as "downstream $O_2$ main process" as different from processes performed immediately after the execution conditions for the air-fuel ratio feedback control exist. FIG. 11 shows this process.

Figure 12:
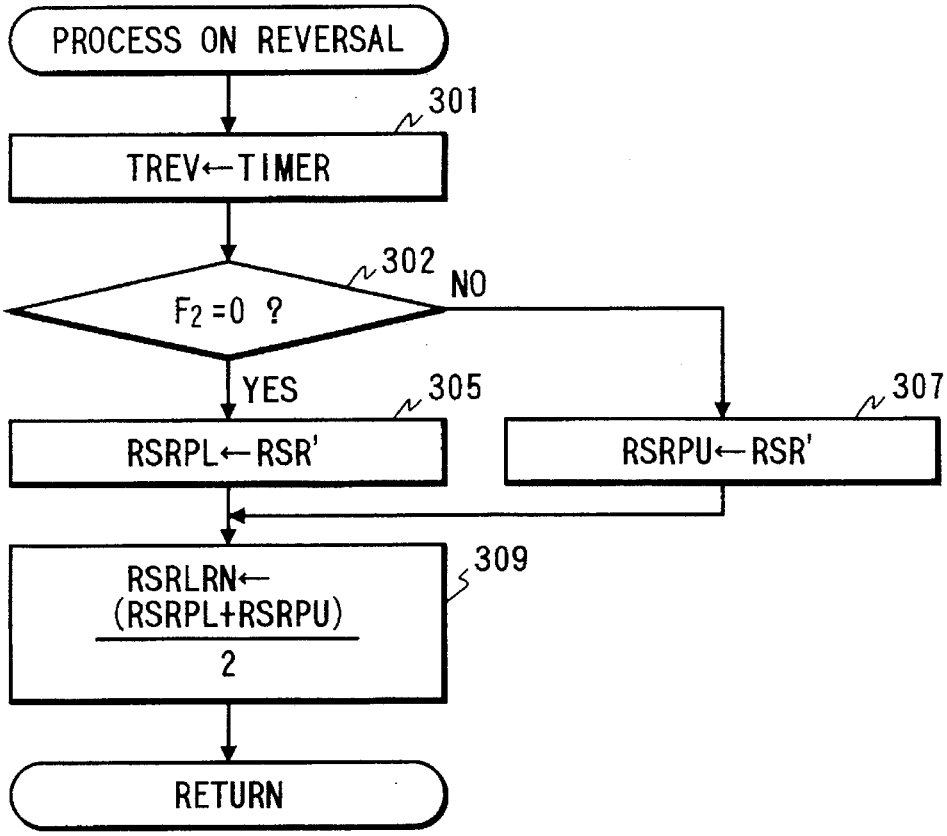

In step 251, it is determined if the rich/lean flag F2 has been reversed. If a YES answer is obtained, then the routine proceeds to step 253 wherein the process shown in FIG. 12 is carried out. In step 301, a reversal time when the flag F2 has been reversed is recorded as TREV. The process in step 301 is required when performing learning process if the flag F2 is not reversed longer. When it is unnecessary to perform the learning process, the step 301 is not necessary. 15 In step 302, it is determined whether the rich/lean flag F2 is zero (0) or not. If a YES answer is obtained (F2=0) meaning that the air-fuel ratio has been shifted from the rich side to the lean side, then the routine proceeds to step 305 wherein RSR' at this time is stored as a learning parameter RSRPL in the RAM 31*c*. Alternatively, if a NO answer is obtained in step 302 meaning that the air-fuel ratio has been shifted from the lean side to the rich side, then the routine proceeds to step 307 wherein RSR' is recorded as a learning parameter RSRPU in the RAM 31*c*. Note that the leaning parameters RSRPL and RSRPU are reset to initial values (e.g., RSRPL=RSRLRN (leaning value)−α, RSRPU=RSLRN+β) at the start of engine operation.

After step 305 or 307, the routine proceeds to step 309 wherein the learning value RSRLRN is set to the average of RSRPU and RSRPL. This learning value RSRLRN is stored in the backup RAM 31*d* to keep it after the engine is turned off, thereby allowing proper adjustment of exhaust gas to be made quickly even after the engine is turned on again.

Figure 13:
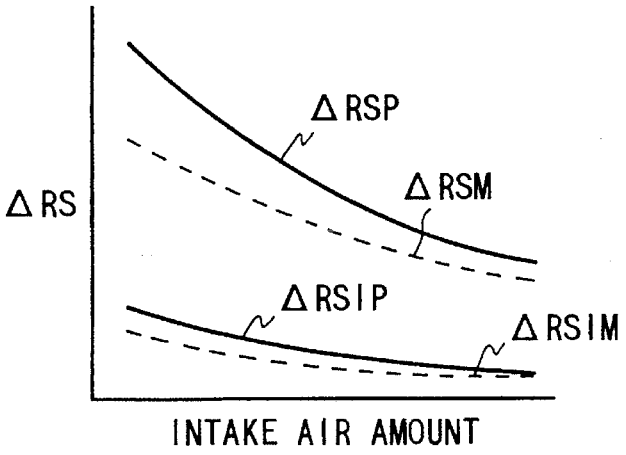
FIG. 13 is a graph which shows a relation between an integration amount ΔRS and an intake air amount.

After step 309, the routine proceeds to step 254 shown in FIG. 11 wherein rich and lean skip correction values ΔRSP and ΔRSM are looked up using mapped data, as shown in FIG. 13, based on an intake air amount detected by the airflow meter 13. Subsequently, the routine proceeds to step 255 wherein it is determined if the rich/lean flag F2 is zero (0) or not. If a YES answer is obtained meaning that the air-fuel ratio has been shifted from the rich side to the lean side, then the routine proceeds to step 257 wherein the skip correction parameter RSR' is updated by adding the rich skip correction value ΔRSP thereto. Subsequently, the routine proceeds to step 259 wherein it is determined whether RSR' is greater than a given maximum value or not. If a YES answer is obtained, then the routine proceeds to step 261 wherein RSR' is set to the maximum value. Alternatively, if a NO answer is obtained in step 255 meaning that the air-fuel ratio has been shifted from the lean side to the rich side, then the routine proceeds to step 271 wherein the skip correction parameter RSR' is updated by subtracting the lean skip correction value ΔRSM therefrom. Subsequently, the routine proceeds to step 273 wherein it is determined whether RSR' is smaller than a given minimum value or not. If a YES answer is obtained, then the routine proceeds to step 275 wherein RSR' is set to the minimum value.

If the answer obtained in step 251 is NO meaning that the rich/lean flag F2 is determined not to have been reversed after a lapse of the above discussed delay time following detection of the output from the downstream air-fuel ratio sensor 119, then the routine proceeds to step 281 wherein integration mounts ΔRSIP and ΔRSIM are derived by look-up using mapped data in FIG. 13 based on the intake air amount. In step 283, it is determined whether the rich/lean flag F2 is zero (0) or not. If a NO answer is obtained meaning that the air-fuel ratio is on the lean side, then the routine proceeds to step 285 wherein the skip correction parameter RSR' is updated by adding ΔRSIP thereto, and then proceeds to step 259. Alternatively, if a YES answer is obtained meaning that the air-fuel ratio is on the rich side, then the routine proceeds to step 287 wherein the skip correction parameter RSR' is updated by subtracting ΔRSIM therefrom, and then proceeds to step 273.

Figure 14A:
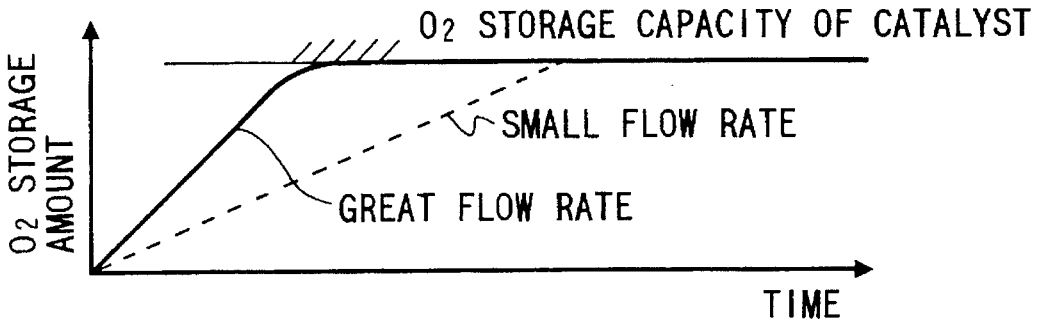
FIGS. 14(*a*) and 14(*b*) are time charts which show an $O_2$ storage amount and an output from a downstream air-fuel ratio sensor.
Figure 14B:
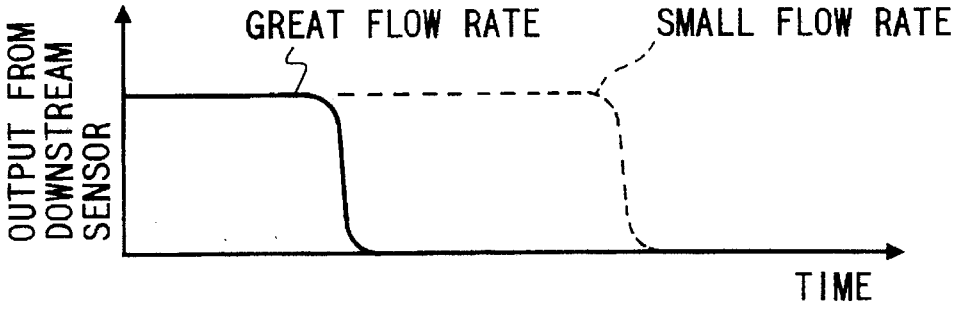

The ΔRS-map, shown in FIG. 13, used in steps 254 and 281, plots the control parameters (i.e., the skip mounts ΔRSP and ΔRSM, and the integration mounts ΔRSIP and ΔRSIM) so that they may increase as the intake air mount is decreased. This causes the air-fuel ratio to be changed fast as the intake air mount is decreased, thereby improving characteristics of the downstream $O_2$ feedback control whose control cycle will become longer when the intake air mount is low. In general, an $O_2$ storage mount of the catalyst, although it is slightly changed according to a change in temperature, is almost constant regardless of engine operating conditions, while the mount of exhaust gas is changed greatly. As shown in FIGS. 14(*a*) and 14(*b*), when a great deal of exhaust gas and a small deal of exhaust gas at the same lean air-fuel ratio (containing the same amount of $O_2$) are discharged through the catalyst in the event of the amount of $O_2$ stored in the catalyst representing zero (0), the great deal of the exhaust gas causes the $O_2$ storage amount to be saturated earlier than the small deal of the exhaust gas. It will be appreciated that when the same skip and integration amounts are provided regardless of engine operating conditions, it will cause the control cycle when the great deal of exhaust gas is discharged to become shorter than the small deal of exhaust gas. Accordingly, in this embodiment, the control parameters (the skip amounts ΔRSP and ΔRSM, and the integration amounts ΔRSIP and ΔRSIM) are so determined as to increase a variation in air-fuel ratio as the amount of exhaust gas, or the mount of intake air is decreased for eliminating the variation in control cycle. In this embodiment, the amount of intake air measured by the airflow meter 13 is substituted for the amount of exhaust gas, however, it may also be replaced with intake pipe pressure, engine speed, or throttle opening degree.

Figure 15:
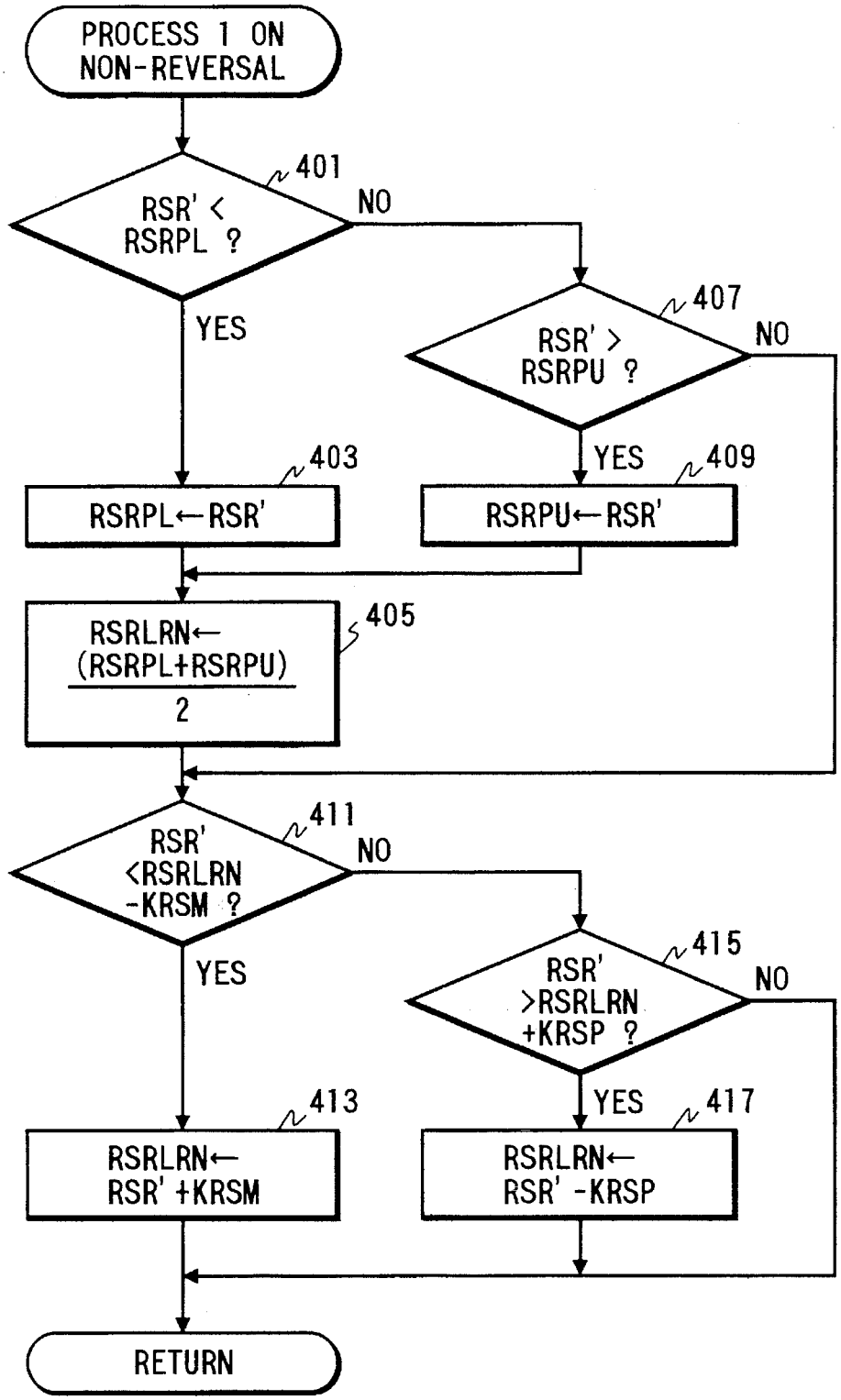
FIG. 15 is a flowchart which shows part of downstream feedback control performed by an air-fuel ratio control system.

Referring back to FIG. 11, after step 259, 261, 273, or 275, the routine proceeds to step 290 wherein a subroutine, as shown in FIG. 15, is performed. This routine is for leaning the control parameters when the air-fuel ratio has not been reversed between the rich and lean sides as well as when it has been reversed, but it may alternatively be executed only when the air-fuel ratio has not been reversed.

After entering step 290, the routine proceeds to step 410 wherein a current value of the skip correction parameter RSR' is compared with RSRPL indicative of a value of RSR' derived upon a previous reversal of the air-fuel ratio from the rich to lea side. If RSR'<RSRPL, then the routine proceeds to step 403 wherein the current value of RSR' is set as RSRPL. Alternatively, if RSR'≧RSRPL in step 401, then the routine proceeds to step 407 wherein it is determined if RSR' is greater than RSRPU indicative of a value of RSR' derived upon a previous reversal of the air-fuel ratio from the lean to rich side. If a YES answer is obtained, then the routine proceeds to step 409 wherein a current value of RSR' is set as RSRPU. After step 403 or 409, the routine proceeds to step 405 wherein the learning value RSRLRN is derived by averaging RSRPL and RSRPU. If a NO answer is obtained (RSR'≦RSRPU) in step 407 meaning that the current value of RSR' is between RSRPL and RSRPU, then the routine proceeds directly to step 411.

In step 411, it is determined whether the RSR' is smaller than the learning value RSRLRN by a given value KRSM or not. If a YES answer is obtained meaning that RSR' is much smaller than the learning value RSRLRN, then the routine proceeds to step 413 wherein the learning value RSRLRN is updated by adding KRSM to RSR'. If a NO answer is obtained in step 411, then the routine proceeds to step 415 wherein it is determined whether the RSR' is greater than the sum of the learning value RSRLRN and a given value KRSP or not. If a NO answer is obtained concluding that RSR' is near the learning value RSRLRN, then the routine goes to RETURN. Alternatively, if a YES answer is obtained meaning that RSR' is much greater than RSRLRN, then the routine proceeds to step 417 5 wherein the learning value RSRLRN is updated by subtracting KRSP from RSR'. After step 413 or 417, the routine returns back to step 290 in FIG. 11 wherein the process upon non-reversal of the air-fuel ratio is completed, and then returns back to step 296, as shown in FIG. 6 wherein the downstream $O_2$ main process is completed.

Afterward, the routine proceeds to steps 298 and 299 wherein the skip correction parameter RSR' and the rich/lean flag F2 are stored in the memory as RSRO and F20, respectively. The routine then proceeds to step 205.

If a NO answer is obtained in step 295 meaning that the air-fuel ratio is oriented to the same side (the rich or lean side) as that before the system undergoes the open-loop control, then the routine proceeds to step 247 wherein RSR' is set to RSRO indicative of a value of RSR' immediately before the routine goes to the open-loop control. RSR' is held to RSRO (RSR'=RSRO) until the counter value CFBR reaches zero (0), or the rich/lean flag F2 shows a value different from F20, that is, until the given period of time has expired following establishment of the feedback control conditions, or the air-fuel ratio has been shifted to a side opposite to that before the open-loop control is initiated. In step 247, the control constant, i.e., RSR' may alternatively be set to a value derived by adding a given value to RSRO for having the control constant reach a convergent value quickly.

The holding of RSR' is released when the rich/lea flag F2 becomes different from F20 in order to have the system be responsive to a change in air-fuel ratio to reduce exhaust emissions. After step 247, the routine proceeds to step 205, as already discussed.

Figure 16:
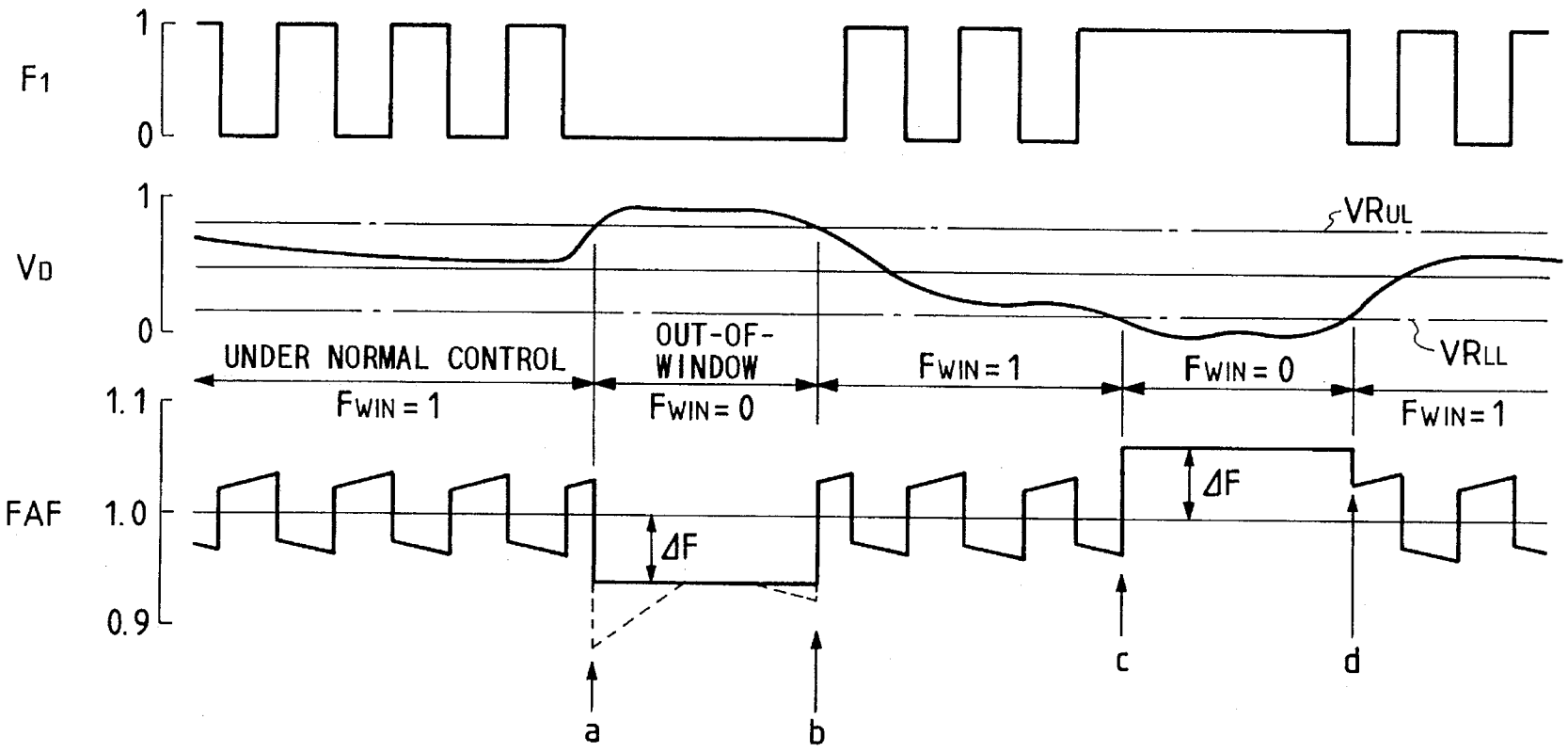
FIG. 16 is a time chart which shows the entire flow of an air-fuel ratio management routine.

FIG. 16 shows the entire flow of the air-fuel ratio management routine. As apparent from the time-chart shown, when the output voltage $V_D$ from the downstream air-fuel ratio sensor 119 lies within the acceptable range defined between the upper and lower limits $VR_{UL}$ and $VR_{LL}$, the air-fuel ratio correction amount FAF is determined under the normal feedback control, as explained above. When the output voltage $V_D$ of the downstream air-fuel ratio sensor 119 exceeds the upper limit $VR_{UL}$ at a time a, FAF is set to a value which is smaller than 1.0 by ΔF, thereby shifting an air-fuel ratio to the lean side. Thus, $O_2$ is stored in the catalyst so that the concentration of $O_2$ downstream of the catalytic converter 118 is increased, thereby causing the output voltage $V_D$ to fall within the acceptable range at a time b. When the output voltage $V_D$ of the downstream air-fuel ratio sensor 119 drops below the lower limit $VR_{LL}$ at a time c, FAF is set by adding ΔF to 1.0, thereby causing the air-fuel ratio to become rich. Thus, $O_2$ in the catalyst is consumed so that the concentration of $O_2$ downstream of the catalytic converter 118 is decreased, thereby causing the output voltage $V_D$ to fall within the acceptable range at a time d. In this manner, the storage mount of $O_2$ in the catalyst is maintained constant at all times, ensuring proper purification of exhaust emissions.

Figures 17A, 17B, 17C:
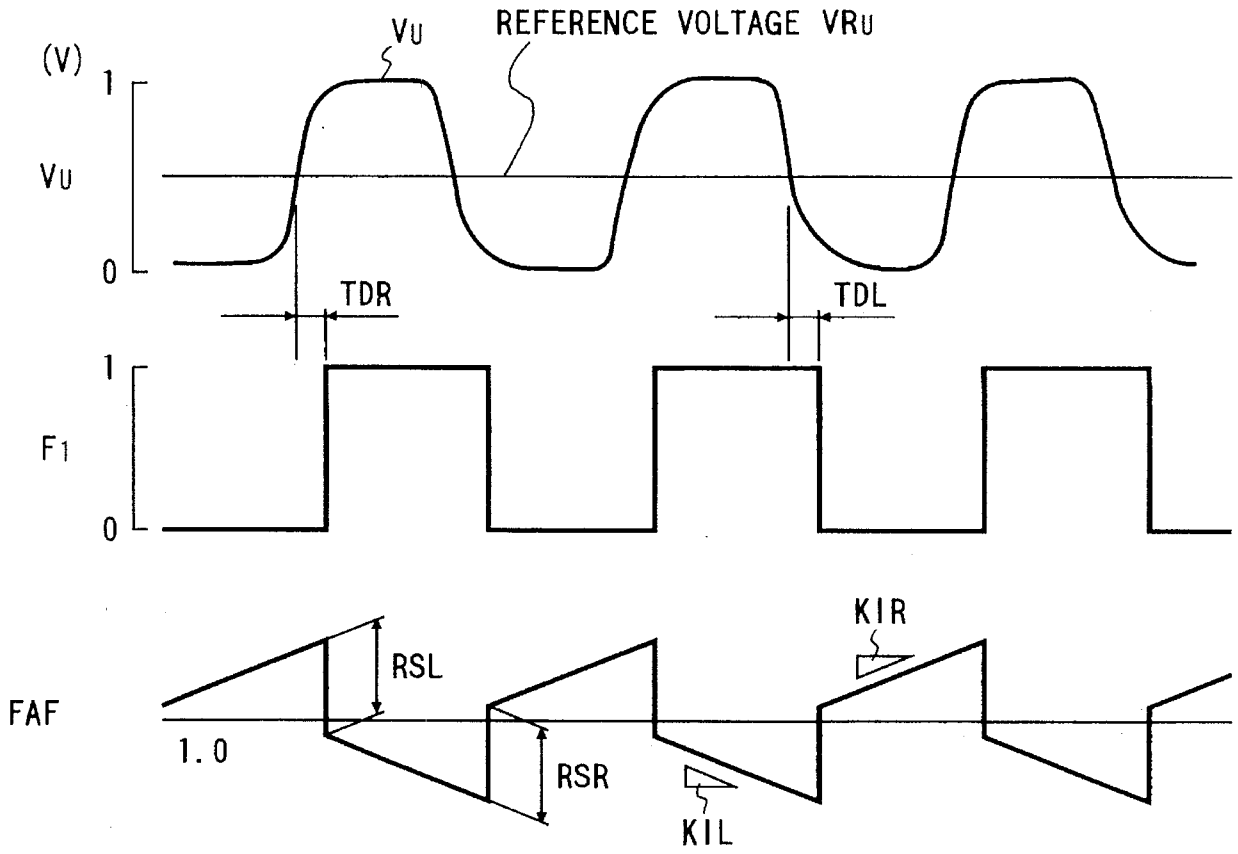
FIGS. 17(*a*), 17(*b*), and 17(*c*) are time charts for explaining an upstream $O_2$ feedback control.

FIGS. 17(*a*) to 17(*c*) show time charts for determining the control parameters under the upstream $O_2$ feedback control and the downstream $O_2$ feedback control.

Assuming that the output voltage $V_U$ of the upstream air-fuel ratio sensor 19 varies, as shown in FIG. 17(*a*), across the reference voltage $V_{RU}$, the rich/lea flag F1 is, as shown in FIG. 17(*b*), changed after a lapse of the delay time TDR when an air-fuel ratio is shifted from the lean to rich side, while it is changed after a lapse of the delay time TDL when the air-fuel ratio is shifted from the rich to lean side. Upon the flag F1 being changed, the air-fuel ratio correction amount FAF (i.e., a controlled air-fuel ratio) is, as shown in FIG. 17(*c*), corrected. This correction of the air-fuel ratio correction amount FAF may be made based any of the reference voltage $VR_U$, the delay times TDR and TDL, the skip amounts RSR and RSL, and the integration constants KIL and KIR or a combination thereof.

Figure 18:
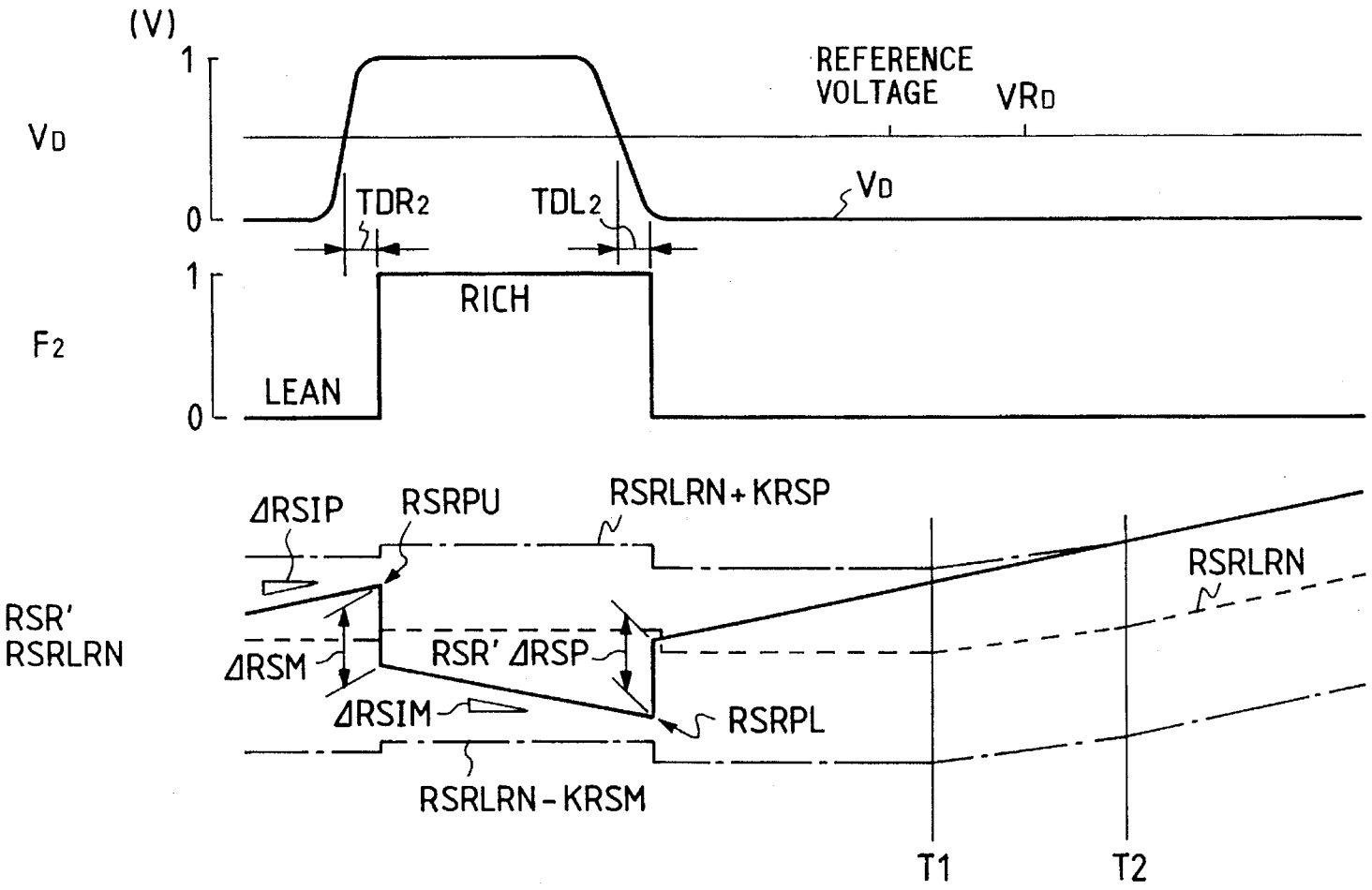
FIG. 18 is a time chart for explaining a downstream $O_2$ feedback control.
Figures 19A, 19B, 19C, 19D, 19E:
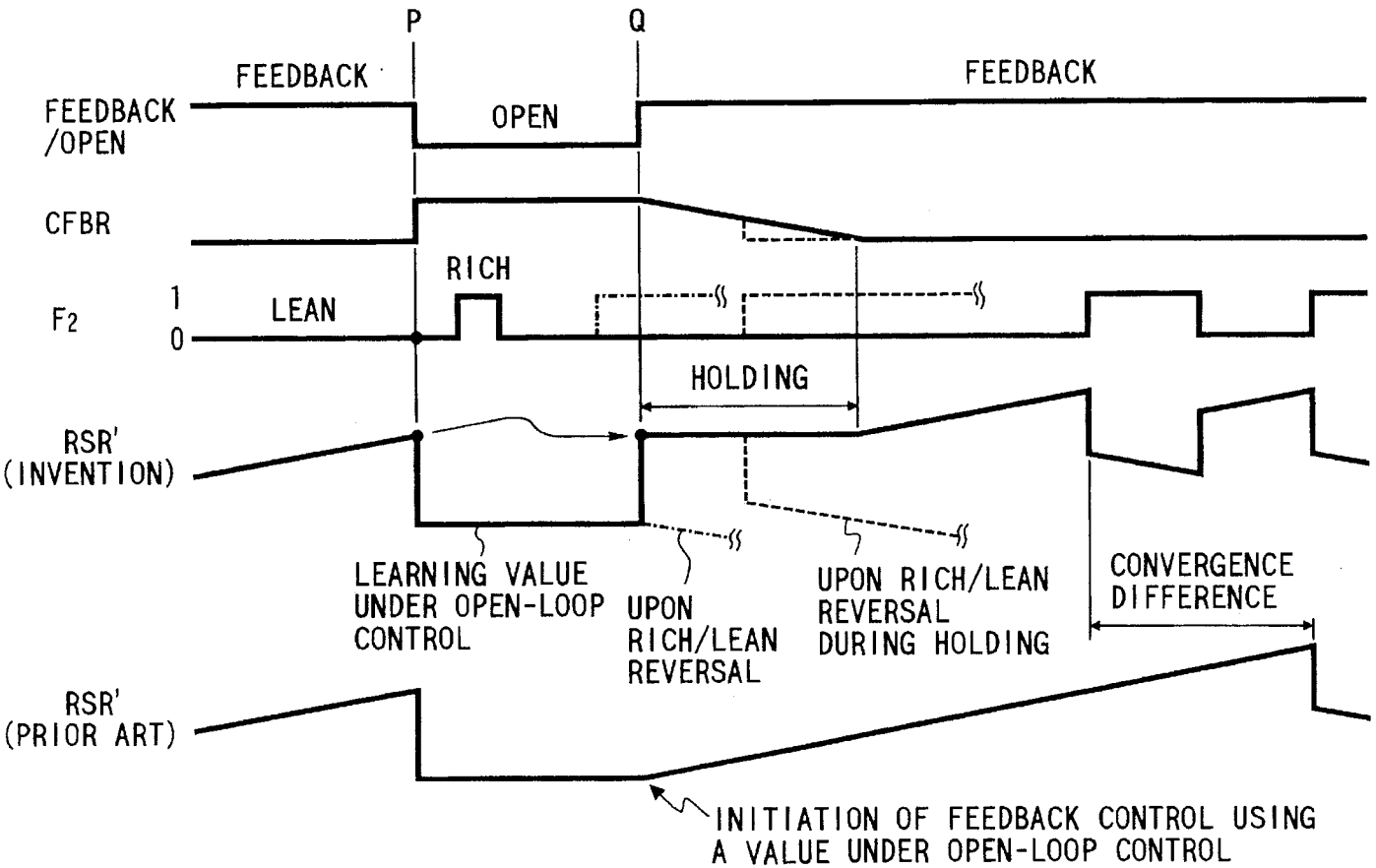
FIGS. 19(*a*) to 19(*e*) are time charts for explaining control operations when an air-fuel ratio control system is brought under downstream $O_2$ feedback control from open-loop control.

FIGS. 18 and 19(*a*) to 19(*d*) show the operation of the downstream $O_2$ feedback control.

The output voltage $V_D$ from the downstream air-fuel ratio sensor 119 is processed with a given delay, as similar to the upstream air-fuel ratio sensor 19, to set the rich/lean flag F2. The skip correction parameter RSR' used for calculation of the skip amounts RSR and RSL is determined based on a value of the flag F2. When the flag F2 is changed from zero (lean side) to one (rich side), the skip amount ΔRSM is subtracted from RSR', after which it is decreased by ΔRSIM every 524 msec. of program cycle. Alternatively, when the flag F2 is changed from one (rich side) to zero (lean side), the skip amount ΔRSP is added to RSR', after which it is increased by ΔRSIP every 524 msec. of program cycle.

When the flag F2 continues to show zero (0), a value of RSR' exceeds at a time T1 a value of RSRPU which was set upon previous lean-to-rich reversal of the flag F2. At this time, the value of RSR' is set as RSRPU and the learning value RSRLRN is updated by averaging RSRPU and RSRPL (RSRLRN=(RSRPU+RSRPL)/2). Afterward, when the flag F2 further continues to show zero (0), the above process is repeated to update the learning value RSRLRN. A variation in RSRLRN thus updated depends upon the average of RSRPU and RSRPL, and therefore is half a variation in RSR'. Accordingly, under this condition, at a time T2, RSR' reaches a value which is greater than RSRLRN by KRSP. Subsequently, the learning value RSRLRN continues to be updated to a value which is smaller than RSR' by KRSP until the flag F2 is reversed.

In the above embodiment, the learning value RSRLRN is, as clearly form the above discussion, updated when the given conditions are met under the downstream $O_2$ feedback control. The learning value RSRLRN is, however, used only during the open-loop control, and thus it may be updated only once when the system is placed under the open-loop control.

FIGS. 19(*a*) to 19(*e*) show essential part of the present invention.

The skip correction parameter RSR' and the status of the flag F2 are stored in the memory when the system is brought at a time P under the open-loop control from the downstream $O_2$ feedback control (steps 298 and 299 in FIG. 6). At the same time, the counter CFBR are reset to the initial value CINT (step 245). When the feedback control conditions are met again to terminate the open-loop control at a time Q, it is confirmed whether the status of the flag F2 is the same as that immediately before the initiation of the open-loop control, or at the time P or not (step 295). If so, the skip correction parameter RSR' is set to the same value as that immediately before the initiation of the open-loop control (step 247). At the same time, the counter CFBR starts counting down (step 291). When the flag F2 is not reversed in a given period of time during which the counter CFBR reaches zero (0), RSR' is held as is. When the reversal of the flag F2 occurs while RSR' is held, the holding of RSR' is released, and the system is brought under the downstream $O_2$ feedback control. FIG. 19(*e*) shows a variation in RSR' when the system is under a conventional air-fuel ratio control. As apparent from the drawing, RSR' represents the same value as that at the end of the open-loop control even when the feedback control starts at the time Q. It will thus be appreciated that the conventional air-fuel ratio control requires more time for convergence of RSR' to a given value than the present invention. The holding of RSR' for a preselected time period set by the counter CFBR is provided for assuring the same amount of $O_2$ stored in the catalyst as that before the initiation of the open-loop control. If RSR' is not held for the preselected time period, the amount of $O_2$ in the catalyst becomes different from that before the open-loop control, leading to a malfunction of the system. The time required to have a sufficient amount of $O_2$ stored in the catalyst depend upon a flow rate of exhaust gas, the volume of the catalyst, and an air-fuel ratio of exhaust gas. Thus, a count value of the counter CFBR may be determined according to these data. For example, it may be set to a smaller value as the amount of exhaust gas is increased. The amount of exhaust gas may be substituted for the amount of intake air, the pressure in an intake pipe, an engine speed, or the opening degree of the throttle valve.

Figure 20:
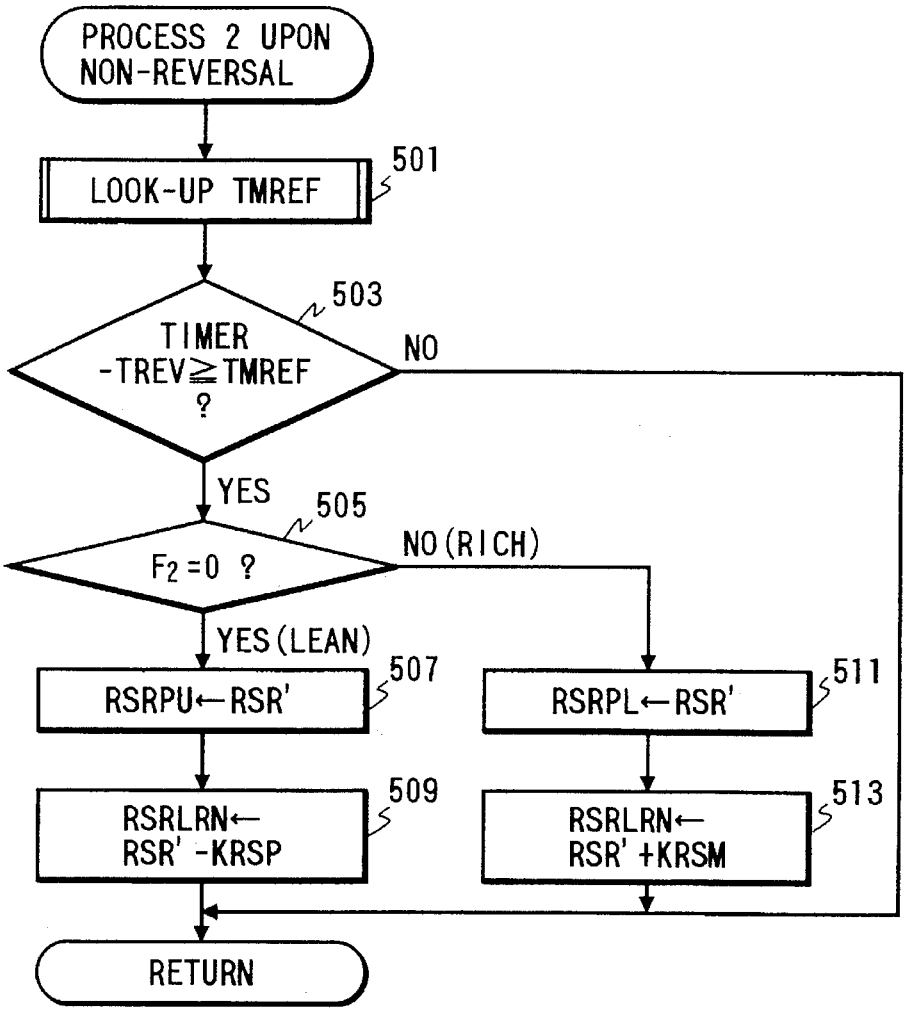
FIG. 20 is a flowchart which shows part of downstream $O_2$ feedback control.

Referring to FIG. 20, there is shown an alternative process performed in step 290, as shown in FIG. 11, when the reversal of the flag F2 does not occur.

Figure 21:
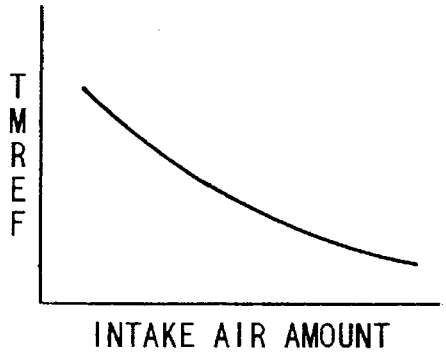
FIG. 21 is a graph which shows a relation between a reference time TMREF and an intake air amount.

After entering the program, the routine proceeds to step 501 wherein a reference time TMREF is determined by look-up using mapped data, as shown in FIG. 21, based on the amount of intake air monitored. It is desirable that the reference time TMREF substantially be set to a value which is 1.2 to 2.0 times a control cycle when the downstream $O_2$ feedback control is converged. The routine then proceeds to step 503 wherein it is determined whether time (TIMER-TREV) following previous reversal of the flag F2 has reached the reference time TMREF or not. If a NO answer is obtained, then the routine terminates. If a YES answer is obtained, then the routine proceeds to step 505 wherein it is determined whether the flag F2 is zero or not. If a YES answer is obtained meaning that the air-fuel ratio is on the lean side, then the routine proceeds to step 507 wherein the learning parameter RSRPU is substituted for RSR' to set a temporarily reversal point for subsequent learning. The routine then proceeds to step 509 wherein the learning value RSRLRN is updated by subtracting the given value KRSP from RSR'.

Alternatively, if a NO answer is obtained meaning that the air-fuel ratio is on the rich side, then the routine proceeds to step 511 wherein the learning parameter RSRPL is substituted for RSR'. The routine then proceeds to step 513 wherein the learning value RSRLRN is updated by adding the given value KRSP to RSR'.

The above processes make it possible to update the learning value RSRLRN even if the flag F2 based on the output of the downstream air-fuel ratio sensor 119 remains not reversed for an extended period of time. Additionally, it is also advisable that immediately before the learning value RSRLRN is used, the above processes be performed together after the time TIMER-TREV following the previous reversal of the flag F2 expires.

Figure 22:
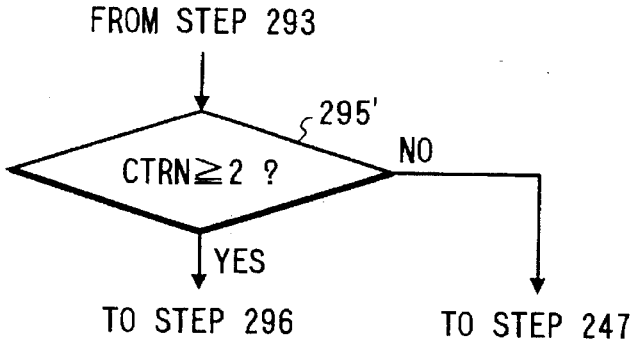
FIGS. 22, 23, and 24 are flowcharts which show modifications of downstream $O_2$ feedback control.

FIG. 22 shows a third embodiment of the invention. The shown step 295' may be executed in place of step 295 in the downstream $O_2$ feedback control routine, as shown in FIG. 6.

Figure 23:
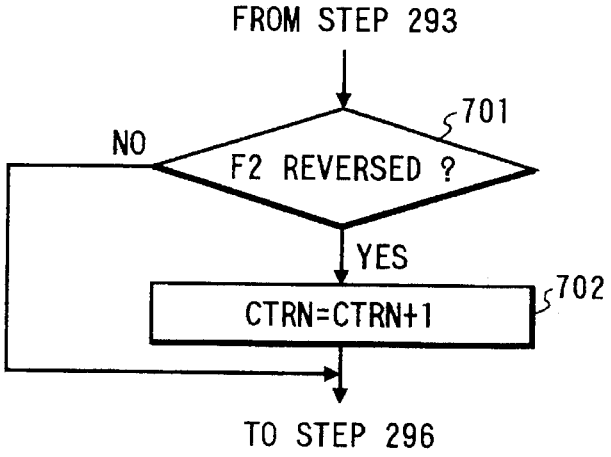

Step 295 of the above first embodiment directly compares the condition of an air-fuel ratio when the system is brought under the open-loop control with that when the downstream $O_2$ feedback control is resumed, however, it is advisable that as shown in step 295', a determination be made whether the number of times CTRN the flag F2 has been reversed based on the output of the downstream air-fuel ratio sensor 119 is greater than a given value (e.g., 2) or not. In this case, a counting process may be provided to count CTRN. FIG. 23 shows such a counting process as a fourth embodiment of the invention.

In step 701, it is determined if the flag F2 has been reversed or not. If a NO answer is obtained, then the routine proceeds directly to step 296. Alternatively, if a YES answer is obtained, then the routine proceeds to step 702 wherein a count value CTRN is incremented (CTRN=CTRN+1) and then stored in the backup RAM 31*d*.

Figure 24:
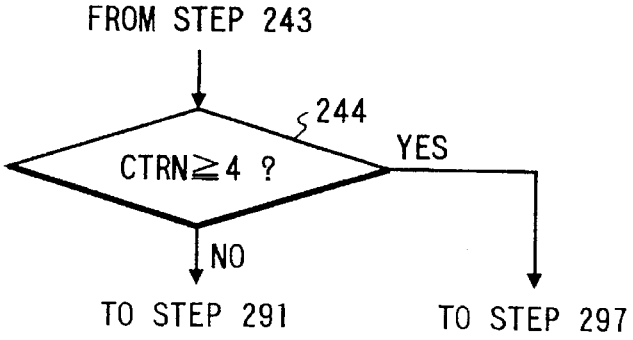

FIG. 24 shows a fifth embodiment which prohibits the operations in steps 291, 293, 295, 247, and 296 shown in FIG. 6 when it is concluded that the control parameters have been converged.

After the downstream $O_2$ feedback control conditions are met in step 243, the routine proceeds to step 244 wherein it is determined whether the count value CTRN counted in step 702 in FIG. 23 is greater than four (4) or not. If a YES answer is obtained meaning that the count value CTRN indicative of the number of times the flag F2 has been reversed, exceeds four (4), the routine proceeds directly to step 297 bypassing steps 291, 293, 295, 247, and 296.

Figures 25A, 25B, 25C:
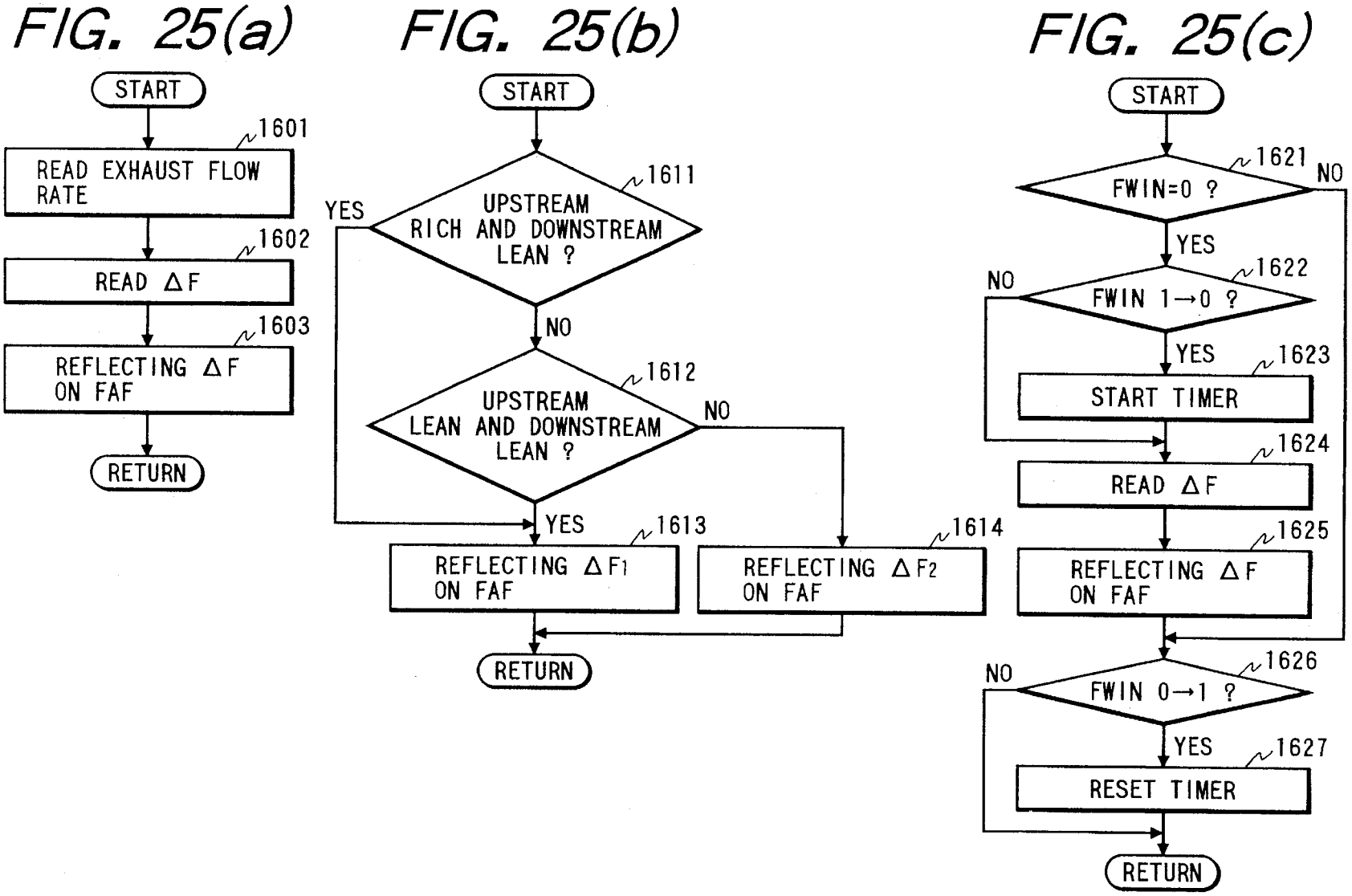
FIGS. 25(*a*) to 25(*c*) are flowcharts which shows modifications for determining a correction amount ΔF for an air-fuel ratio correction amount FAF.

Referring to FIG. 25(*a*), a sixth embodiment of the invention is shown which modifies ΔF, used for decrementing or incrementing the air-fuel ratio correction amount FAF in step 1030 or 1060, as shown in FIG. 3, according a flow rate of exhaust gas. The shown routine is executed at given time intervals or every preselected crank angle.

Figure 26A:
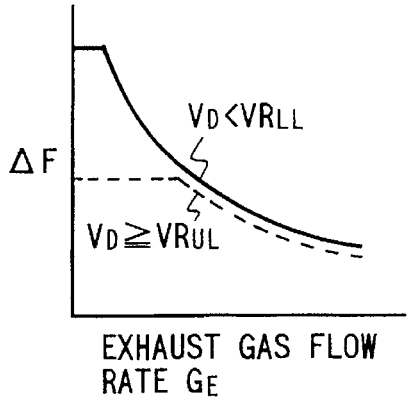
FIG. 26(*a*) is a graph which shows a relation between a correction amount ΔF and an exhaust gas flow rate Ge.
Figure 26B:
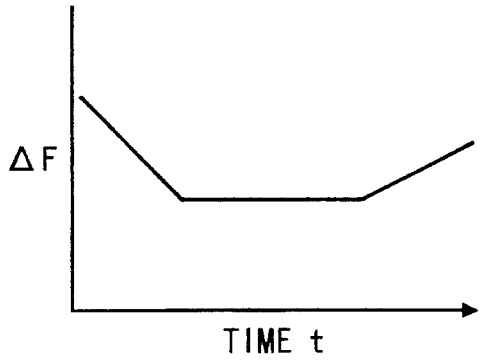

Upon initiation of the program, the routine proceeds to step 1601 wherein a flow rate of exhaust gas (hereinafter, referred to as an exhaust gas flow rate GE) is determined based on the amount of intake air measured by the airflow meter 13, the intake pressure measured by the intake pressure sensor 10, and the throttle opening degree measured by the throttle position sensor 15. The routine then proceeds to step 1602 wherein ΔF is determined by look-up using mapped data, as shown in FIG. 26, based on the exhaust gas flow rate GE. Subsequently, the routine proceeds to step 1603 wherein the air-fuel ratio correction amount is corrected using ΔF.

The determination of ΔF using the exhaust gas flow rate GE is based on the experimental fact that the product of ΔF required to bring the output voltage $V_D$ from the downstream air-fuel ratio sensor 119 into a neutral value (i.e., to adjust the oxygen concentration downstream of the catalytic converter 118 to a value corresponding to the stoichiometric air-fuel ratio) and a total flow rate of exhaust gas, shows a constant value. In order to control the air-fuel ratio in a short period of time over a wide rage of an exhaust gas amount without having the output voltage $V_D$ of the downstream air-fuel ratio sensor 119, i.e., an air-fuel ratio downstream of the catalytic converter 118 overshoot, ΔF, as shown in FIG. 26(*a*), is so provided in step 1602 as to meet the relation of ΔF×GE=a constant value. Additionally, for preventing the air-fuel ratio correction mount FAF, when the output voltage $V_D$ from the downstream air-fuel ratio sensor 119 exceeds the upper limit $VR_{UL}$, from being modified to a smaller value to shift the air-fuel ratio to the lean side, degrading the drivability, ΔF may be restricted, as shown by a broken line in FIG. 26(*a*), when the exhaust gas flow rate GE is relatively small.

FIG. 25(*b*) show a seventh embodiment which modifies ΔF according to the output from the upstream air-fuel ratio sensor 19.

Upon initiation of the program, the routine proceeds to step 1611 wherein it is determined whether or not the output voltages $V_D$ and $V_U$ from the downstream and upstream air-fuel ratio sensors 119 and 19 both represent an air-fuel ratio as being on the rich side. If a NO answer is obtained, then the routine proceeds to step 1612 wherein it is determined whether the output voltages $V_D$ and $V_U$ both represent the air-fuel ratio as being on the lean side or not. If a YES answer is obtained either in step 1611 or 1612, then the routine proceeds to step 1613. Alternatively, if the answers in steps 1611 and 1612 both show YES, the routine then proceeds to step 1614. In step 1613, $\Delta F_1$ is used for correcting the air-fuel ratio correction amount FAF. In step 1614, $\Delta F_2$ which bears the relation of $\Delta F_1 > \Delta F_2$ is used for correcting FAF.

With the above processes, for instance, even when the air-fuel ratio learning is not carried out sufficiently so that an air-fuel ratio controlled based on the air-fuel ratio correction mount FAF (=1.0) is not in agreement with the stoichiometric air-fuel ratio, and the upstream air-fuel ratio sensor, if ΔF is added to FAF (=1.0), does not show that the air-fuel ratio is on the rich side or the downstream air-fuel ratio sensor, if ΔF is subtracted from FAF (=1.0), does not show that the air-fuel ratio is on the lean side, the air-fuel ratio can be controlled based on the output from the upstream air-fuel ratio sensor 19 to bring the output from the downstream air-fuel ratio sensor 119 to within a given acceptable range.

FIG. 25(*c*) shows an eighth embodiment which modifies ΔF based on the time after the output voltage $V_D$ moves out of the acceptable range.

After starting the program, the routine proceeds to step 1621 wherein it is determined whether the flag FWIN is zero or not. If a NO answer is obtained meaning that the air-fuel ratio feedback control conditions, as discussed in FIG. 3, are all met then the routine proceeds directly to step 1622. Alternatively, if a YES answer is obtained, then the routine proceeds to step 1622 wherein it is determined whether the flag FWIN has been changed from one (1) to zero (0) or not. If a YES answer is obtained, then the routine proceeds to step 1623 wherein a timer is turned on. If a NO answer is obtained, then the routine proceeds directly to step 1624. In step 1624, ΔF is determined based on a timer value using mapped data, as shown in FIG. 26(*b*). The routine then proceeds to step 1625 wherein the air-fuel ratio correction amount FAF is corrected using ΔF derived in step 1624.

Afterward, the routine proceeds to step 1626 wherein it is determined whether the flag FWIN has been changed from zero (0) to one (1) or not. If a NO answer is obtained, the routine goes to "END". If a YES answer is obtained, then the routine proceeds to step 1627 wherein the timer is reset to zero.

With the above processes, an initial value of ΔF is set to a relatively greater value, so that the convergence of the output of the downstream air-fuel ratio sensor 119 is enhanced. Further, even if the output voltage $V_D$ of the downstream air-fuel ratio sensor 119 does not return to within the acceptable range after a lapse of a given time period, the gradually increased ΔF improves the convergence of the output of the downstream air-fuel ratio sensor 119.

Further, it is desirable that ΔF be modified based on a deviation of the output of the downstream air-fuel ratio sensor 119 from a value indicative of a stoichiometric air-fuel ratio or from the upper or lower limit $VR_{UL}$, $VR_{LL}$, or directly based on the output voltage $V_D$ of the downstream air-fuel ratio sensor 119. In this case, for example, in step 1601 of FIG. 25(*a*), a voltage deviation of an output of the downstream air-fuel ratio sensor 119 from a given level is determined in place of the determination of the exhaust gas flow rate GE. In step 1602, ΔF is so determined as to increase as the voltage deviation becomes great.

Additionally, in the above first embodiment, since the learning control is carried out, when the output voltage $V_D$ lies out of the acceptable range, the air-fuel ratio correction amount FAF is determined based on the relation of FAF=1+ΔF, however, in a system which does not perform the learning control, FAF may be derived by adding ±ΔF to the average of FAFs immediately before the output voltage $V_D$ of the downstream air-fuel ratio sensor 119 moves out of the upper and lower limits.

Figure 27:
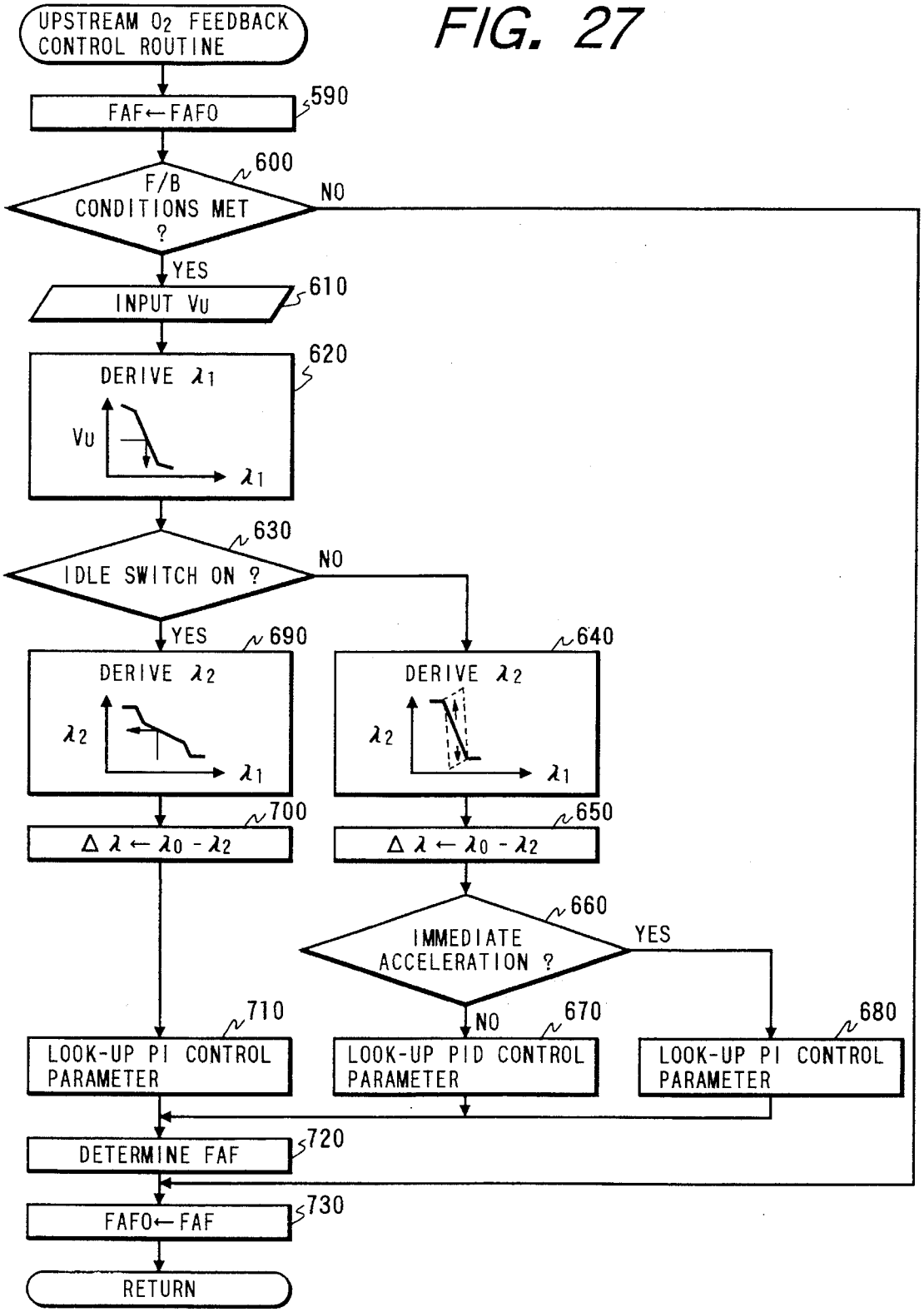
FIG. 27 is a flowchart which shows a modification of an air-fuel ratio using linearized PID control.

Referring to FIG. 27, there is shown a ninth embodiment of the present invention which is different from the above first embodiment in that the so-called linearized PID (proportional, integral, and differential actions) control is utilized under the upstream $O_2$ feedback control, and which is identical therewith in the management routine, as shown in FIG. 3. However, this embodiment permits a program, or control cycle to be prolonged more than that in the first embodiment, and thus the management routine is carried out every 16 msec. Additionally, the introduction of the linearized PID control causes the downstream $O_2$ feedback control to be changed slightly. Only these will be explained below.

Figure 28:
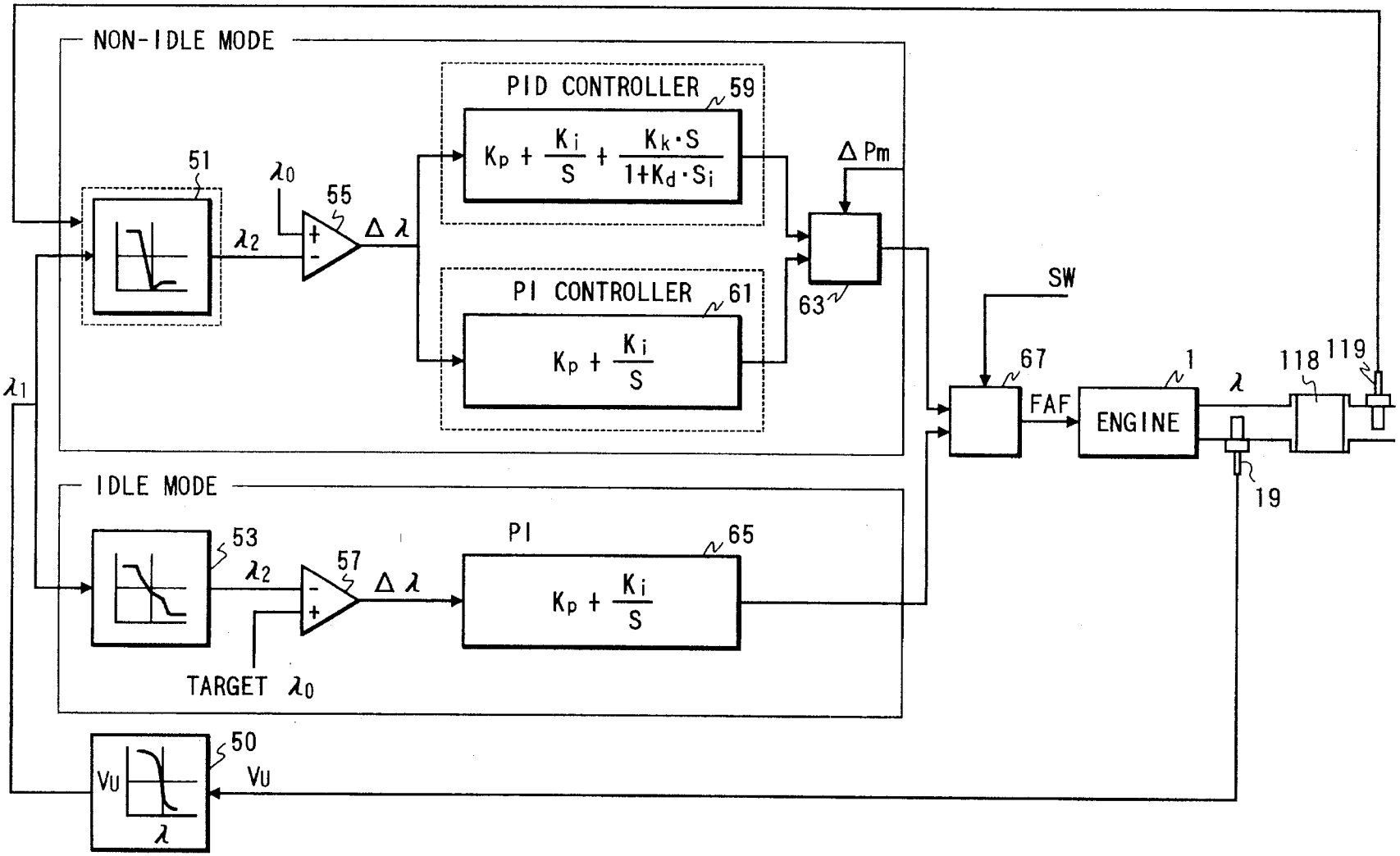
FIG. 28 is a block diagram which shows an air-fuel ratio control system according to the flowchart shown in FIG. 27.

FIG. 27 shows a flowchart of the upstream $O_2$ feedback control routine performed by the ECU 30, and FIG. 28 is a block diagram which represents the feedback control according to logical steps in FIG. 27.

After entering step 1080 of the management routine, as shown in FIG. 3, in step 590, FAFO which is the air-fuel ratio correction amount FAF in the last program cycle, is set to FAF. Subsequently, the routine proceeds to step 590 wherein it is determined whether given air-fuel ratio feedback control conditions are all met or not. As such air-fuel ratio control conditions, for example, it is known in the art to determine a coolant temperature level, the presence or absence of a fuel cut, and whether the acceleration is increased or not. These determinations are made prior to step 1000 in the management routine, and step 600 uses the results thereof.

If a NO answer is obtained in step 600 meaning that the air-fuel ratio feedback control conditions are not met, then the routine proceeds directly to step 730. Alternatively, if a YES answer is obtained, then the routine proceeds to step 610 wherein the output voltage $V_U$ of the upstream air-fuel ratio sensor 19 is taken in. The routine then proceeds to step 620 wherein a standard excess air ratio λ1 is determined based on the output voltage $V_U$ using the mapped data shown. Note that the excess air ratio represents a rate of an actual intake air amount being supplied relative to a reference value (=1.0) indicative of the amount of intake air provided at a stoichiometric air-fuel ratio. The standard excess air ratio λ1 is mathematically determined by projecting the amount of intake air contained in an actual mixture based on the oxygen concentration in the exhaust passage derived by an output voltage of the upstream air-fuel ratio sensor 19.

After step 620, the routine proceeds to step 630 wherein it is determined whether the idle switch **15*b* is turned on or not. If a NO answer is obtained concluding that the idle switch 15*b* is OFF, then the routine proceeds to step 640 wherein a control excess air ratio λ2 which corresponds to λ1 is determined by looking up a non-idle mode map, as shown. Subsequently, the routine proceeds to step 650** wherein the control excess air ratio λ2 is subtracted from a target excess air ratio λ0 to derive a deviation Δλ. Note that the target excess air ratio λ0 is an excess air ratio at a target air-fuel ratio determined based on running conditions of the vehicle. For example, if the target air-fuel ratio is a stoichiometric air-fuel ratio, then λ0=1.0.

Afterward, in step 660, it is determined whether the vehicle is under sudden or immediate acceleration or not. If a NO answer is obtained, then the routine proceeds to step 670 wherein a PID control calculation parameter is looked up. Alternatively, if a YES answer is obtained, then the routine proceeds to step 680 wherein a PI (proportional and integral actions) control calculation parameter is looked up.

In step 630, if a YES answer is obtained meaning that the idle switch **15*b* is turned on, or the engine is idling, then the routine proceeds to step 690 wherein the control excess air ratio λ2 is determined by looking up an idle mode map, as shown. Subsequently, the routine proceeds to step 700 wherein the control excess air ratio λ2 is subtracted from the target excess air ratio λ0 to derive the deviation Δλ. The routine then proceeds to step 710** wherein the PI control calculation parameter is looked up.

Subsequently, the routine proceeds to step 720 wherein using the calculation parameter derived (in step 670, 680, or 710) based on whether the engine is in the idle mode or not and whether the engine is under acceleration or not, the air-fuel ratio correction amount FAF is determined, which will be described later in detail. The routine then proceeds to step 730 wherein FAF is set to as FAFO.

Now, the air-fuel ratio feedback control performed according to the flowchart of FIG. 27 will be discussed in detail with reference to the block diagram in FIG. 28.

Figure 29:
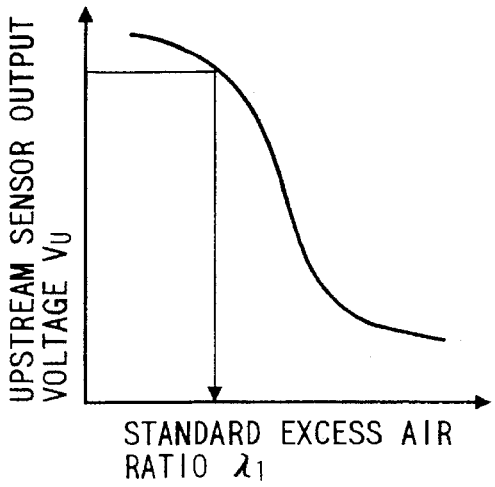
FIG. 29 is a graph which shows a relation between an output voltage $V_U$ of an upstream air-fuel ratio sensor and a standard excess air ratio λ1.

The output voltage $V_U$ of the upstream air-fuel ratio sensor 19 is inputted to a linearizer 50, which corresponds to steps 610 and 620. The linearizer 50 has a characteristic map, as shown in FIG. 29. In practice, the data identified by this characteristic map is pre-stored in the ROM **31*b*. This characteristic map defines a relation between the output voltage $V_U$ of the upstream air-fuel ratio sensor 19 and the standard excess air ratio λ1. According to this characteristic map, the linearizer 50 derives the standard excess air ratio λ1, which corresponds to the output voltage $V_U$ received from the upstream air-fuel ratio sensor 19**.

Figure 30A:
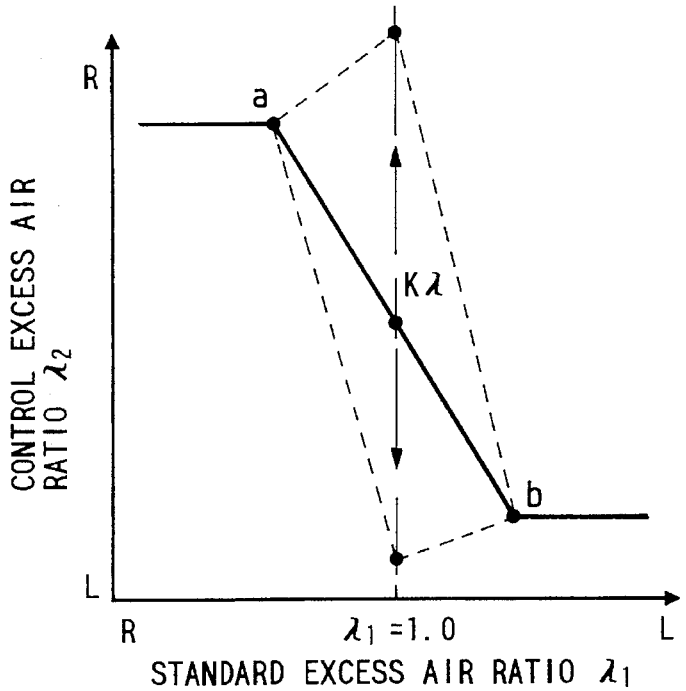
FIGS. 30(*a*) and 30(*b*) are graphs which show relations between a control excess air ratio λ2 and a standard excess air ratio λ1 in a non-idle mode of engine operation.
Figure 30B:
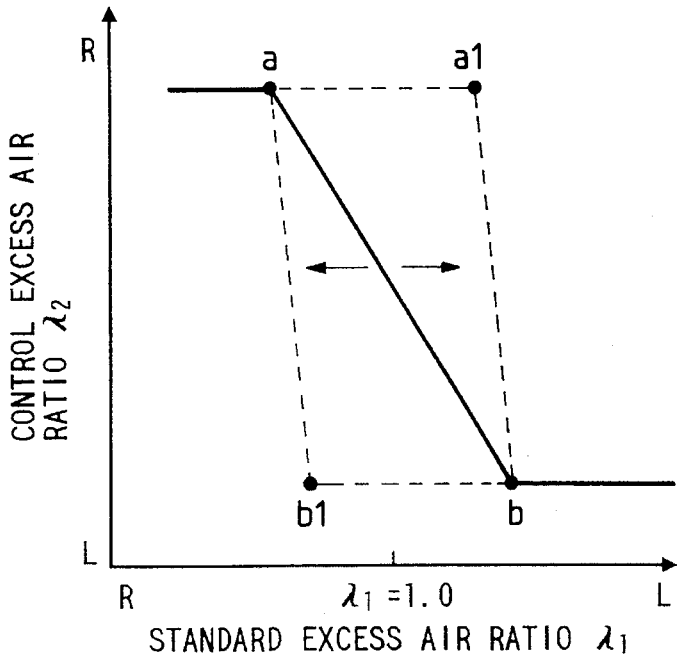
Figure 31:
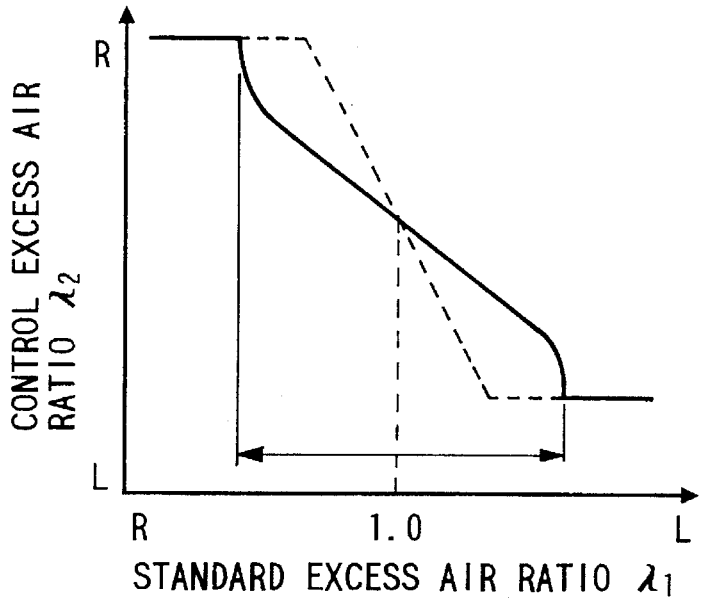
FIGS. 31 is a graph which shows a relation between a standard excess air ratio λ1 and a control excess air ratio λ2 in an idle mode of engine operation.

The derived standard excess air ratio λ1 is fed to a correction linearizer 51 for the non-idling engine operation and a correction linearizer 53 for the engine idling operation. The correction linearizer 51 corresponds to step 640, and the correction linearizer 53 corresponds to step 690. The correction linearizer 51 has the characteristic maps for the non-idling engine operation, as shown in FIGS. 30(*a*) and 30(*b*). The correction linearizer 53 has the characteristic map for the idling engine operation, as shown in FIG. 31. In fact, the data identified by these characteristic maps is also pre-stored in the ROM **31*b*. The characteristic maps in FIGS. 30**(*a*), 30(*b*), and 31 respectively show relations between the standard excess air ratio λ1 and the control excess air ratio λ2. According to these characteristic maps, the linearizers 51 and 53 determine the control excess air ratio λ2 based on the standard excess air ratio λ1.

Figure 32:
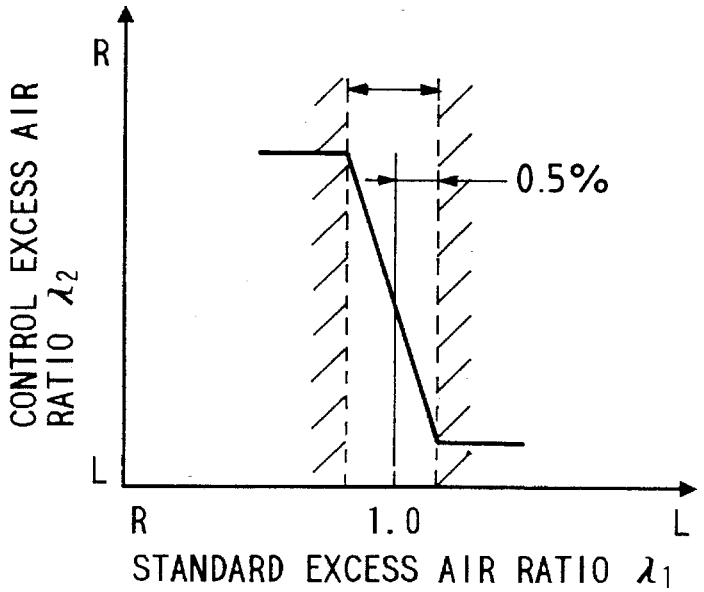
FIG. 32 is a graph which shows a common basic relation between a standard excess air ratio λ1 and a control excess air ratio λ2 in idle and non-idle modes of engine operation.

The characteristic maps in FIGS. 30(*a*), 30(*b*), and 31 also partly include a common basic relation between the standard excess air ratio λ1 and the control excess air ratio λ2, which is shown in FIG. 32.

Figure 33:
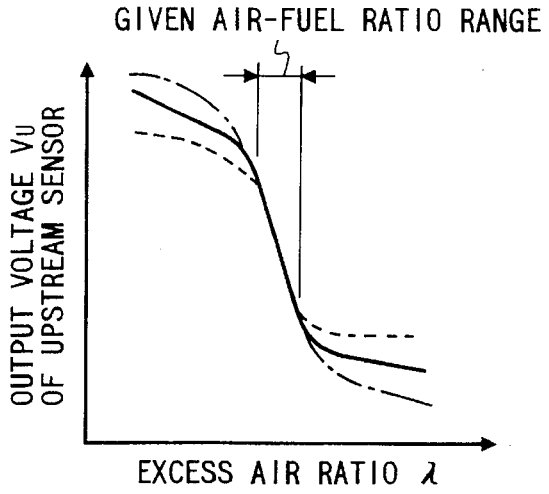
FIG. 33 is a graph which shows a variation in relation between a control excess air ratio λ2 and an excess air ratio λ.

The common basic relation for the control excess air ratio λ2 is, as shown in the drawing, maintained constant outside a given air-fuel ratio range defined by a width of 1% across the standard excess air ratio λ1 of 1.0 which represents the stoichiometric air-fuel ratio. As will be apparent from FIG. 33, an unwanted variation in level of the output voltage $V_U$ of the upstream air-fuel ratio sensor 19 usually increases considerably outside a given air-fuel ratio range over a width of 1% across the excess air ratio λ due to individual characteristics of an employed sensor and/or ambient temperature. Within the given air-fuel ratio range, such a variation in level of the output voltage $V_U$ is small enough to be ignored. For this reason, the common basic relation is established in the characteristic maps for both the non-idling engine operation and the idling engine operation so as to inhibit the variation of the output voltage $V_U$ from the upstream air-fuel ratio sensor 19 reflecting upon the control excess air ratio λ2 during the air-fuel ratio feedback control.

Now, the difference between the characteristic map for the non-idling engine operation, as shown in FIGS. 30(*a*) and 30(*b*) and the idling engine operation, as shown in FIG. 31, will be discussed below. As shown in FIGS. 30(*a*) and 30(*b*), within the given air-fuel ratio range, the relation between λ1 and λ2 is so shifted vertically or horizontally as to bias the control excess air ratio λ2, which varies according to the standard excess air ratio λ1, to the rich (R) or lean (L) side with respect to the stoichiometric air-fuel ratio.

On the other hand, as shown in FIG. 31, within the given air-fuel ratio across the stoichiometric air-fuel ratio, the relation is defined wherein a variation of the control excess air ratio λ2, which is increased or decreased according to a variation of the standard excess air ratio λ1, is reduced as compared with a basic variation, as shown by a broken line.

Referring back to FIG. 28, the correction linearizer 51 and the correction linearizer 53 respectively output the control excess air ratio λ2 corresponding to the standard excess air ratio λ1 using the characteristic maps for the non-idling engine operation and the idling engine operation. The control excess air ratio λ2 outputted from the correction linearizer 51 is fed into a deviation calculation circuit 55, while the control excess air ratio λ2 outputted from the correction linearizer 53 is fed into a deviation calculation circuit 57.

Each of the deviation calculation circuits 55 and 57 output a deviation Δλ between the control excess air ratio λ2 and the target excess air ratio λ0. Based on the calculated deviation Δλ, the air-fuel ratio control, which will be described below, is performed. Under this air-fuel ratio control, the difference between the characteristic maps for the non-idling engine operation and the idling engine operation basically offers control characteristics, as discussed below.

As shown in FIG. 25 and as described above, both in the non-idling and idling engine operation, the control excess air ratio λ2, when the standard excess air ratio λ1 lies out of the given air-fuel ratio rage, is held at a sufficiently large or smaller constant value. On the other hand, when the standard excess air ratio λ1 falls within the given air-fuel ratio range, the control excess air ratio λ2 varies according to a variation in the standard excess air ratio λ1.

Accordingly, the air-fuel ratio feedback control performed based on the deviation Δλ between the control excess air ratio and the target excess air ratio λ0 compensates for the deviation assuming high follow-up characteristics. On the other hand, since the control excess air ratio λ2 stops varying when the standard excess air ratio λ1 lies out of the given air-fuel ratio range, the unexpected variation in the output voltage $V_D$ of the upstream air-fuel ratio sensor 19 is inhibited from reflecting onto the air-fuel ratio control. This ensures the highly reliable control performance to improve exhaust emissions.

Additionally, when the standard excess air ratio λ1 falls within the given air-fuel ratio range during non-idling modes of engine operation, the following control characteristics are attained.

Figure 34:
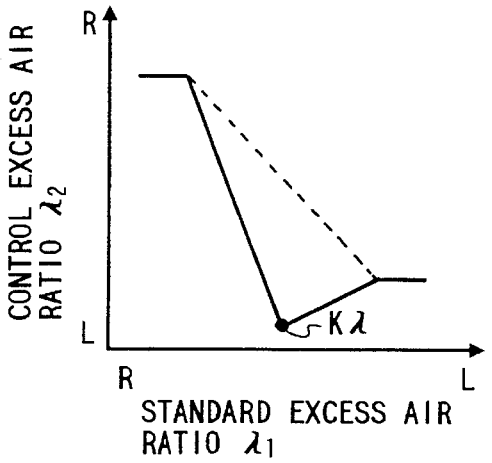
FIG. 34 is a graph which shows a relation between a control excess air ratio λ2 and an excess air ratio λ in a non-idle mode of engine operation.

FIG. 34 shows one example of the relation between the standard excess air ratio λ1 and the control excess air ratio λ2 in FIG. 30(*a*) or 30(*b*). A solid line represents the control excess air ratio λ2 which is shifted toward the lean side as a whole. A broken line represents a basic relation between λ1 and λ2 with no such a shift. When the shifted relation shown by the solid line is available in the correction linearizer 51, it provides the control excess air ratio λ2 which is changed, as shown by a solid line in a time chart in FIG. 35. Alternatively, when the basic relation shown by the broken line is available in the correction linearizer 51, it provides the control excess air ratio λ2 which is changed, as shown by a broken line in the time chart.

Figure 35:
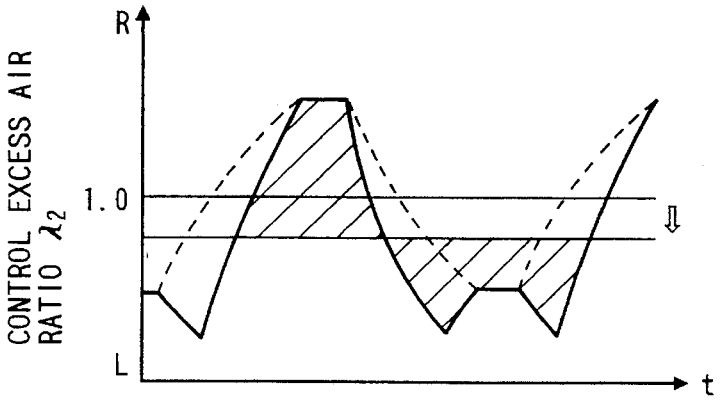
FIG. 35 is a time chart which shows a variation in control excess air ratio λ2.
Figure 36:
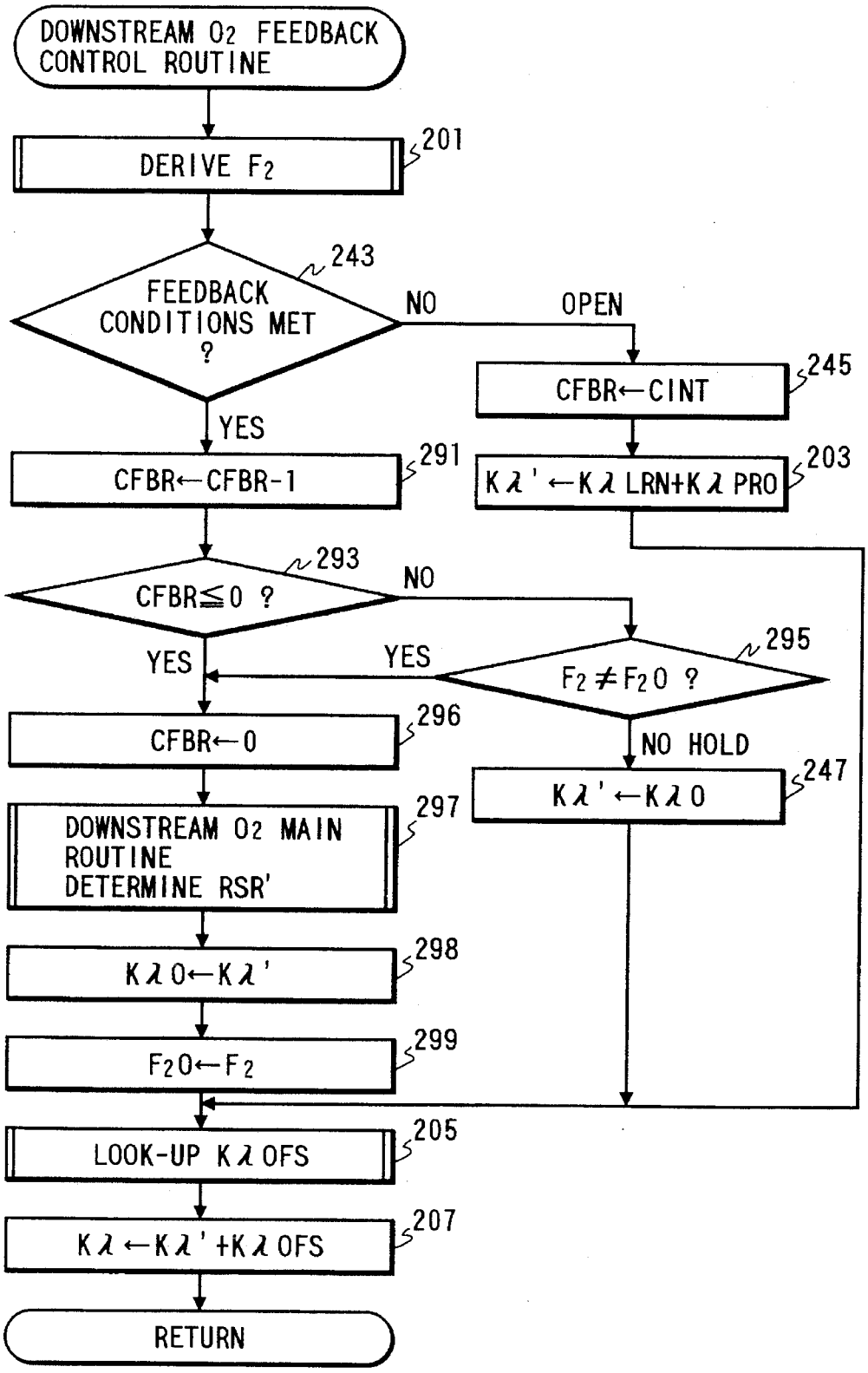
FIGS. 36 to 41 are flowcharts for correcting kλ under downstream $O_2$ feedback control, which correspond to those in FIGS. 6, 7, 11, 12, 15, and 20.
Figure 37:
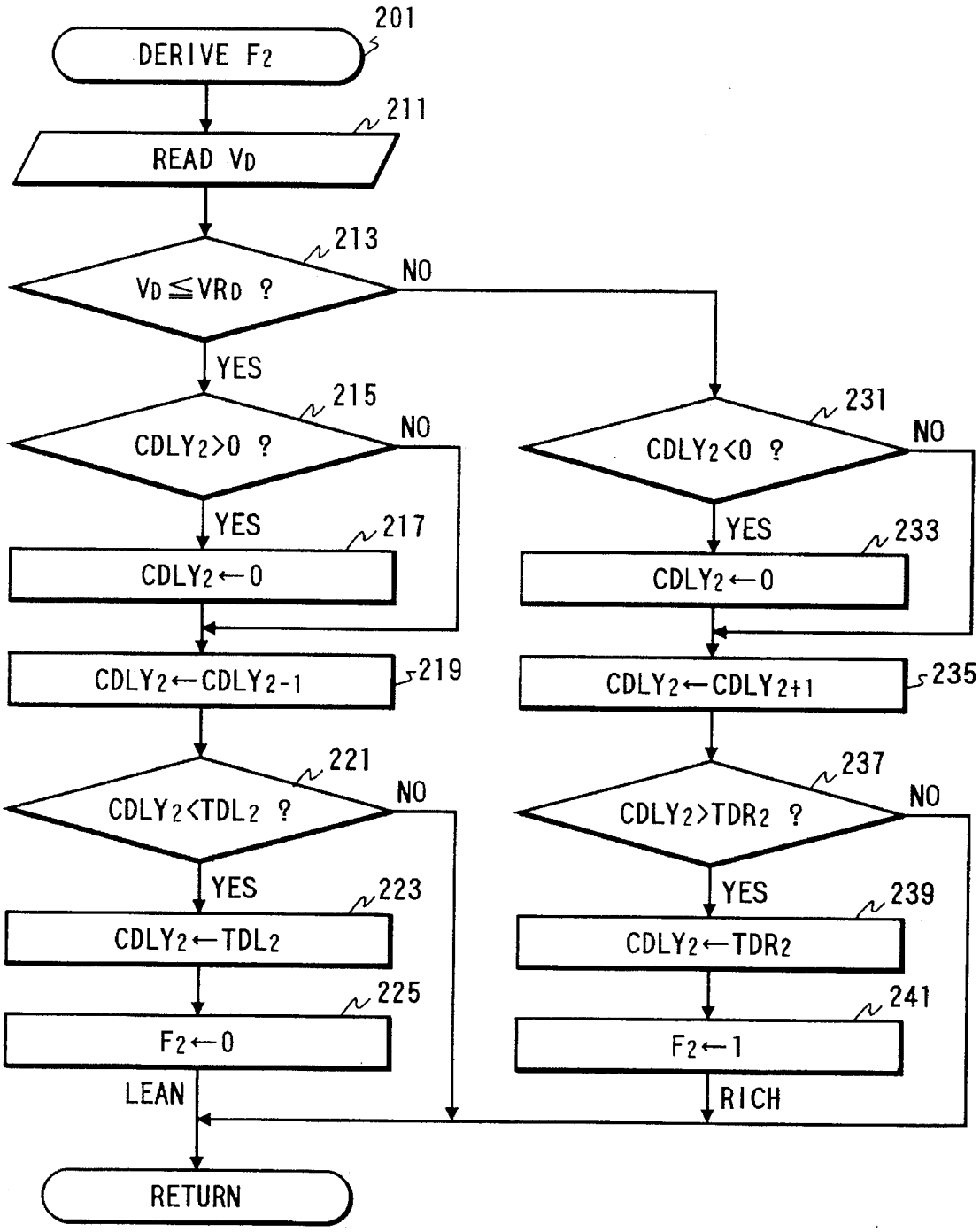
Figure 38:
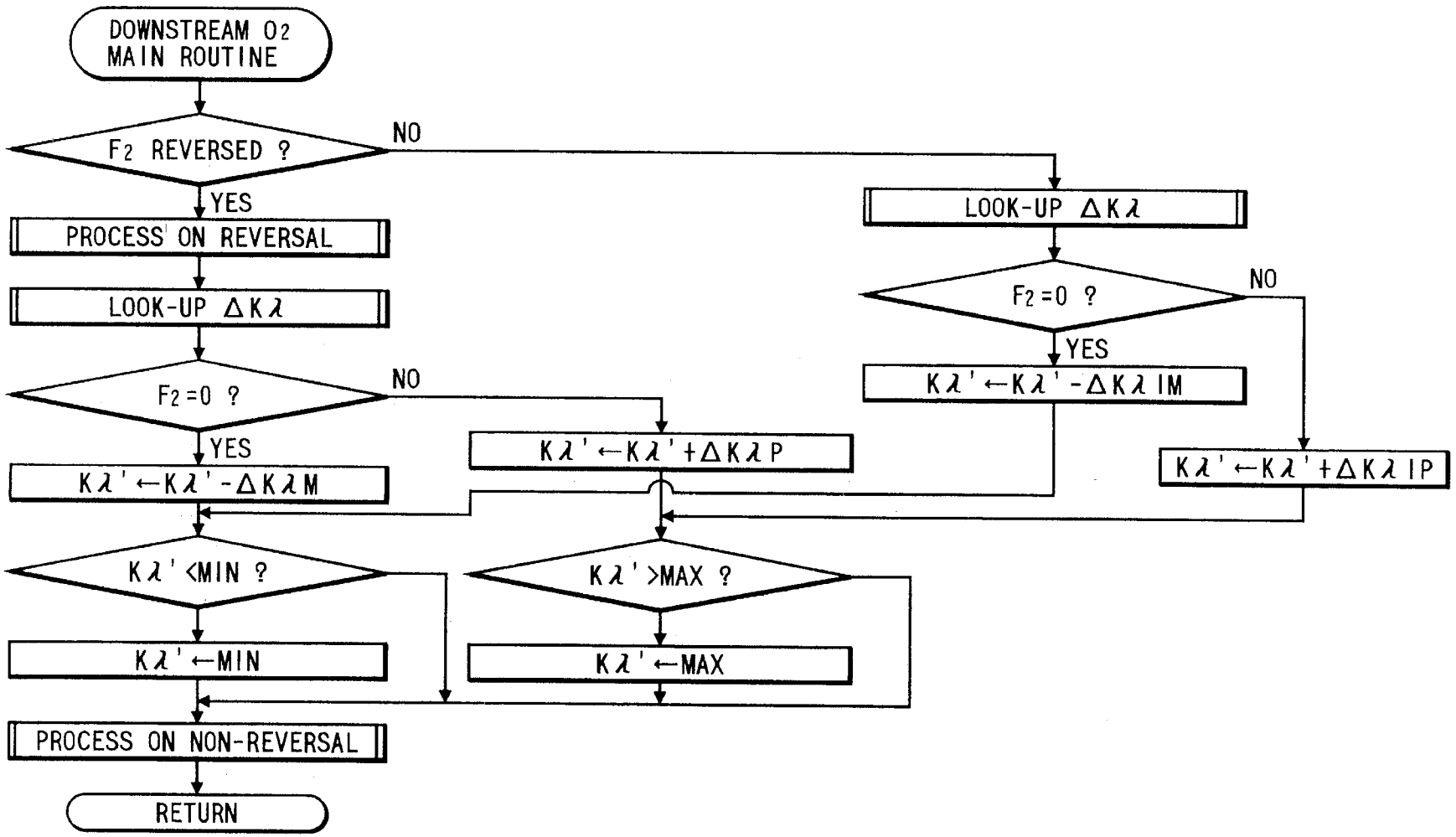
Figure 39:
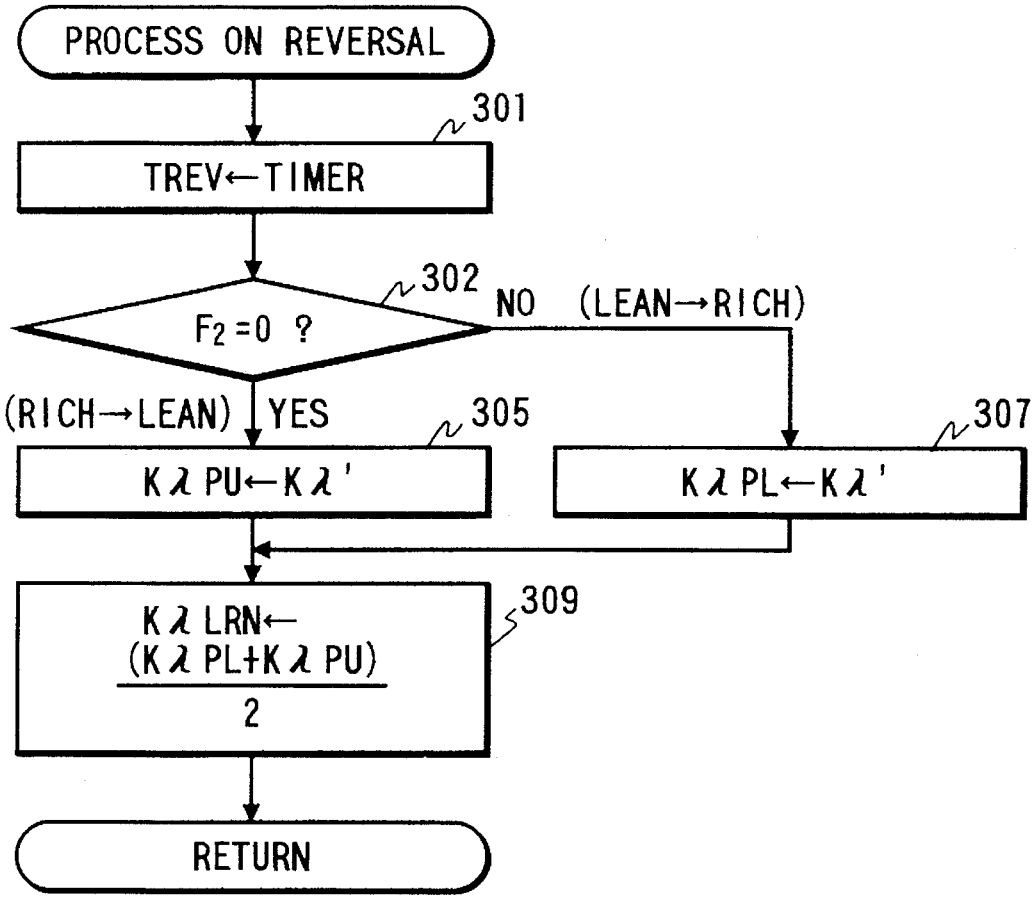
Figure 40:
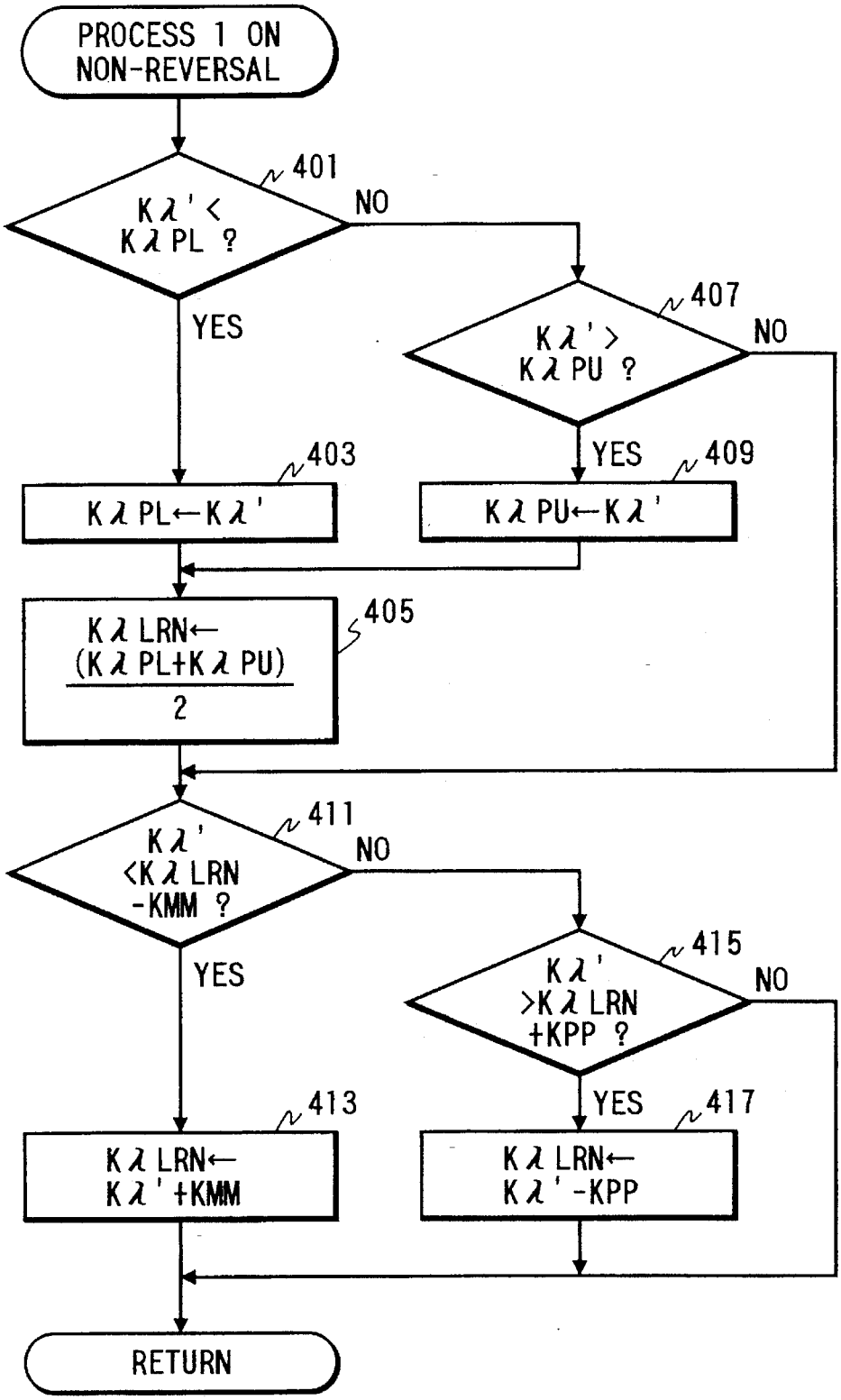
Figure 41:
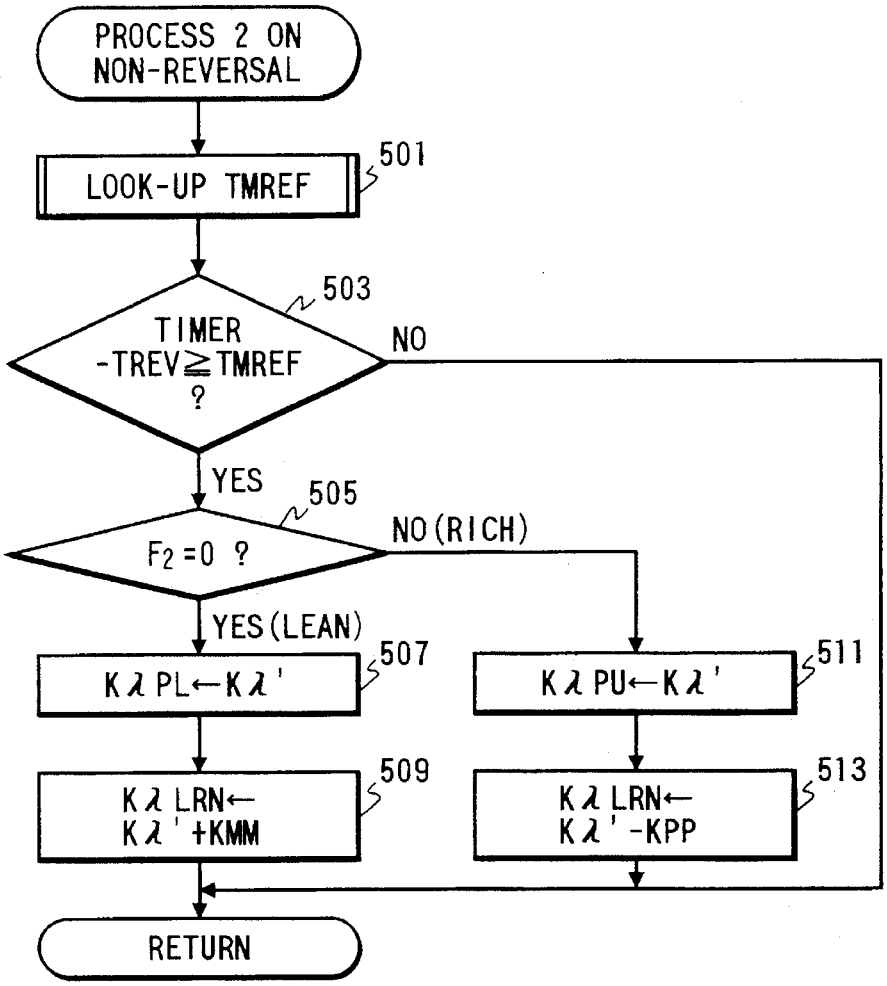
Figure 42:
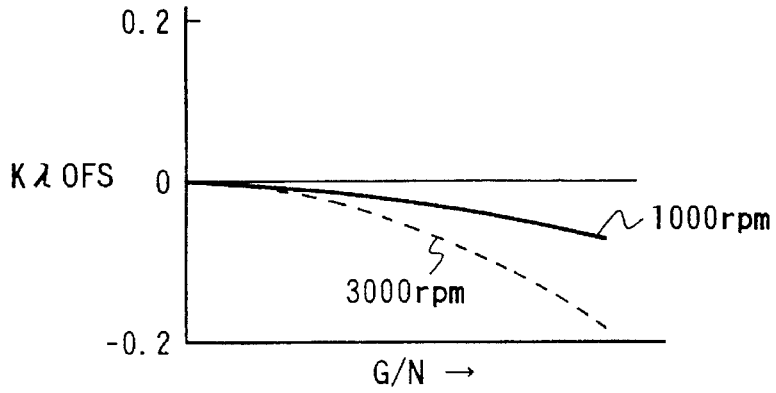
FIGS. 42 to 45 show maps used in the flowcharts, as shown in FIGS. 36 to 41, which correspond to FIGS. 10, 8, 9, and 13.
Figure 43:
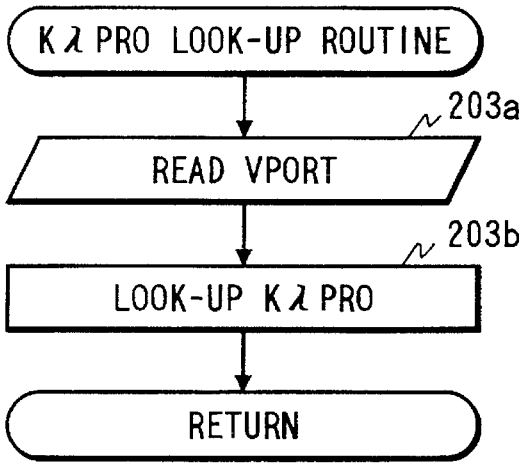
Figure 44:
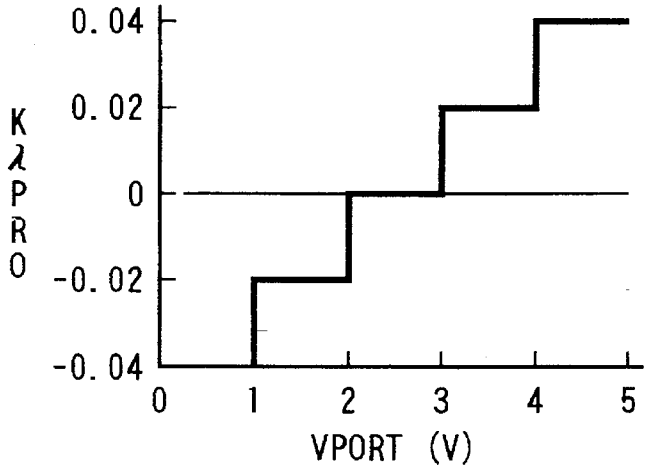
Figure 45:
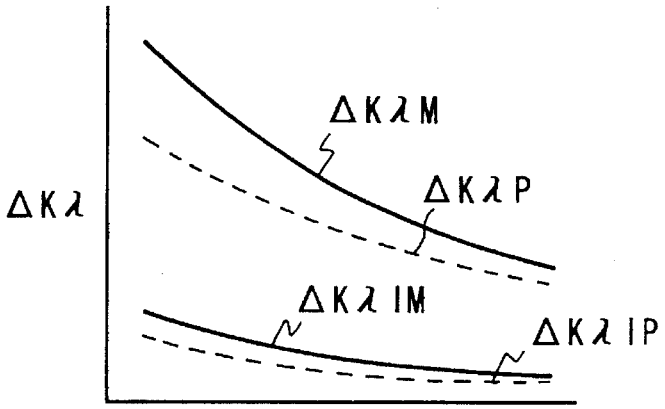

In FIG. 35, the broken line indicates the variation in the control excess air ratio λ2 which forms the same area (i.e., the average of λ2) on the rich and lean side across the stoichiometric air-fuel ratio of 1.0. In the variation in the control excess air ratio λ2 along the solid line, a line defines the same area (i.e., the average of λ2) on the rich and lean side is shifted toward the lean side from the stoichiometric air-fuel ratio.

As a result of the shift to the lean side, the air-fuel ratio control functions so as to correct an air-fuel ratio to the rich side. Similarly, if the control excess air ratio λ2 is shifted toward the rich side, as opposite to FIG. 34, the air-fuel ratio is corrected toward the lean side. The fine adjustment of the center of the air-fuel ratio control is, thus, accomplished by changing or resetting an amount and a direction of such a shift of the control excess air ratio λ2. Accordingly, even if the optimum air-fuel ratio for reducing harmful exhaust gases to meet emission regulations differs due to individual properties of each engine, the center of the air-fuel ratio control is easily adjusted to the required optimum air-fuel ratio by resetting the above-noted shift of the control excess air ratio λ2.

Hereinbelow, the manner that controls the control excess air ratio λ2 under the downstream $O_2$ feedback control using the output from the downstream air-fuel ratio sensor 119 to change the λ2-characteristics of the correction linearizer 51, will be discussed.

In FIG. 30(*a*), assuming that a value of the control excess air ratio λ2 when the standard excess air ratio λ1 represents 1.0, is kλ, as long as a value of kλ is derived by the downstream $O_2$ feedback control, a value of the control excess air ratio λ2 relative to a variation in the standard excess air ratio λ1 can be given by a known linear function based on fixed points a and b. According to this way, the λ2-characteristics of the correction linearizer 51 are changed.

FIGS. 36 to 41 are flowcharts for correcting kλ under downstream $O_2$ feedback control. FIGS. 42 to 45 show maps used in these flowcharts. The logical operations shown are substantially the same as those of the above mentioned first embodiment, as shown in FIGS. 6, 7, 11, 12, 15, and 20, but however, different therefrom in that as Δλ (corresponding to the skip correction parameter RSR' in the first embodiment) is increased, the air-fuel ratio is shifted to the lean side. Thus, when the air-fuel ratio moves toward the lean side, Δλ is decreased, while when it moves toward the rich side, Δλ is increased. The operation of the downstream $O_2$ feedback control is the same as that of the first embodiment and explanation thereof in detail will be omitted here.

Now, referring back to FIG. 28, the upstream $O_2$ feedback control will further be described hereinbelow in detail.

During the non-idling engine operation, the deviation Δλ outputted from the deviation calculation circuit 55 is fed to a PID controller 59 and a PI controller 61, respectively. The PID controller 59 is for a steady engine operation and the PI controller 61 is for an immediate acceleration operation.

The PID controller 59 performs the feedback control expressed by the following transfer function Gc(S):

$$Gc(S) = Kp + \frac{Ki}{S} + \frac{K_K \cdot S}{1 + Kd \cdot S} \quad (1)$$

where $K_P$ is a proportional constant, Ki is an integral constant, $K_K$ is a differential constant, and Kd is a differential weight constant.

In the above equation (1), a differential factor (K·S)/(1+Kd. S) represents an approximate expression.

In practice, step 720 in the upstream $O_2$ feedback control routine, as shown in FIG. 27, mathematically determines the air-fuel ratio correction amount FAF in accordance with the following equation (2) which is equivalent to the equation (1).

$$FAF = FAFP + FAFI + FAFD \quad (2)$$

where $FAFP = K_P \cdot \Delta\lambda$ $FAFI = Ki \cdot \Delta\lambda + FAFI_{i-1}$ $FAFD = \{K_K \cdot (\Delta\lambda - \Delta\lambda_{i-1}) + Kd \cdot FAFD_{i-1}\}/(Kd+1)$ In the above expression, FAF is the air-fuel ratio correction mount, FAFP is a proportional portion, FAFI is an integral portion, FAFD is a differential portion, and $\Delta\lambda$ is the deviation $\Delta\lambda$.

When determining FAF in practice, $\Delta\lambda$, FAFP, FAFI, and FAFD are calculated sequentially every 16 mesec. The subscript i−1 represents a value derived in a last calculation cycle 16 msec. before.

When the PI controller 61 is activated, it performs in step 720 of FIG. 27 an arithmetic operation according to the equations (1) and (2) where $K_K$=Kd=0. Note that values of $K_K$ and Kd may be different from those used in the PID controller 59.

The air-fuel ratio correction amount FAF derived in the above manner is provided from the PID controller 59 or the PI controller 61 to a first selection circuit 63. The first selection circuit 63 also receives a pressure variation data ΔPm per one revolution of the engine or unit time determined based on the output from the airflow meter 13, and determines (in step 660) whether the engine is in the steady operation or under the immediate acceleration or not. If it has been concluded that the engine is in the steady operation, then FAF calculated by the PID controller 59 is fed to a second selection circuit 67. Alternatively, if it has been concluded that the engine is under the immediate acceleration, FAF calculated by the PI controller 61 is fed to the second selection circuit 67.

During the idling engine operation, the deviation $\Delta\lambda$, outputted from the deviation calculation circuit 57, is fed to a PI controller 65. The PI controller 65, similar to the PI controller 61, performs an arithmetic operation (step 720) according to the equations (1) and (2) where $K_K$=Kd=0 to realize the PI control. Note that values of $K_K$ and Kd may be different from those used in the non-idling engine operation.

The air-fuel ratio correction amount FAF derived by the PI controller 61 is fed to the second selection circuit 67. The second selection circuit 67 also receives an output signal from the idle switch **15*b*, and determines (in step 630) whether the engine is idling or not based on the status of the idle switch 15*b*. If it has been concluded that the engine is not in the idle mode, then the second selection circuit 67 provides FAF calculated by the PID controller 59 or 61 to the engine 1. Alternatively, if it has been concluded that the engine is in the idle mode, the second selection circuit 67 provides FAF calculated by the PI controller 65 to the engine 1. The engine 1** is brought under the air-fuel feedback control based on the air-fuel ratio correction amount FAF thus provided in a known manner.

As appreciated from the foregoing description, the use of the linearized PID control in the upstream $O_2$ feedback control greatly enhances the controllability of the air-fuel ratio. Additionally, in stead of the electromotive type air-fuel ratio sensors 19 and 119 used in the PID control, a limiting current type air-fuel ratio sensor may be employed. Further, in place of the airflow meter 13, an intake air pressure sensor or a throttle sensor may be used to derive the parameters, as described above, determined based on the output from the airflow meter.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An air-fuel ratio control apparatus for an internal combustion engine comprising:

an upstream air-fuel ratio sensor arranged in a portion of an exhaust passage of the internal combustion engine upstream of a catalytic converter to provide a signal having a sensor parameter indicative of an air-fuel ratio of an air-fuel mixture;

a downstream air-fuel ratio sensor arranged in a portion of the exhaust passage downstream of the catalytic converter to provide a signal having a sensor parameter indicative of the air-fuel ratio;

control parameter determining means for determining a given control parameter used for controlling the air-fuel ratio under air-fuel ratio control based on the signal outputted from said downstream air-fuel ratio sensor;

learning means for learning the given control parameter determined by said control parameter determining means in timing where the signal outputted form said downstream air-fuel ratio sensor is reversed between a first sensor parameter indicating that the air-fuel ratio is on a rich side and a second sensor parameter indicating that the air-fuel ratio is on a lean side;

air-fuel ratio control means for performing the air-fuel ratio control based on the signal outputted from said upstream air-fuel ratio sensor and the given control parameter either determined by said control parameter determining means or learned by said learning means; and learning execution means for executing a learning operation of said learning means when the a preselected condition is encountered.

2. An air-fuel ratio control apparatus as set forth in claim 1, wherein said learning execution means executes the learning operation of said learning means when the given control parameter determined by said control parameter determining means exceeds a value of the given control parameter determined upon before-last reversal of the signal outputted from said downstream air-fuel sensor.

3. An air-fuel ratio control apparatus as set forth in claim 1, wherein said learning execution means executes the learning operation of said learning means when the given control parameter determined by said control parameter determining means moves out of a value of said control parameter learned by said learning means, by a preselected degree.

4. An air-fuel ratio control apparatus as set forth in claim 1, wherein said learning execution means executes the learning operation of said learning means after a predetermined period of time following a last reversal of the signal outputted from said downstream air-fuel sensor.

5. An air-fuel ratio control apparatus as set forth in claim 4, wherein said preselected period of time is set based on a flow rate of exhaust gas of the internal combustion engine.

6. An air-fuel ratio control apparatus for an internal combustion engine comprising:

an upstream air-fuel ratio sensor arranged in a portion of an exhaust passage of the internal combustion engine upstream of a catalytic converter to provide a signal having a sensor parameter indicative of an air-fuel ratio of an air-fuel mixture;

a downstream air-fuel ratio sensor arranged in a portion of the exhaust passage downstream of the catalytic converter to provide a signal having a sensor parameter indicative of the air-fuel ratio;

control parameter determining means for determining a given control parameter for controlling the air-fuel ratio of the air-fuel mixture, based on the sensor parameter provided by said downstream air-fuel ratio sensor under a given condition;

air-fuel ratio controlling means for controlling the air-fuel ratio of the air-fuel mixture based on the sensor parameter provided by said upstream air-fuel ratio sensor, said air-fuel ratio controlling means correcting the air-fuel ratio based on the given control parameter determined by said control parameter determining means;

learning means for learning the given control parameter to derive a learning value and storing the learning value every given cycle under said given condition;

storing means for storing the given control parameter determined by said control parameter determining means;

convergence determining means for determining whether the learning value learned by said learning means has converged or not; and control parameter updating means for updating the given control parameter to a value within a given range including a value of the given control parameter stored in said storing means when said convergence determining means concludes that the learning value is not converged.

7. An air-fuel ratio control apparatus as set forth in claim 6, wherein the given cycle during which said learning means learns the given control parameter is defined by a time duration the signal outputted from said downstream air-fuel ratio sensor is reversed between a first sensor parameter indicating that the air-fuel ratio is rich and a second sensor parameter indicating that the air-fuel ratio is lean.

8. An air-fuel ratio control apparatus as set forth in claim 6, wherein said storing means, when a second condition different from said given condition is encountered, stores a value of the given control parameter determined before the second condition is encountered.

9. An air-fuel ratio control apparatus as set forth in claim 6, wherein the value updated by said control parameter updating means when said convergence determining means concludes that the learning value is not converged, is the value of the given control parameter stored in said storing means.

10. An air-fuel ratio control apparatus as set forth in claim 6, wherein said convergence determining means determines that the learning value is converged when a status of the air-fuel ratio determined based on the sensor parameter provided by said downstream air-fuel ratio sensor when a second condition different from said given condition is encountered, is different from a status of the air-fuel ratio determined based on the sensor parameter provided by said downstream air-fuel ratio sensor upon encountering said given condition again.

11. An air-fuel ratio control apparatus as set forth in claim 6, wherein said convergence determining means determines that the learning value is converged when the sensor parameter provided by said downstream air-fuel ratio sensor shows that the air-fuel ratio has been reversed a preselected number of times between a rich side and a lean side.

12. An air-fuel ratio control apparatus as set forth in claim 6, further comprising prohibiting means for prohibiting an operation of said control parameter determining means for a given period of time when said given condition is met again after the apparatus is brought from said given condition under a second condition different from said given condition.

13. An air-fuel ratio control apparatus as set forth in claim 12, further comprising operation resuming means for resuming the operation of said control parameter determining means after the learning value is set as the control parameter when the sensor parameter provided by said downstream air-fuel ratio sensor has been reversed during a time when said prohibiting means prohibits the operation of said control parameter determining means.

14. An air-fuel ratio control apparatus as set forth in claim 6, further comprising canceling means for canceling processing of said control parameter updating means based on determination results of said convergence determining means.

15. An air-fuel ratio control apparatus for an internal combustion engine comprising:

an upstream air-fuel ratio sensor arranged in a portion of an exhaust passage of the internal combustion engine upstream of a catalytic converter to provide a signal having a sensor parameter indicative of an air-fuel ratio of an air-fuel ratio mixture;

a downstream air-fuel ratio sensor arranged in a portion of the exhaust passage downstream of the catalytic converter to provide a signal having a sensor parameter indicative of the air-fuel ratio;

first air-fuel ratio controlling means for controlling the air-fuel ratio of the air-fuel mixture of the internal combustion engine, said first air-fuel ratio controlling means determining an air-fuel ratio correction amount based on the sensor parameter provided by said upstream air-fuel ratio sensor and correcting the air-fuel ratio correction amount based on the sensor parameter provided by said downstream air-fuel ratio sensor to control the air-fuel ratio of the air-fuel mixture;

second air-fuel ratio controlling means for controlling the air-fuel ratio of the air-fuel mixture, said second air-fuel ratio controlling means determining an air-fuel ratio correction amount based on the sensor parameter provided by said downstream air-fuel ratio sensor to control the air-fuel ratio;

sensor parameter determining means for determining if the sensor parameter provided by said downstream air-fuel ratio sensor falls within a given range to provide a first signal indicative of the sensor parameter falling within the given range and a second signal indicative of the sensor parameter lying out of the given range; and control mode selecting means for selecting between a first, control mode and a second control mode, the first mode being such that said first air-fuel ratio controlling means is activated in response to the first signal provided by said sensor parameter determining means, the second control mode being such that said second air-fuel ratio controlling means is activated in response to the second signal provided by said sensor parameter determining means.

16. An air-fuel ratio control apparatus as set forth in claim 15, further comprising engine operating condition determining means for determining a given engine operating condition, said second air-fuel ratio controlling means including correcting means for correcting the air-fuel ratio correction amount based on the engine operating condition determined by said engine operating condition determining means.

17. An air-fuel ratio control apparatus as set forth in claim 16, further comprising a flow rate determining means for determining a flow rate of exhaust gas flowing through the exhaust passage, the correcting means correcting the air-fuel ratio correction amount based on the flow rate of the exhaust gas determined by said flow rate determining means.

18. An air-fuel ratio control apparatus as set forth in claim 16, wherein the correction means corrects the air-fuel ratio correction amount based on the sensor parameter provided by said upstream air-fuel ratio sensor.

19. An air-fuel ratio control apparatus as set forth in claim 16, wherein said correction means corrects the air-fuel ratio correction mount based on a time lapsed from provision of the second signal by said sensor parameter determining means.

20. An air-fuel ratio control apparatus as set forth in claim 16, wherein said correction means corrects the air-fuel ratio correction amount based on a deviation of the sensor parameter provided by said downstream air-fuel ratio sensor from a value indicative of a stoichiometric air-fuel ratio.

21. An air-fuel ratio control parameter as set forth in claim 16, wherein said second air-fuel ratio controlling means determines the air-fuel ratio correction amount by adding or subtracting a preselected value to or from an average value of the air-fuel ratio correction amounts derived before the sensor parameter provided by said downstream air-fuel ratio sensor moves out of the given range, based on the sensor parameter provided by said downstream air-fuel ratio sensor, said correction means correcting the preselected value based on the engine operating condition.

22. An air-fuel ratio control apparatus as set forth in claim 16, wherein said second air-fuel ratio controlling means determines the air-fuel ratio correction amount by adding or subtracting a preselected value to or from a reference value of one (1) based on the sensor parameter provided by said downstream air-fuel ratio sensor, said correction means correcting the preselected value based on the engine operating condition.

23. An air-fuel ratio control apparatus as set forth in claim 21, wherein the average value of the air-fuel ratio correction amounts is determined based on values derived upon two successive previous reversals of the sensor parameter provided by said downstream air-fuel ratio sensor between a first sensor parameter indicating that the air-fuel ratio is on a rich side and a second sensor parameter indicating that the air-fuel ratio is on a lean side.

24. An air-fuel ratio control apparatus for an internal combustion engine comprising:

an upstream air-fuel ratio sensor arranged in a portion of an exhaust passage of the internal combustion engine upstream of a catalytic converter to provide a signal having a sensor parameter indicative of an air-fuel ratio of an air-fuel mixture;

a downstream air-fuel ratio sensor arranged in a portion of the exhaust passage downstream of the catalytic converter to provide a signal having a sensor parameter indicative of the air-fuel ratio;

control parameter determining means for determining a given control parameter for controlling the air-fuel ratio of the air-fuel mixture, based on the sensor parameter provided by said downstream air-fuel ratio sensor under a given condition;

learning means for learning the given control parameter determined by said control parameter determining means in timing where the signal outputted form said downstream air-fuel ratio sensor is reversed between a first sensor parameter indicating that the air-fuel ratio is on a rich side and a second sensor parameter indicating that the air-fuel ratio is on a lean side, to derive a learning value, said learning means storing the learning value;

air-fuel ratio control means for performing the air-fuel ratio control based on the signal outputted from said upstream air-fuel ratio sensor and either of the given control parameter determined by said control parameter determining means and the learning value learned by said learning means;

learning execution means for executing a learning operation of said learning means when the signal provided by said downstream air-fuel ratio sensor provides a parameter indicative of a preselected condition;

storing means for storing the given control parameter determined by said control parameter determining means;

convergence determining means for determining whether the learning value learned by said learning means has converged or not; and control parameter updating means for updating the given control parameter to a value within a given range including a value of the given control parameter stored in said storing means when said convergence determining means concludes that the learning value is not converged.

25. An air-fuel ratio control apparatus for an internal combustion engine comprising:

an upstream air-fuel ratio sensor arranged in a portion of an exhaust passage of the internal combustion engine upstream of a catalytic converter to provide a signal having a sensor parameter indicative of an air-fuel ratio of an air-fuel mixture;

a downstream air-fuel ratio sensor arranged in a portion of the exhaust passage downstream of the catalytic converter to provide a signal having a sensor parameter indicative of the air-fuel ratio;

control parameter determining means for determining a given control parameter used for controlling the air-fuel ratio under air-fuel ratio control based on the signal outputted from said downstream air-fuel ratio sensor;

learning means for learning the given control parameter determined by said control parameter determining means in timing where the signal outputted form said downstream air-fuel ratio sensor is reversed between a first sensor parameter indicating that the air-fuel ratio is on a rich side and a second sensor parameter indicating that the air-fuel ratio is on a lean side;

learning execution means for executing a learning operation of said learning means when the signal provided by said downstream air-fuel ratio sensor provides a parameter indicative of a preselected condition;

first air-fuel ratio controlling means for controlling the air-fuel ratio of the air-fuel mixture of the internal combustion engine, said first air-fuel ratio controlling means determining an air-fuel ratio correction amount based on the sensor parameter provided by said upstream air-fuel ratio sensor and correcting the air-fuel ratio correction amount based the given control parameter either determined by said control parameter determining means or learned by said learning means to control the air-fuel ratio of the air-fuel mixture;

second air-fuel ratio controlling means for controlling the air-fuel ratio of the air-fuel mixture, said second air-fuel ratio controlling means determining an air-fuel ratio correction amount based on the sensor parameter provided by said downstream air-fuel ratio sensor to control the air-fuel ratio;

sensor parameter determining means for determining if the sensor parameter provide by said downstream air-fuel ratio sensor falls within a given range to provide a first signal indicative of the sensor parameter falling within the given range and a second signal indicative of the sensor parameter lying out of the given range; and control mode selecting means for selecting between a first control mode and a second control mode, the first mode being such that said first air-fuel ratio controlling means is activate in response to the first signal provided by said sensor parameter determining means, the second control mode being such that said second air-fuel ratio controlling means is activated in response to the second signal provided by said sensor parameter determining means.

26. An air-fuel ratio control apparatus for an internal combustion engine comprising:

an upstream air-fuel ratio sensor arranged in a portion of an exhaust passage of the internal combustion engine upstream of a catalytic converter to provide a signal having a sensor parameter indicative of an air-fuel ratio of an air-fuel mixture;

a downstream air-fuel ratio sensor arranged in a portion of the exhaust passage downstream of the catalytic converter to provide a signal having a sensor parameter indicative of the air-fuel ratio;

control parameter determining means for determining a given control parameter for controlling the air-fuel ratio of the air-fuel mixture, based on the sensor parameter provided by said downstream air-fuel ratio sensor under a given condition;

learning means for learning the given control parameter to derive a learning value and storing the learning value every given cycle under said given condition;

storing means for storing the given control parameter determined by said control parameter determining means;

convergence determining means for determining whether the learning value learned by said learning means has converged or not;

control parameter updating means for updating the given control parameter to a value within a given range including a value of the given control parameter stored in said storing means when said convergence determining means concludes that the learning value is not converged;

first air-fuel ratio controlling means for controlling the air-fuel ratio of the air-fuel mixture of the internal combustion engine, said first air-fuel ratio controlling means determining an air-fuel ratio correction amount based on the sensor parameter provided by said upstream air-fuel ratio sensor and correcting the air-fuel ratio correction amount based on the given control parameter either determined by said control parameter determining means or learned by said learning means to control the air-fuel ratio of the air-fuel mixture;

second air-fuel ratio controlling means for controlling the air-fuel ratio of the air-fuel mixture, said second air-fuel ratio controlling means determining an air-fuel ratio correction amount based on the sensor parameter provided by said downstream air-fuel ratio sensor to control the air-fuel ratio;

sensor parameter determining means for determining if the sensor parameter provided by said downstream air-fuel ratio sensor falls within a given range to provide a first signal indicative of the sensor parameter falling within the given range and a second signal indicative of the sensor parameter lying out Of the given range; and control mode selecting means for selecting between a first control mode and a second control mode, the first mode being such that said first air-fuel ratio controlling means is activated in response to the first signal provided by said sensor parameter determining means, the second control mode being such that said second air-fuel ratio controlling means is activated in response to the second signal provided by said sensor parameter determining means.

27. An air-fuel ratio control apparatus for an internal combustion engine comprising:

an upstream air-fuel ratio sensor arranged in a portion of an exhaust passage of the internal combustion engine upstream of a catalytic converter to provide a signal having a sensor parameter indicative of an air-fuel ratio of an air-fuel mixture;

a downstream air-fuel ratio sensor arranged in a portion of the exhaust passage downstream of the catalytic converter to provide a signal having a sensor parameter indicative of the air-fuel ratio;

control parameter determining means for determining a given control parameter for controlling the air-fuel ratio of the air-fuel mixture, based on the sensor parameter provided by said downstream air-fuel ratio sensor under a given condition;

learning means for learning the given control parameter determined by said control parameter determining means in timing where the signal outputted form said downstream air-fuel ratio sensor is reversed between a first sensor parameter indicating that the air-fuel ratio is on a rich side and a second sensor parameter indicating that the air-fuel ratio is on a lean side;

learning execution means for executing a learning operation of said learning means when the signal provided by said downstream air-fuel ratio sensor provides a parameter indicative of a preselected condition;

storing means for storing the given control parameter determined by said control parameter determining means;

convergence determining means for determining whether the learning value learned by said learning means has converged or not;

control parameter updating means for updating the given control parameter to a value within a given range including a value of the given control parameter stored in said storing means when said convergence determining means concludes that the learning value is not converged;

first air-fuel ratio controlling means for controlling the air-fuel ratio of the air-fuel mixture of the internal combustion engine, said first air-fuel ratio controlling means determining an air-fuel ratio correction amount based on the sensor parameter provided by said upstream air-fuel ratio sensor and correcting the air-fuel ratio correction amount based the given control parameter either determined by said control parameter determining means or learned by said learning means to control the air-fuel ratio of the air-fuel mixture;

second air-fuel ratio controlling means for controlling the air-fuel ratio of the air-fuel mixture, said second air-fuel ratio controlling means determining an air-fuel ratio correction amount based on the sensor parameter provided by said downstream air-fuel ratio sensor to control the air-fuel ratio;

sensor parameter determining means for determining if the sensor parameter provided by said downstream air-fuel ratio sensor falls within a given range to provide a first signal indicative of the sensor parameter falling within the given range and a second signal indicative of the sensor parameter lying out of the given range; and control mode selecting means for selecting between a first control mode and a second control mode, the first mode being such that said first air-fuel ratio controlling means is activated in response to the first signal provided by said sensor parameter determining means, the second control mode being such that said second air-fuel ratio controlling means is activated in response to the second signal provided by said sensor parameter determining means.

* * * * *